US008282090B2

(12) United States Patent
Walsh et al.

(10) Patent No.: US 8,282,090 B2
(45) Date of Patent: Oct. 9, 2012

(54) HIGH SPEED INTERFOLDER SEPARATOR

(75) Inventors: James Andrew Walsh, Ashland, WI (US); James R. Michler, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 2 days.

(21) Appl. No.: 12/986,913

(22) Filed: Jan. 7, 2011

(65) Prior Publication Data

US 2011/0154782 A1 Jun. 30, 2011

Related U.S. Application Data

(63) Continuation-in-part of application No. 12/649,935, filed on Dec. 30, 2009.

(51) Int. Cl.
*B41L 1/32* (2006.01)

(52) U.S. Cl. ..... 270/39.02; 270/39.01; 270/39.05; 270/39.06

(58) Field of Classification Search ..... 270/30.01, 270/30.04, 30.05, 30.06, 30.1, 30.11, 30.12, 270/30.13, 39.01, 39.02, 39.05, 39.06; 414/788.1, 414/789.9, 790, 802
See application file for complete search history.

(56) References Cited

U.S. PATENT DOCUMENTS

| | | | | |
|---|---|---|---|---|
| 2,675,747 | A | 4/1954 | Greiner et al. | |
| 2,761,677 | A | 9/1956 | Rutkus et al. | |
| 3,207,361 | A | 9/1965 | Marcalus | |
| 4,290,226 | A * | 9/1981 | Stauffer | 446/46 |
| 4,494,741 | A | 1/1985 | Fischer et al. | |
| 4,700,939 | A | 10/1987 | Hathaway | |
| 4,717,135 | A | 1/1988 | Hathaway | |
| 4,721,295 | A | 1/1988 | Hathaway | |
| 4,770,402 | A | 9/1988 | Couturier | |
| 4,824,426 | A | 4/1989 | DuFresne | |
| 4,874,158 | A | 10/1989 | Retzloff | |
| 4,917,365 | A | 4/1990 | Stemmler et al. | |
| 5,088,707 | A | 2/1992 | Stemmler | |
| 5,299,793 | A | 4/1994 | Couturier | |
| 5,366,434 | A * | 11/1994 | Green, Jr. | 493/414 |
| 5,730,695 | A | 3/1998 | Hauschild et al. | |
| 6,090,467 | A | 7/2000 | Yip | |
| 6,165,116 | A | 12/2000 | White | |
| 6,254,522 | B1 | 7/2001 | Schmidt | |
| 6,322,315 | B1 | 11/2001 | Schmidt, et al. | |

(Continued)

FOREIGN PATENT DOCUMENTS

JP 61-037668 A 2/1986

(Continued)

*Primary Examiner* — Leslie A Nicholson, III
(74) *Attorney, Agent, or Firm* — Reinhart Boerner Van Deuren P.C.

(57) ABSTRACT

An interfolder separator apparatus and method utilize a pair of count fingers that are movable longitudinally along and transversely to a stream of folded sheets, for temporarily supporting each successive pack formed by the separator and then releasing each successive pack when partly completed to alternating build fingers, so that the operation of separating successive packs from one another is performed separately from the operations of completing the build of each pack and transporting the completed packs to downstream operations. The count fingers may be mounted to pivot about axes that are movable longitudinally along and transversely to the stream of sheets. A first or last panel of the completed pack may also be folded back partly upon itself, after the partly completed pack is released by the count fingers. Some or all of the fingers may be spring loaded and automatically resettable for clearing jams.

6 Claims, 57 Drawing Sheets

U.S. PATENT DOCUMENTS

| | | | |
|---|---|---|---|
| 6,641,358 | B2 | 11/2003 | Schmidt, et al. |
| 6,712,746 | B1 | 3/2004 | White |
| 6,832,886 | B2 | 12/2004 | Michler et al. |
| 2004/0126172 | A1 | 7/2004 | Matteis |
| 2006/0073007 | A1 | 4/2006 | De Matteis |

FOREIGN PATENT DOCUMENTS

| | | | |
|---|---|---|---|
| JP | 7-053122 | A | 2/1995 |

* cited by examiner

HIGH SPEED INTERFOLDER SEPARATOR

CROSS-REFERENCE TO RELATED PATENT APPLICATIONS

This patent application is a Continuation-in-Part of co-pending U.S. patent application Ser. No. 12/649,935, filed Dec. 30, 2009, the entire teachings and disclosure of which are incorporated herein by reference thereto.

FIELD OF THE INVENTION

This invention relates to apparatuses and methods for separating stacks of folded, or interfolded, sheets into packs having a desired number of sheets, and in some cases having a sheet at the beginning or end of the pack folded in a particular configuration to facilitate removal of individual sheets from the completed pack.

BACKGROUND OF THE INVENTION

There are many products, as exemplified by paper tissue, toweling and napkins, etc., which are commonly provided to consumers in stacked form as packs of folded or interfolded individual sheets. These packs of stacked sheets are often staple items which must be produced at very low cost. Producing such products at low cost typically requires the use of high-speed processes and equipment. Such processes are not limited to the production and delivery of paper products, but are widely used in the production of other products such as foil, textile, synthetic sheeting and other industries.

Experience has shown that the steps of cutting individual sheets from a web or webs of material, and folding or interfolding the individual sheets to form a stack of folded sheets can be accomplished at higher speeds than subsequent downstream processes such as: separating a stack of the folded material into individual packs having a desired number of sheets; performing secondary folding of a lead or trailing sheet of each pack; and delivering the completed pack to downstream packaging equipment used to wrap or otherwise prepare the completed packs for delivery and sale.

In the past, a variety of approaches have been utilized for: separating stacks of folded sheets into packs; performing any necessary secondary folding operations; and transporting the completed packs to downstream processing equipment. Some of these prior approaches are illustrated in the following US patents which are commonly assigned to the assignee of the present invention: U.S. Pat. No. 4,770,402 to Couturier; U.S. Pat. No. 4,874,158 to Retzloff; U.S. Pat. No. 6,641,358 to Schmidt et al.; and U.S. Pat. No. 6,322,315 to Schmidt et al.

Although all of the prior approaches described in the above-listed patents of the assignee of the present invention have been, and continue to be, highly successful in their application, further improvement is desirable. Specifically, a continuing need exists for improved apparatuses and methods for separating a completed pack of folded or interfolded sheets from a partly complete pack, while continuing to build the partly completed pack, and transporting the completed pack to downstream operations at higher speed than has previously been attainable. It is also desirable that such improved apparatuses and methods be configured to allow clearing of jams and misfeeds more quickly and with less downtime than prior approaches. It is further desirable that an improved apparatus and/or method be capable of performing final folding operations in a more flexible manner to permit faster system operation.

BRIEF SUMMARY OF THE INVENTION

Through use of a number of innovative structures and methods, the invention provides an improved method and apparatus for separating stacks of interfolded or folded sheets into packs having a desired number of sheets, where the stacks of sheets are formed by a continuously flowing stream of folded sheets issuing downstream from a pair of folding rolls, along a sheet path extending through a nip between the pair of folding rolls, and having adjacent panels of the folded sheets forming successive folds which open alternately in opposite directions substantially transversely to the sheet path.

In one form of the invention, such improvements are provided by inserting a pair of count fingers into successive oppositely opening folds to initiate each new pack, and moving the count fingers in a downstream direction while continuing to at least partly build the next pack on upstream surfaces of the count fingers. The count fingers are then retracted by moving them substantially linearly oppositely from one another, outward from the sheet path to release the at least partly completed pack for movement downstream along the sheet path.

In some forms of the invention, the successive at least partly completed packs are released from the count fingers to a succession of two or more alternating build fingers, moved alternately through the stacking region for completion of the packs on the build fingers. The count and build fingers are configured and operatively interconnected in such a manner that the count fingers interact with each and every successive pack, whereas the two or more build fingers interact only with alternate ones of the packs in accordance with a number of build fingers.

In some forms of the invention, retracting the count fingers transfers a first at least partly completed pack to a build finger moving through the stacking region. The build finger receiving the first pack is then moved downstream along the sheet path as the at least partly completed first pack continues to build upon the build finger. The count fingers are then re-inserted into successive folds of the sheet stream above the build finger, to thereby initiate formation of a second new pack upon the count fingers. The count fingers then move in a downstream direction along the sheet path in the build region while continuing to at least partly build the second new pack on upstream surfaces of the count fingers. The count fingers may continue to support the second new pack while an apparatus or method according to the invention moves the first pack out of the build region with the build finger.

In some forms of the invention, after re-inserting the count fingers into the sheet stream to initiate formation of the second new pack, the build fingers supporting the completed first new pack are moved downstream at a speed faster then the speed at which the count fingers are moving downstream along the path. By virtue of this arrangement and operation, a space is provided between the last sheet of the first pack and the count fingers to facilitate separation of successive packs.

In some forms of the invention, as the second pack continues to build upon the count fingers while they are moving downstream, a second build finger is moved transversely across the sheet path over a last sheet of the completed first pack in such a manner that the second build finger lifts a last panel of the last sheet of the first pack upstream away from the remainder of the first pack. In some forms of the invention, the first pack is then pulled away from the second path along the sheet path while the first pack is resting on the first build finger and the second pack continues to build upon the count fingers.

In forms of the invention wherein a space is formed between the last sheet of the first pack and the count fingers, the second build finger may be inserted into that space. The invention may be practiced with efficacy, however, in embodiments which are not configured or operated to produce a space between the last sheet of the first pack and the count fingers.

Some forms of the invention may also include moving a strip finger transversely inward toward the sheet path across the last sheet of the first pack and beneath the first panel of the first pack, and utilizing the strip finger to facilitate pulling the first pack away from the second pack along the sheet path in combination with the first build finger. For embodiments in which a space is formed between the last sheet of the first pack and the count fingers, the second build finger and strip finger may be inserted into the space prior to pulling the first pack away from the second pack.

In one form of the invention, improvements are provided through use of a count finger arrangement, having first and second count fingers operatively configured and connected for periodic pivotable motion about respective first and second count finger axes, into successive oppositely opening folds, to form a completed pack downstream from the count fingers. The count fingers are also operatively configured and connected for movement of the count finger axes in a downstream direction while continuing to partly build the next pack on upstream surfaces of the count fingers. The count fingers are further operatively configured and connected to be retracted by moving them substantially linearly oppositely from one another outward from the sheet path, to release the partly completed pack for movement in a downstream direction along the sheet path.

The partly completed packs released by the count fingers may be supported on one of a plurality of alternately operating build fingers, after being released by the count fingers, as the partly completed packs are completed while resting on the build fingers with the count fingers in their retracted position. As a result of this construction and method of operation, the count fingers are utilized for supporting each successive pack and then releasing each successive pack when partly completed to alternating ones of the build fingers. In this manner, the operation of separating successive packs from one another is performed separately from the operations of completing the build of each pack and transporting the completed packs to downstream operations. Some forms of the invention also include apparatuses and methods for folding a first or last panel of the completed pack after the partly completed pack is released by the count finger arrangement.

By disconnecting the separation process from the other processes described above, the present invention provides a significant increase in the overall operational speed of an apparatus and/or method according to the invention, as compared to previous approaches.

In one form of a method, according to the invention, first and second count fingers are periodically pivoted about respective first and second count finger axes into successive oppositely opening folds, to form a completed pack downstream from the count fingers. The count finger axes are then moved in a downstream direction while continuing to partly build the next pack on upstream surfaces of the count fingers, as a pack build and transport arrangement moves the completed pack out of the stacking region. The count fingers are then refracted by moving them substantially linearly opposite from one another outward in a transverse direction with respect to the sheet path, to thereby transfer the partly completed next pack to the pack build and transport arrangement.

In some forms of a method or apparatus, according to the invention, a build and transport arrangement includes two or more build fingers that are alternately positionable in the stacking region, and configured for receiving partly completed packs from the count fingers. Once the partly completed packs are transferred to the build fingers from the count fingers, additional folded sheets from the sheet stream are stacked on an upstream end of the partly completed packs to form the completed packs supported by the build fingers. When the packs are completed, they are transported out of the stacking region by the build finger supporting the newly completed pack. The build fingers are operated alternately, in conjunction with the count fingers, to form a succession of completed packs, with the build fingers alternately transporting the completed packs from the stacking region.

In some forms of the invention, the build finger supporting the completed pack is moved substantially longitudinally along the sheet path, while the count fingers are supporting the next pack, to thereby facilitate separation of a last panel of the completed pack from a first panel of the next pack. Where the last and first panels are interfolded with one another, the invention may include pulling the interfolded panels away from one another prior to transporting the completed packs out of the stacking region. Where the first and the last panels are attached to one another, along a serration or other line of weakness for example, the invention may further include detaching the last and first panels from one another prior to transporting the completed packs out of the stacking region.

Some forms of the invention may include inserting a strip finger at least partly across an upstream surface of the completed pack, while the count fingers are supporting the next pack, prior to transporting the completed pack out of the stacking region.

Some forms of the invention may also include an apparatus or method for folding the first and/or the last panels at least partly back upon itself. In some forms of the invention this is accomplished by folding the last panel at least partly back upon itself, by folding a portion of the last panel around a distal end of a strip finger prior to retracting the strip finger.

In other forms of the invention, a panel folding arrangement may include a first panel folding finger that is operatively connected and configured to be inserted in an extended position thereof below the build finger supporting the completed pack, for folding the first panel of the completed pack at least partly back upon itself by folding a portion of the first panel around a distal end of the folding finger in the extended position, prior to retracting the strip finger from its extended position. In some forms of the invention, a fluid emitter is utilized for directing a flow of air or other fluid against the first and/or the last panel to facilitate folding of that panel at least partly back upon itself.

In some forms of the invention, the alternating build fingers are disposed on only one side of the sheet path. In other forms of the invention, the alternating build fingers are disposed on opposite sides of the sheet path.

In order to allow processing of packs having either an even or an odd number of folded sheets, some forms of the invention may also include a second strip finger, with the first and second strip fingers being operatively configured and operatively connected to the count fingers and the build fingers on opposite sides of the sheet path, in such a manner that one of the first and second strip fingers is utilized for providing packs having an even number of folded sheets, and both of the first and second strip fingers are utilized for packs having an odd number of folded sheets.

Some embodiments of the invention having first and second strip fingers disposed on opposite sides of the sheet path may further include a panel folding arrangement for folding at least one of the first and last panels at least partly back upon itself. In some forms of such a panel folding arrangement, the first and second strip fingers and the panel folding arrangement are operatively connected and configured for folding the last panel at least partly back upon itself, by folding a portion of the last panel around a distal end of the one of the first and second strip fingers prior to retracting the one of the first and second strip fingers.

In other embodiments of a panel folding arrangement for use in an apparatus or a method having first and second strip fingers disposed on opposite sides of the sheet path, the panel folding arrangement may include both a first and a second panel folding finger. The first panel folding finger may be operatively connected to the first strip finger and configured to be inserted in an extended position thereof below the build finger supporting the completed pack, for folding the first panel of the completed pack at least partly back upon itself, specifically by folding a portion of the first panel around a distal end of the first folding finger in the extended position, prior to retracting the first strip finger from its extended position. In similar fashion, the second panel folding finger may be operatively connected to the second stripping finger and configured to be inserted in an extended position thereof below the build finger supporting the completed pack, for folding the first panel of the completed pack at least partly back upon itself, by folding a portion of the first panel around a distal end of the second folding finger in its extended position, prior to retracting the second strip finger from the extended position. In some forms of the invention, a first and second folding finger may be operable for extension to, and retraction from their respective extended positions while the first and second strip fingers remain extended across the last sheet of the completed pack. Stated another way, in such forms of the invention, the first and second folding fingers are configured and operatively connected in such a manner that they are moveable relative to their cooperating strip finger, whereas in other embodiments of the invention, the separation and strip finger with which it is associated must move together and simultaneously.

In some forms of the invention, all of the separator fingers may be constructed and operated in a manner which allows them to automatically deflect and then return to their normal operating positions to deal with overloads, obstructions or jams within an apparatus according to the invention. In some forms of the invention having deflectable count fingers, the deflectable count fingers may be pivotably mounted for deflection about a count finger pivot axis for clearing overloads, obstructions or jams. Count fingers thus pivotably mounted may be used in normal operation in embodiments of a method and/or apparatus according to the invention wherein the count fingers pivot only for clearing of a jam, with normal insertion and extraction of the count fingers being accomplished through linear motion only of the count fingers along and transversely to the sheet path.

Some forms of the invention may also include an apparatus or method for separating adjacent stacks of interfolded or folded sheets of material utilizing a knock down finger to ensure proper spacing between adjacent stacks, i.e. packs, during separation. Such a method can include rotating the knock down finger into engagement with each completed pack after inserting at least one count finger to separate the completed pack from a next pack. Some forms of the invention include rotating the knock down finger such that the knock down finger contacts the completed pack downstream from the at least one count finger and downstream from each next pack. In some forms of the invention, the method can include retracting the knock down finger prior to retracting the at least one count finger from the next pack.

In some forms of the invention, methods include periodically pivoting the knock down finger about a count finger axis. Some other forms of the invention include moving the knock down finger in a downstream direction at the same speed as the first and second count finger axes.

In some forms of the invention, methods include pivoting a pair of count fingers about respective count finger axes into successive oppositely opening folds to initiate each new pack, and moving the count finger axes in a downstream direction while continuing to partly build the next pack on upstream surfaces of the count fingers, and then pivoting a knock down finger about at least one of the first and second count finger axes to contact a completed pack downstream of each new pack initiated.

In some forms of the invention, the method further includes moving the knock down finger with the pair of count fingers while the knock down finger is in contact with the completed pack, and while the next pack is being built on the top surface of each of the pair of count fingers. In some forms of the invention, the method further includes lowering the completed pack downstream from the next pack at a speed greater than the speed of movement of the count fingers in the downstream direction, and simultaneously pivoting the knock down finger with the lowering of the completed pack.

In some forms of the invention, pivoting the knock down finger includes pivoting the knock down finger in a first direction about at least one of the first and second count finger axes. In some forms of the invention, the method further includes pivoting the knock down finger in the second direction after lowering the completed pack.

In some forms of the invention, an apparatus incorporating a knock down finger is provided. The knock down finger is operatively connected such that the knock down finger is insertable downstream of the pair of count fingers to contact a last panel of a fully completed pack. In some forms of the invention, the knock down finger is commonly mounted with at least one of the pair of count fingers and is pivotable about a same axis as the at least one of the pair of count fingers to contact the last panel of the fully completed pack. In some forms of the invention, the knock down finger is retractable with the pair of count fingers.

In some forms of the invention, the apparatus includes a pack build arrangement and a pair of count fingers, with a knock down finger operatively configured and connected to the pack build arrangement for periodic pivotable motion to contact a last panel of a completed pack. In some forms of the invention, the pair of count fingers includes a first and a second count finger, and the knock down finger is commonly mounted with at least one of the first and second count fingers about at least one of a first and a second count finger axis, respectively. The knock down finger is pivotable about the respective first or second count finger axis. In some forms of the invention, the knock down finger is movable with at least one of the first and second count fingers in the downstream direction. In some forms of the invention, the knock down finger is commonly mounted with at least one of the count fingers for movement linearly oppositely away from the other one of the first and second count fingers.

In some forms of the invention, the apparatus includes a count finger arrangement and a build and transport arrangement. The count finger arrangement includes a knock down finger. The knock down finger is operatively configured and connected to the build and transport arrangement for periodic pivotable motion to contact a last panel of a completed pack. In some forms of the invention, the knock down finger is commonly mounted with at least one of the first and second count fingers about at least one of a first and second count finger axis, respectively. The knock down finger is pivotable about the respective first or second count finger axis. In some forms of the invention, the knock down finger is commonly mounted for movement with the first and second count finger axes in the downstream direction. In some forms of the invention, the knock down finger is commonly mounted for movement with the at least one of the first and second count fingers linearly oppositely away from the other of the first and second count fingers.

In some forms of the invention, an apparatus incorporating a knock down finger is provided. The apparatus includes at least one count finger insertable into adjacent successive folds to form a completed pack and to support a next pack as the next pack continues to build. The apparatus further includes a knock down finger operatively configured and connected to the at least one count finger to contact the completed pack downstream of the next pack and downstream of the at least one count finger to form a space between the completed pack and the next pack.

In some forms of the invention, the at least one count finger includes a first and a second count finger. The first and second count fingers are pivotable about first and second count finger axes, respectively, and movable in the downstream direction with the completed pack and the next pack, and wherein the knock down finger is commonly mounted with at least one of the first and second count fingers. In some forms of the invention, the knock down finger is commonly mounted such that it is pivotable about at least one of the first and second count finger axes.

In some forms of the invention, the knock down finger is pivotable in a first direction about the at least one first and second count finger axis to contact a last panel of the completed pack to form the space between the completed pack and the next pack such that a build finger of the apparatus is insertable into one of the adjacent successive folds entirely above a last panel of the completed pack. In some forms of the invention, the knock down finger is pivotable in a second direction opposite the first direction to discontinue contact with the last panel of the completed pack prior to insertion of the build finger.

In some forms of the invention, a separator having a pack and build and transport arrangement with side shifting build fingers is provided. The separator includes a pack and build and transport arrangement for receiving the folded panels in the stacking region to form the completed pack, and for transporting the completed packs out of the stacking region, The pack and build and transport arrangement also includes two or more first build fingers commonly mounted to a first build finger carriage and arranged along a first support axis extending perpendicularly to the sheet path. At least one of the two or more first build fingers is extendable and retractable in a direction parallel to the first support axis to vary a distance between the at least one of the two or more first build fingers and another one of the two or more first build fingers.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
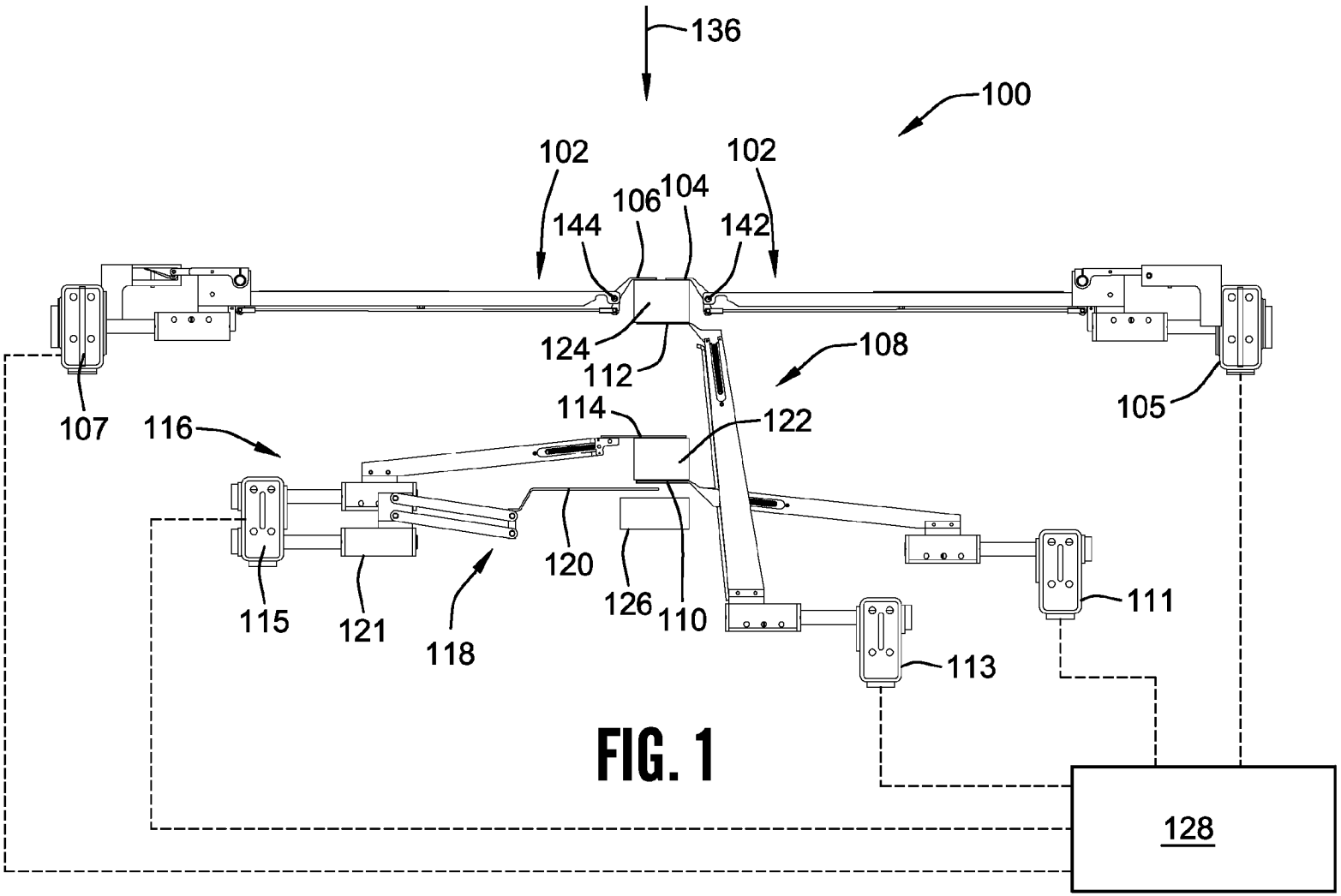
FIG. 1 is a cross-section taken through a first exemplary embodiment of a separator apparatus, in accordance with the invention.
Figure 2:
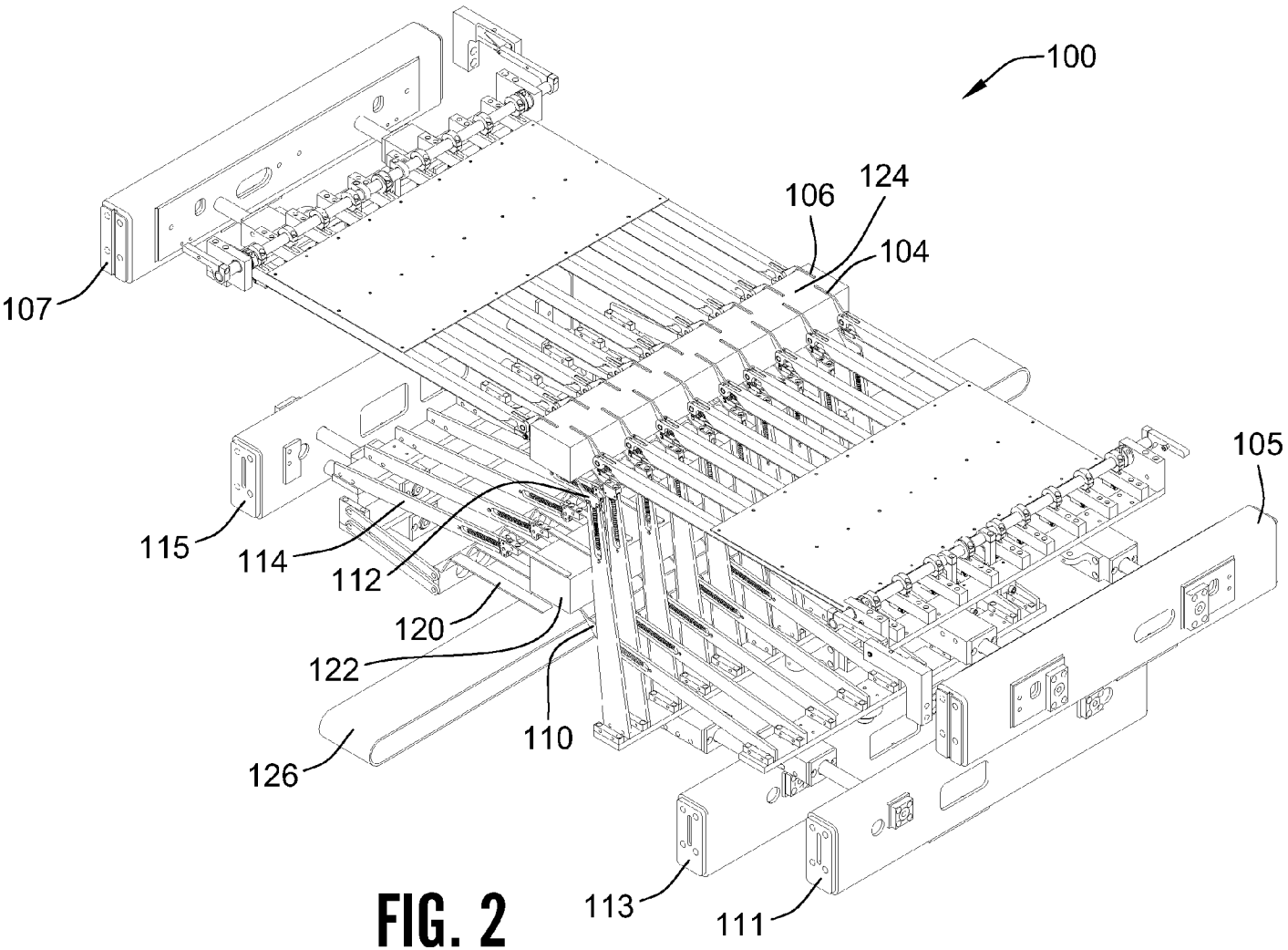
FIGS. 2 and 3 are perspective illustrations of the separator apparatus of FIG. 1, with FIG. 2 and FIG. 3 showing the separator apparatus from opposite sides of a sheet path through the separator apparatus.
Figure 3:
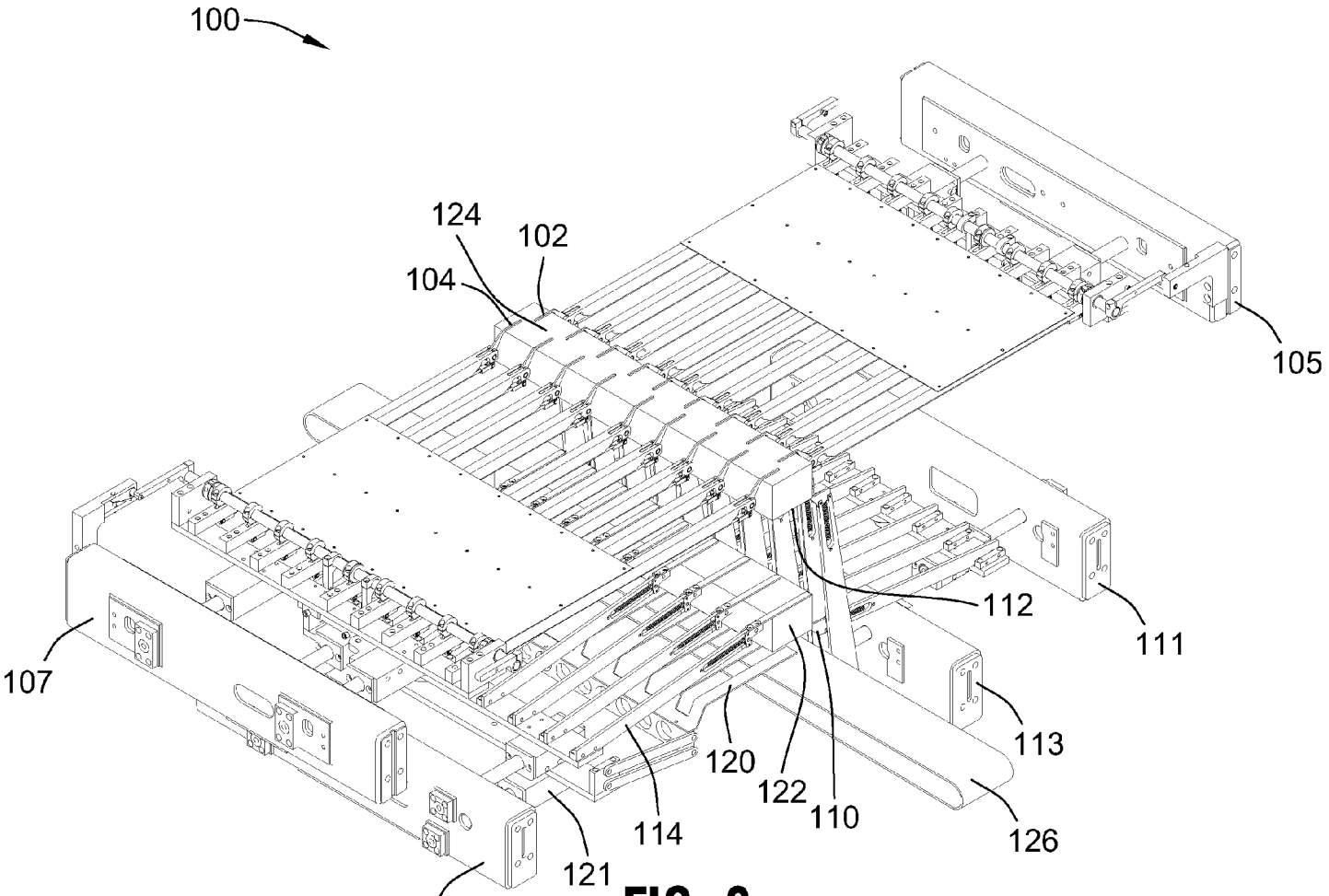

FIG. 1 is a cross-sectional view of a portion of a first exemplary embodiment of a separator apparatus 100, according to the invention, with components of the separator apparatus 100 positioned in a first operating mode. The first exemplary embodiment of the separator apparatus 100 is further illustrated in perspective drawings FIGS. 2 and 3.

Figure 4:
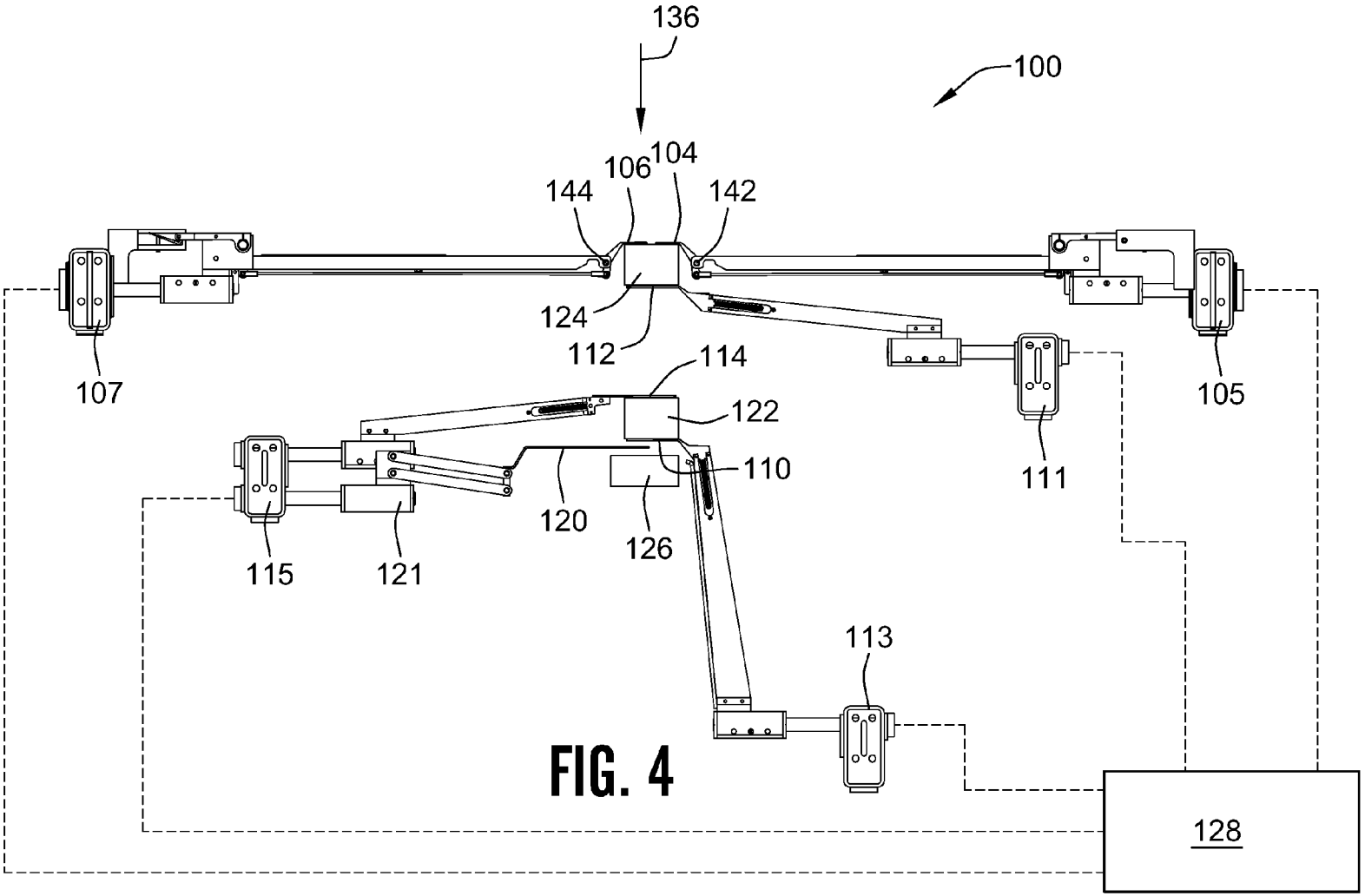
FIG. 4 shows the first exemplary embodiment of the separator apparatus of FIG. 1 with the various components shown in FIG. 1 in different relative positions to one another than the positions shown in FIG. 1.
Figure 5:
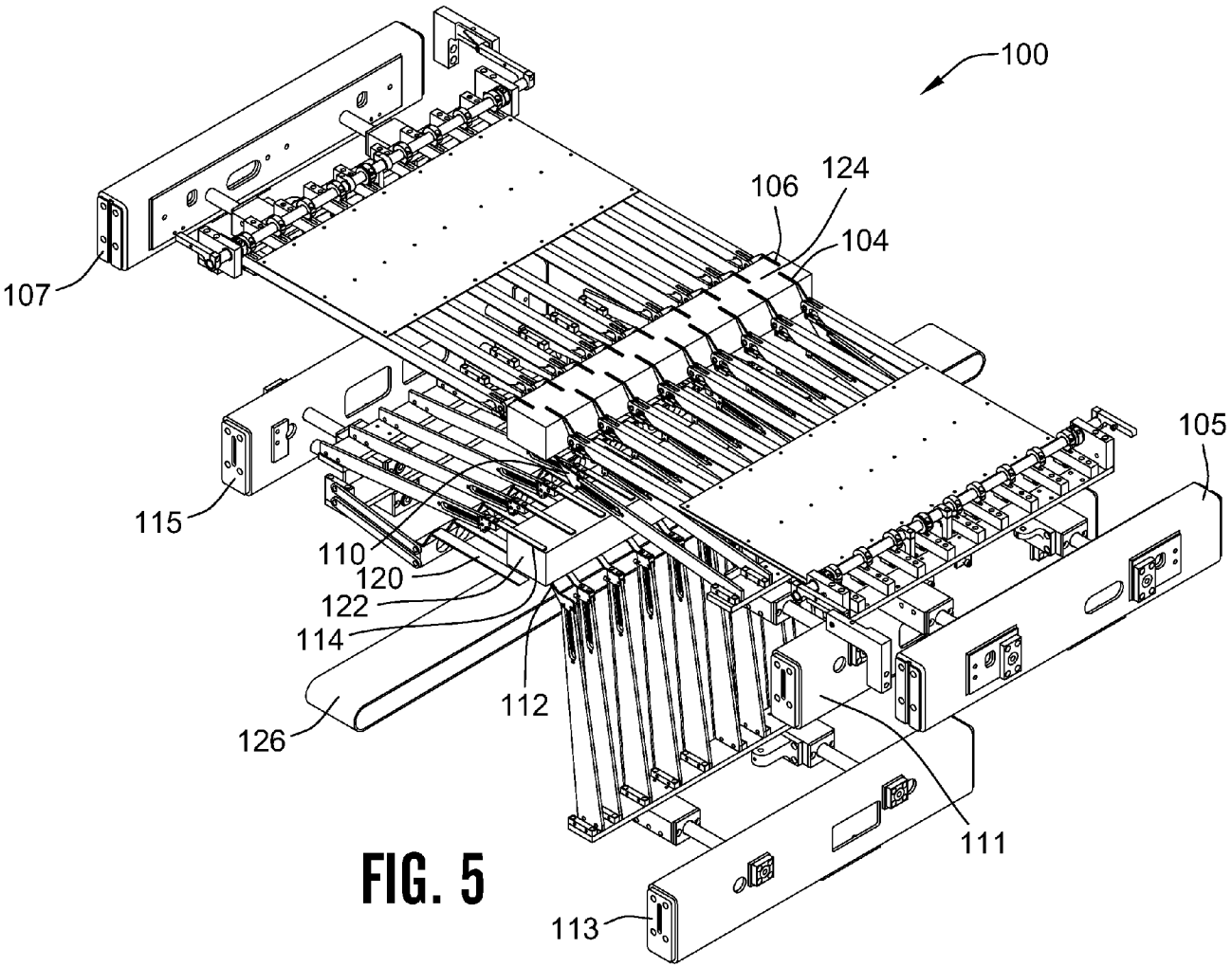
FIGS. 5 and 6 are perspective illustrations from opposite sides of a sheet path through the exemplary embodiment of the separator apparatus shown in FIG. 4.
Figure 6:
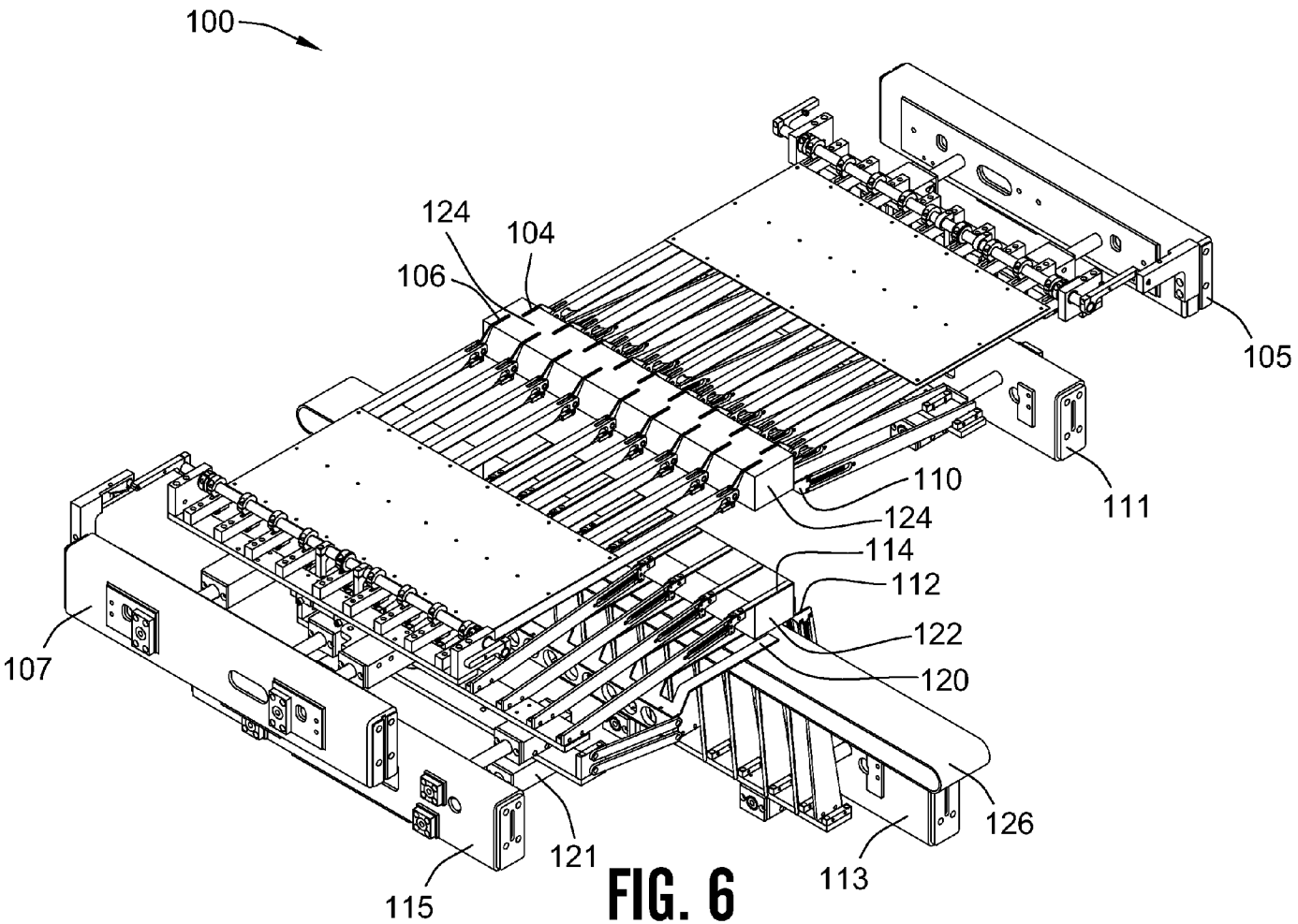

FIG. 4 is also a cross-sectional illustration of the first exemplary embodiment of the separator apparatus 100, showing components of the separator apparatus 100 positioned in a second operating mode, as further illustrated in the perspective illustrations of FIGS. 5 and 6.

As will be understood from the description that follows, FIGS. 1-6 are provided primarily to illustrate the construction and relative interconnection between various components of the first exemplary embodiment of the apparatus 100, and not necessarily to depict any particular instantaneous positioning of the various components achieved during operation of the first exemplary embodiment of the separator apparatus 100. Operation of the separator apparatus 100 will be described in detail below with reference to a number of other sequential illustrations.

As shown in FIGS. 1-6, the first exemplary embodiment of the separator apparatus includes a count finger arrangement 102 having plurality of first and second count fingers 104, 106, a build and transport arrangement 108 having a plurality of first (upper) build fingers 110 and second (lower) build fingers 112, and a plurality of (left) strip fingers 114. The first and second count fingers 104, 106, first and second build fingers 110, 112, and the strip fingers 114 collectively constitute the separator fingers of the first exemplary embodiment of the separator apparatus 100. As shown in FIGS. 1-6, the separator fingers 104, 106, 110, 112, 114 are attached in parallel arrays to five carriages 105, 107, 111, 113, and 115 in a manner described in greater detail below. The strip fingers 114 are part of a stripping and folding arrangement 116, which also includes a panel folding arrangement 118 having a plurality of panel folding fingers 120 arranged in a parallel array and attached to the same carriage 115 as the strip fingers 114. FIGS. 1-6 also show a completed pack 122 of folded sheets resting on the upper build finger 110, and the next pack 124 of folded sheets resting upon the lower build finger 112.

The exemplary embodiment of the separator apparatus 100 also includes a conveying arrangement 126 for receiving the completed packs 122 and a control arrangement (not shown) operatively connecting the various components of the separator apparatus 100 to a controller 128.

As shown in FIGS. 1-6, and described in greater detail below, the first exemplary embodiment of the separator apparatus 100 includes a plurality of count fingers 104, 106, first and second build fingers 110, 112, strip fingers 114 and panel folding fingers 120, which are mounted on and operatively interconnected to five carriages 105, 107, 111, 113, 115. Specifically, the first count fingers 104 are operatively attached to a first count finger carriage 105, the second count fingers 106 are operatively attached and mounted on a second count finger carriage 107, the first build fingers 110 are mounted on and operatively connected to a first build finger carriage 111, the second build fingers 112 are mounted on and operatively connected to a second build finger carriage 113, and the strip fingers 114 are mounted on and operatively connected to a strip finger carriage 115. The panel folding fingers 120 are also mounted on and operatively connected to the strip finger carriage 115.

As will be readily observed in FIGS. 2-3 and 5-6, the various fingers 104, 106, 110, 112, 114, 120 are arranged in substantially parallel arrays, with the arrays extending substantially perpendicularly to the sheet path 136. The adjacent fingers in each array are spaced from one another and attached to their respective carriage 105, 107, 111, 113, 115 in such a manner that the fingers and the structures attaching some of the fingers to their respective carriages 105, 107, 111, 113, 115 can pass vertically and/or horizontally through one another during operation of the separator apparatus 100 in the manner described in greater detail below.

In the first exemplary embodiment of the separator apparatus 100, the five carriages 105, 107, 111, 113, 115, are constrained to be moveable parallel to the sheet path 136 (vertically as illustrated in FIGS. 1 and 4), transversely to the sheet path 136, (horizontally as illustrated in FIGS. 1 and 4) and a further operatively connected to move in a sequence according to a invention as controlled by the controller 128, (as illustrated in FIGS. 1 and 4) or any appropriate actuation means. The fingers 104, 106, 110, 112, 114, 120 are attached to their respective carriage 105, 107, 111, 113, 115 by appropriate mounting structures and actuation mechanisms, some of which will be described in greater detail below.

It will be particularly noted, that in the first exemplary embodiment of the separator apparatus 100, as shown in FIGS. 1-6, the fingers 104, 106, 110, 112, 114, 120 are all operatively mounted on and connected to their respective carriage 105, 107, 111, 113, 115, to be moveable in a direction transverse to the sheet path 136, with respect to the carriage upon which they are mounted, with vertical movement of these fingers being provided by movement along the sheet path 136 of the particular carriage to which the finger is attached.

It will also be noted, as best seen in FIGS. 1 and 4, that, in the first exemplary embodiment of the separator apparatus 100, the strip fingers 114 and the fold-over fingers 120 are all operatively mounted upon and connected to the strip finger carriage 115. It will be further noted, that the fold-over fingers 120 are attached the strip finger carriage 115 by a folding finger actuating arrangement 121 in such a manner that the fold-over fingers may be actuated in a direction transverse to the sheet path independently from the strip fingers 114.

In the first exemplary embodiment of the separator apparatus 100, movement of the fingers 104, 106, 110, 112, 114, 120, with respect to the sheet path 136 is accomplished through the use of servo-motor-driven actuation arrangements in the mechanisms connecting the fingers 104, 106, 110, 112, 114, 120 to their respective carriage 105, 107, 111, 113, 115. One of these actuation arrangements is described in more detail below in relation to FIGS. 13 and 15*a*. It will be understood, however, that in other embodiments of the invention any appropriate mechanism and actuating arrangement may be utilized for achieving movement of the fingers 104, 106, 110, 112, 114, 120 during operation of a separator according to the invention.

As will be understood by those having skill in the art, the first exemplary embodiment of the invention 100, shown in FIGS. 1-6 and 7*a*-7*p*, utilizes a plurality of count fingers 104, 106 and first and second build fingers 110, 112 and strip fingers 114 attached to five carriages 105, 107, 111, 113, 115 in such a manner that the two carriages 105, 107 supporting the count fingers 104, 106 always remain upstream from the three carriages 111, 113, 115 upon which the first and second build fingers 110, 112 and strip fingers 114 are mounted. It will be further recognized that the first exemplary embodiment 100 of the apparatus is configured in such a manner that the carriage 113 supporting the second build fingers 112 always remain downstream from the carriage 111 supporting the first build fingers 110, despite the fact that during operation the first and second pluralities of build fingers 110, 112 move alternately past one another to upstream and downstream relative positions. In some embodiments of the invention, therefore, it is convenient to refer to the first set of build fingers 110 as "upper build fingers," because the first build finger carriage 111 is always above the carriage 113 carrying the second build fingers 112, and in similar fashion to refer to the second build fingers 112 as "lower build fingers," in recognition of the exemplary arrangement wherein the second build finger carriage 113 is always below (i.e. lower than) the first build finger carriage 111.

Although, the first exemplary embodiment of the separator apparatus 100 described above includes five carriages 105, 107, 111, 113, 115, it will be understood that in other embodiments of the invention a separator in accordance with the invention may include fewer or more carriages than are utilized in the first exemplary embodiment of the separator 100. The carriages in other embodiments of the invention may also move in different sequences relative to one another from those described expressly herein, within the scope of this invention.

Figure 11:
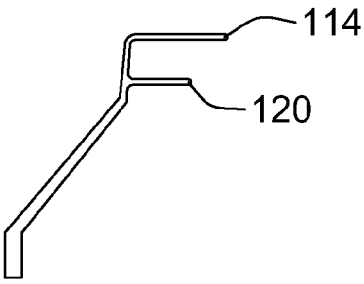
FIG. 11 shows an alternate embodiment of a separator apparatus, according to the invention, wherein strip fingers according to the invention and fold-over fingers according to the invention are rigidly attached to one another.

It is further contemplated that, in alternate embodiments of the invention, it may be desirable to operatively attach the fingers 104, 106, 110, 112, 114, 120 to one another and the carriages 105, 107, 111, 113, 115 in other arrangements. For example, it is contemplated that in some embodiments of the invention the panel folding fingers 120 may be rigidly attached to the strip fingers 114 in the manner illustrated in FIG. 11.

As also illustrated in FIGS. 1 and 4, and described in more detail below, in some forms of the invention it is desirable to have some or all of the fingers 104, 106, 110, 112, 114, 120, be operatively connected in such a manner that the fingers can deflect and automatically reset to clear a jam or other obstruction, such as an improperly formed pack, in the sheet path. In the first exemplary embodiment of the separator apparatus 100, for example, the first and second count fingers 104, 106, the first and second build fingers 110, 112 and the strip fingers 114 are all connected to their respective carriages 105, 107, 111, 113, 115, by mechanisms described in greater detail below, which allow the fingers 104, 106, 110, 112, 114 to pivot away from their working position and automatically reset to allow passage of a jam. The fold-over fingers 120 are constructed in such a manner that they can flex enough to deflect and spring back to an operating position to clear a jam.

It will be appreciated by those having skill in the art, that the invention thus provides the first separator apparatus of this type in which all of the operative fingers of the separator are deflectable and automatically resettable.

Figure 7A:
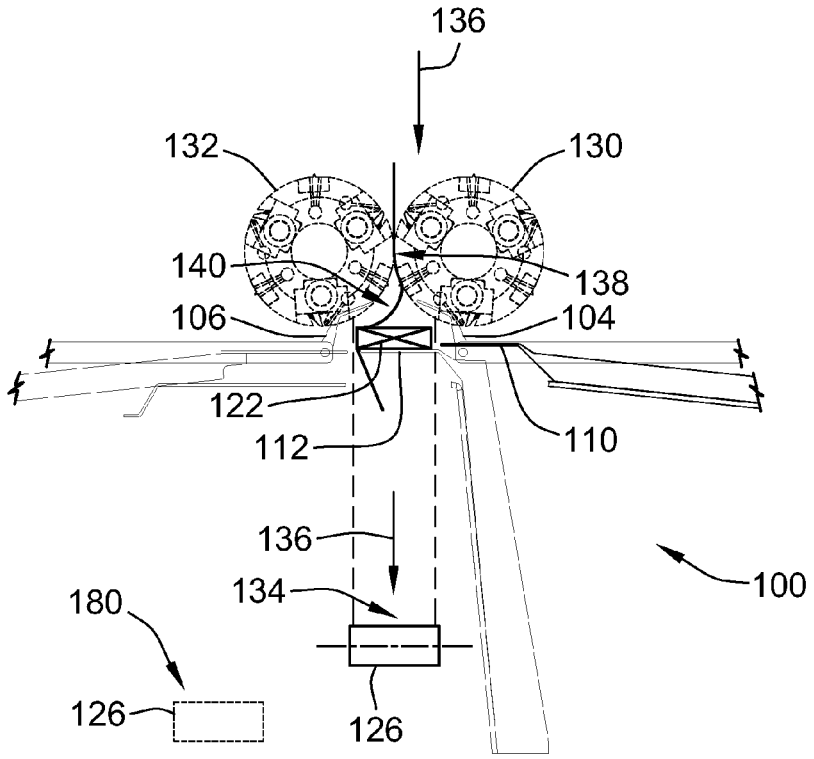
FIGS. 7*a*-7*p* are successive schematic illustrations depicting operation of the first exemplary embodiment of the invention shown in FIGS. 1-6, in accordance with a method of operation of the invention.
Figure 7B:
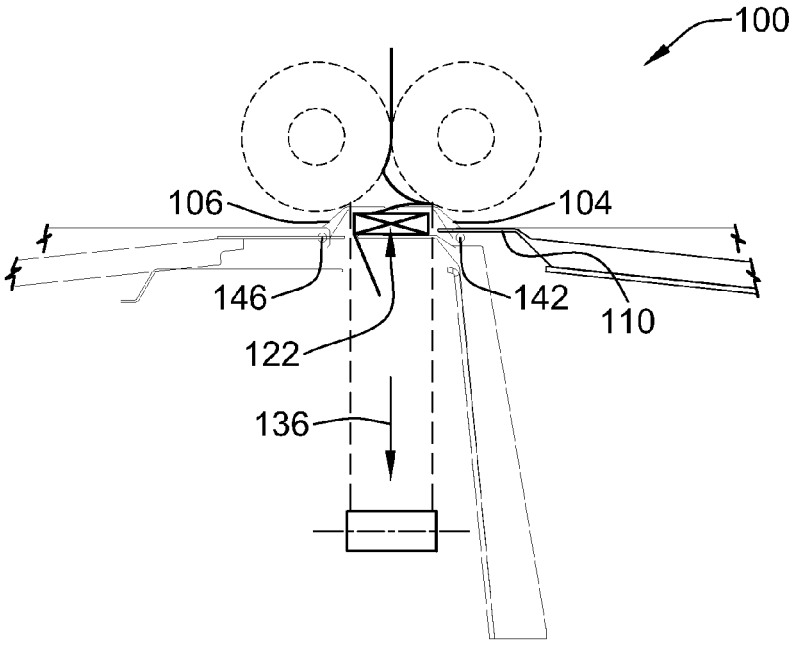
Figure 7C:
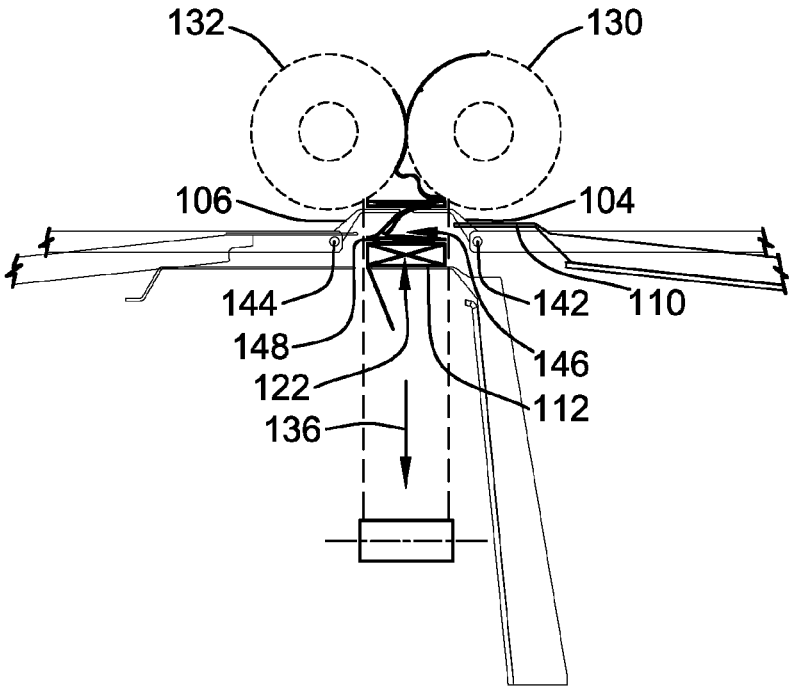
Figure 7D:
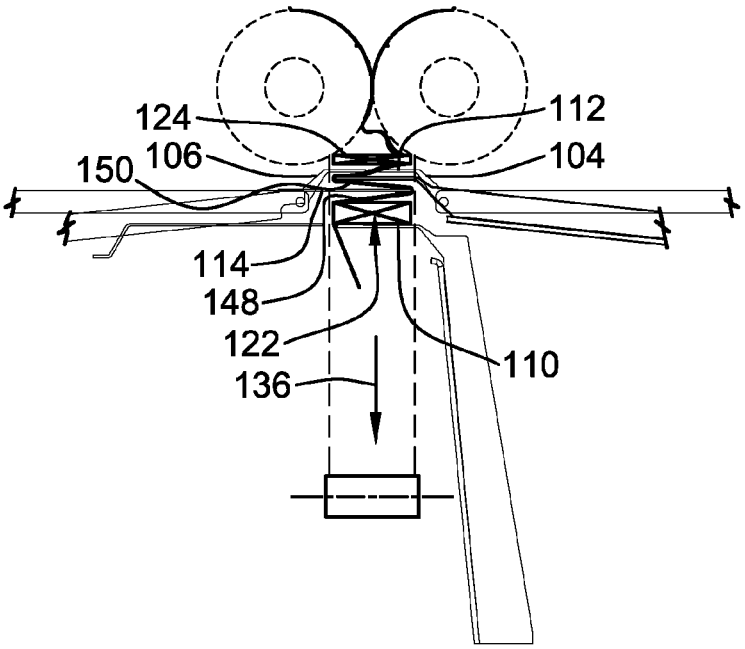
Figure 7E:
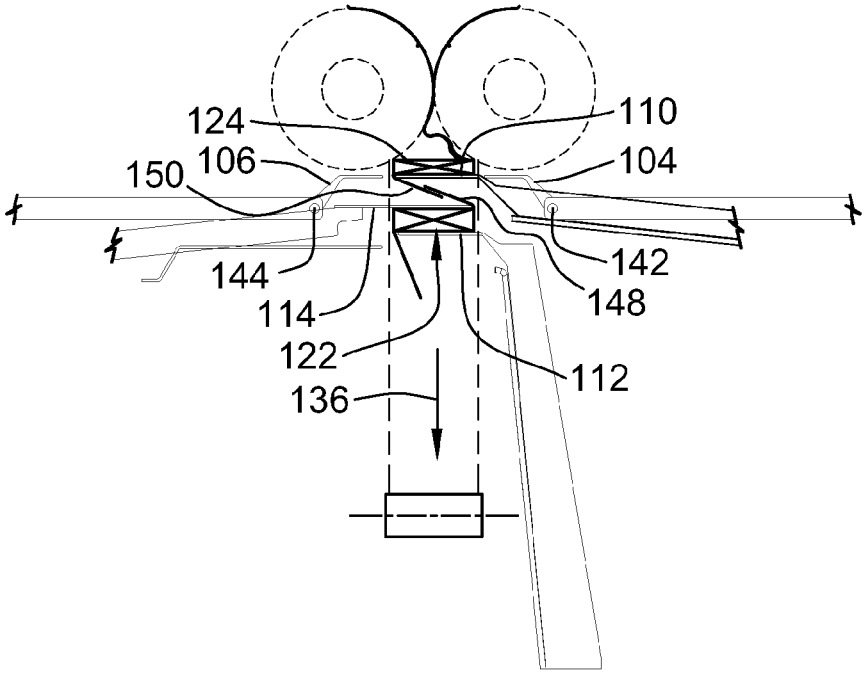
Figure 7F:
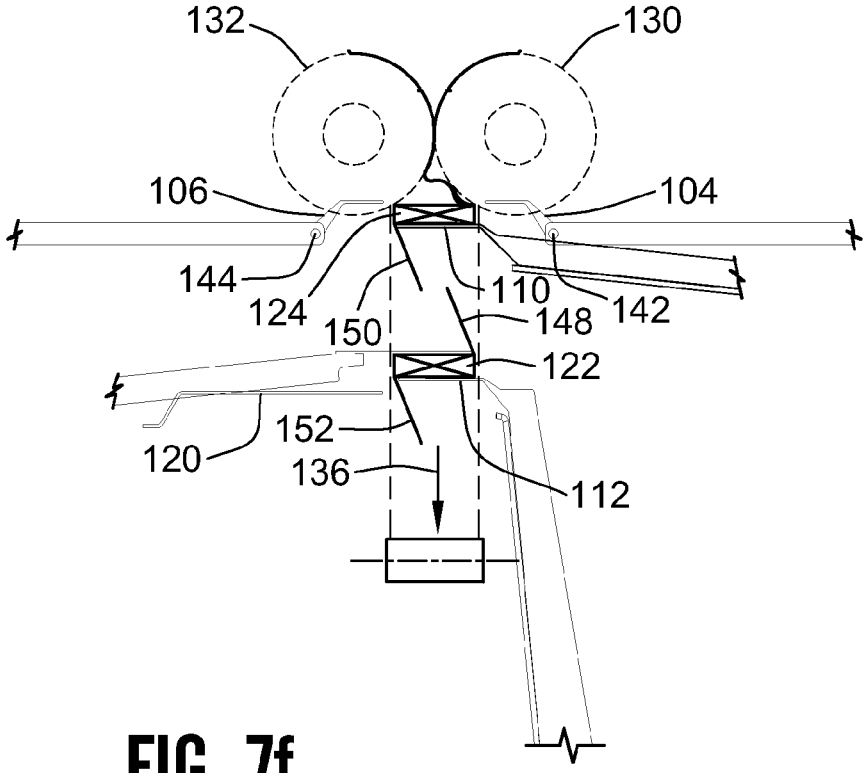
Figure 7G:
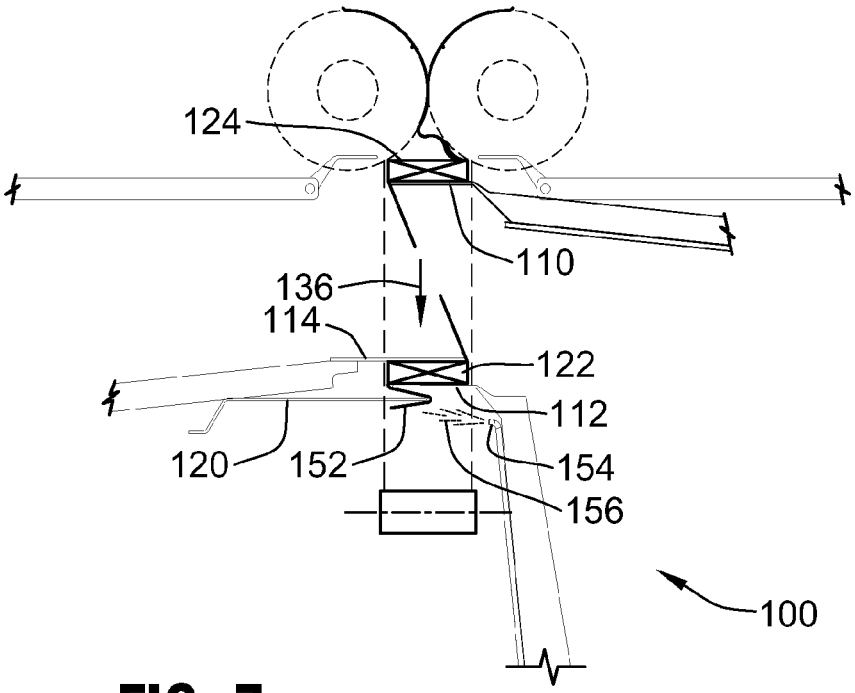
Figure 7H:
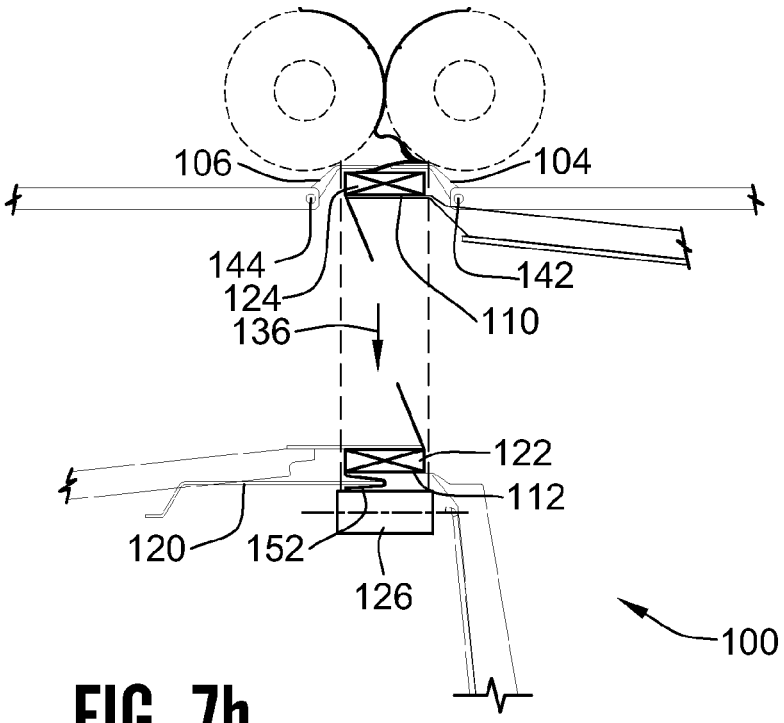
Figure 7I:
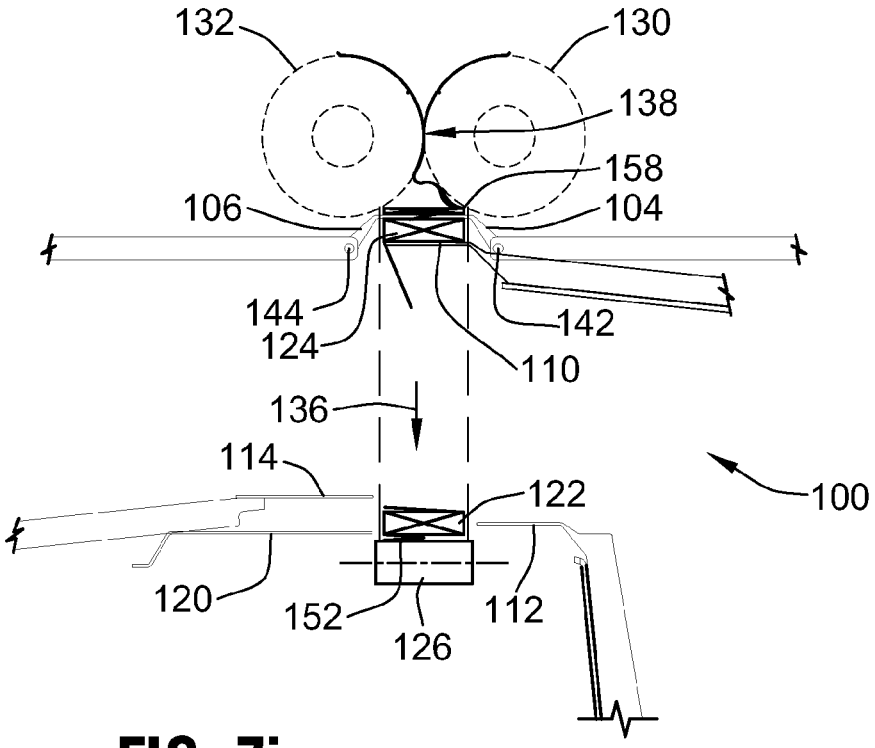
Figure 7J:
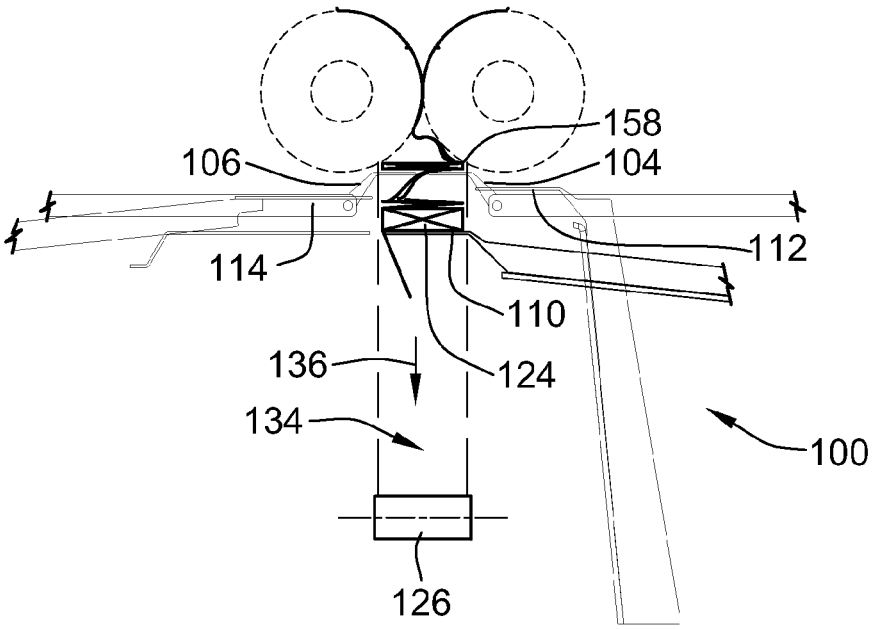
Figure 7K:
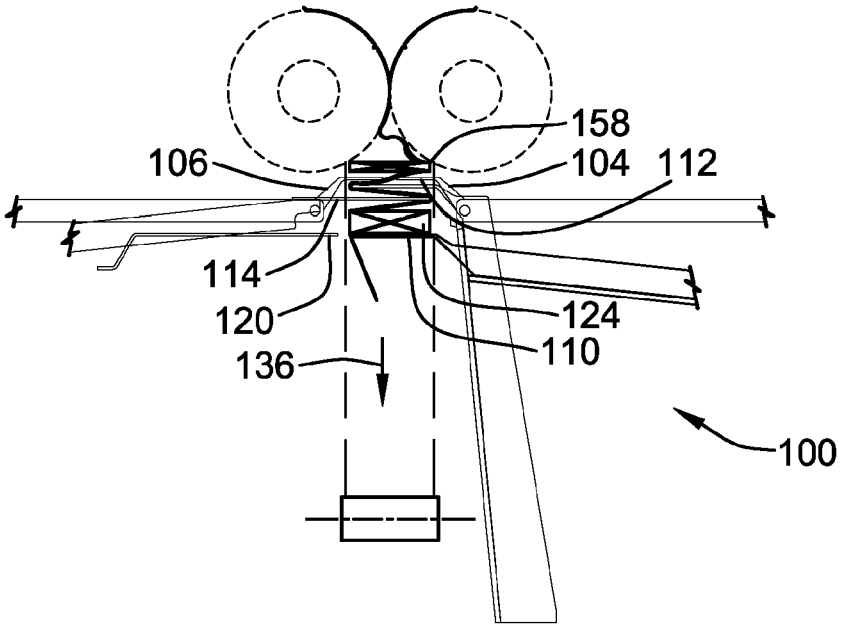
Figure 7L:
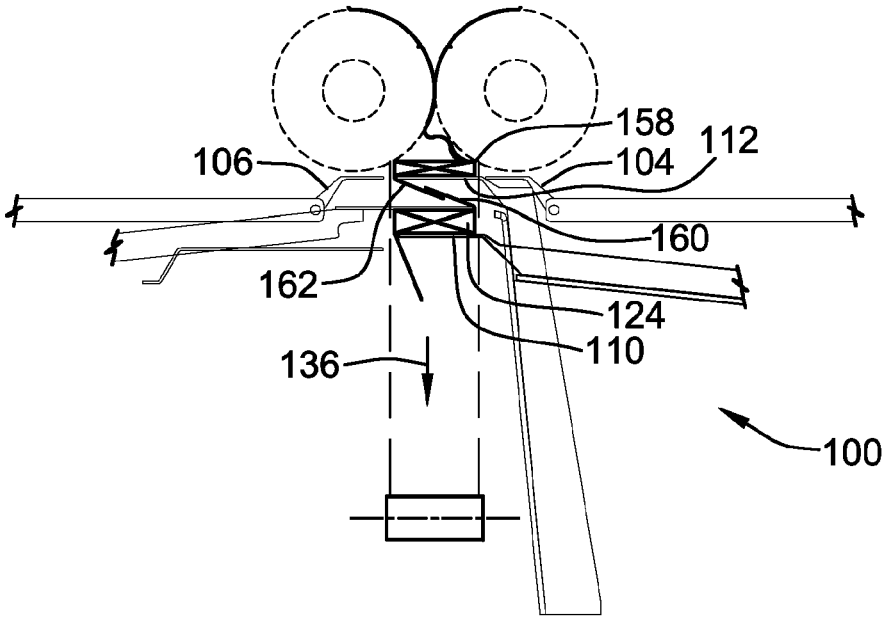
Figure 7M:
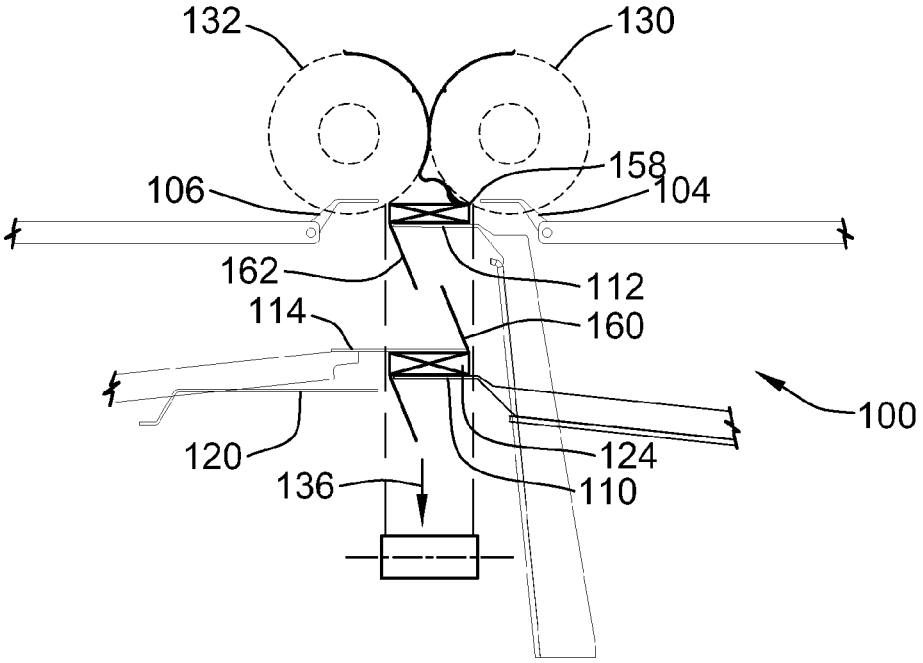
Figure 7N:
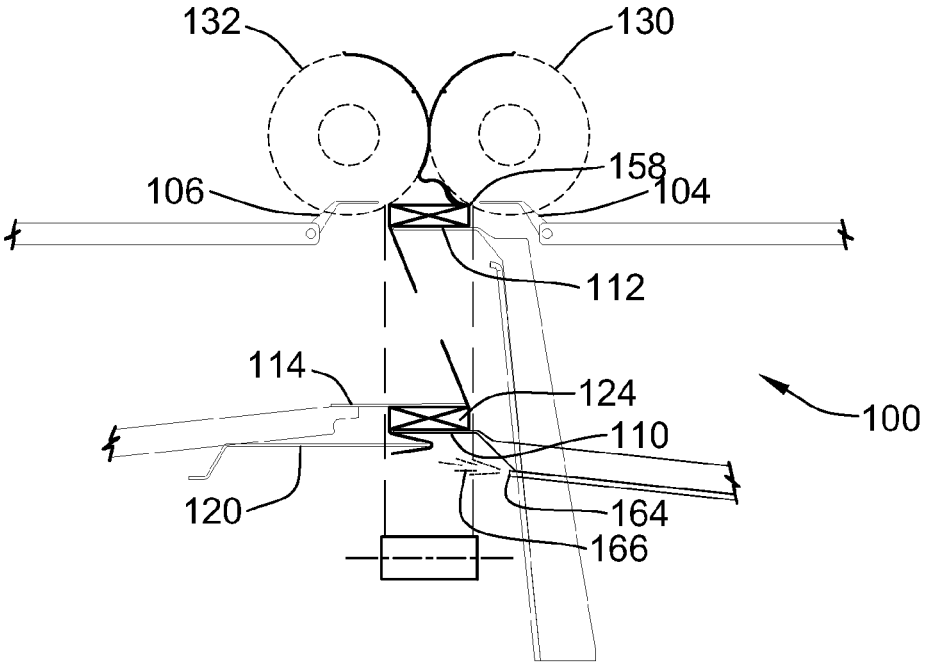
Figure 7O:
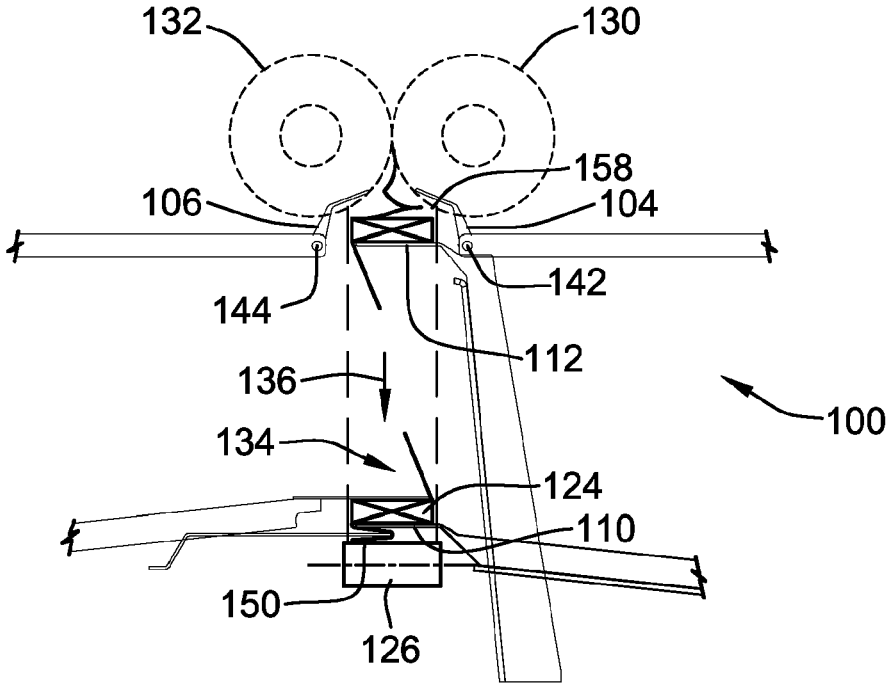
Figure 7P:
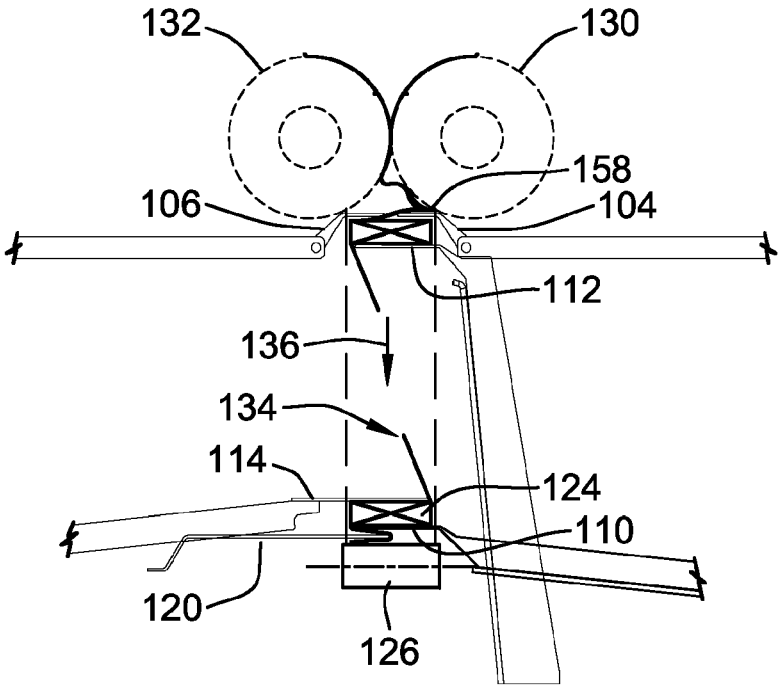

FIGS. 7*a*-7*p* sequentially illustrate schematically operation of the first exemplary embodiment of the separator apparatus 100, forming packs 122, 124 having an even number of sheets. Each sheet has two panels interfolded with one another.

As shown in FIGS. 7*a*-7*p*, the exemplary embodiment of the separator apparatus 100 is mounted downstream from (below), and as close as is practical to a pair of folding rolls 130, 132 for forming completed packs 122, 124 containing a desired number of interfolded sheets in a stacking region 134 downstream from the folding rolls 130, 132. The stacking region 134 is disposed about the sheet path 136, extending through a nip 138 defined between the pair of folding rolls 130, 132. The completed packs 122, 124 are formed from sheets cut from a continuously flowing sheet stream 140 issuing downstream from the pair of interfolding rolls 130, 132 along the sheet path 136. The interfolded sheets have adjacent panels of each sheet joined along a fold line to form successive folded sheets opening between edges of the panels opposite the fold line alternately in opposite directions oriented substantially transversely to the sheet path 136.

As shown in FIG. 7*a*, the stream 140 of interfolded sheets is building the first pack 122 on top of the lower build finger 112. The first and second count fingers 104, 106 are illustrated in their respective retracted positions, with their distal ends located inside of grooves in the first and second rolls 130, 132 in such a manner that the first and second count fingers 104, 106 do not engage the folds being formed in the sheet stream 140.

As shown in FIG. 7*b*, when the controller 128 determines that the stack forming the first pack 122 is completed, the first and second count fingers 104, 106 are actuated to quickly pivot about their respective first and second count finger axes 142, 146 into successive oppositely opening folds to form the completed pack 122 downstream from the count fingers 104, 106. As shown in FIG. 7*c*, after the count fingers 104, 106 have pivoted from their retracted to their extended positions, the separator apparatus 100 begins moving the count finger axes 143, 144 longitudinally along the sheet path 136 in a downstream direction (downward in the orientation of the apparatus 100 shown in FIG. 7*c*) while the folding rolls 130, 132 continue to run at full speed depositing successive folded sheets on an upper surface of the extended count fingers 104, 106, to thereby begin building the next (second) pack 124 on top of the extended count fingers 104, 106.

As further shown in FIG. 7*c*, once the count fingers 104, 106 have pivoted from their retracted to their extended positions and begin moving downward along the sheet path 136, the second build finger 112 is moved downstream along the sheet path 136 away from the count fingers 104, 106, to thereby provide a space 146 between the last sheet 148 of the completed pack 122 and the count fingers 104, 106.

As shown in FIG. 7*d*, as the next stack 124 continues to build on top of the extended count fingers 104, 106, the upper build finger 110 is moved transversely across the sheet path 136 into the space 146 over the last sheet of the completed pack 122, in such a manner that the upper build finger 110 lifts the last panel 148 of the last sheet of the completed pack 122 upward away from the remainder of the completed pack 122.

As further shown in FIG. 7*d*, with the upper build fingers 110 lifting the last panel 148 of the last sheet of the completed pack 122 upward away from the remainder of the completed pack 122, the strip fingers 114 are moved transversely across the sheet path 136 into the space 146 beneath the first panel of the first sheet of the next pack 124, to help hold the last sheet of the completed pack 122 in place and facilitate separation of the last panel 148 of the last sheet of the completed pack 122 from the first panel 150 of the first sheet of the next pack 124 when the completed pack 122 is pulled downstream along the sheet path 136 away from the next pack 124, in the manner described in more detail below.

As shown in FIG. 7*e*, once the upper build finger 110 is inserted below the count fingers 104, 106, the first and second pivot axes 142, 144 are moved transversely outward from the sheet path 136 to transfer the partly completed next pack 124 to the upper build finger 110.

As shown in FIG. 7*f*, once the first and second count fingers 104, 106 have transferred the pack 124 being built to the upper build finger 110, the apparatus 100 moves the count finger axes 142, 144 longitudinally in an upstream direction, back toward the folding rolls 130, 132, and then moves the count finger axes 142, 144 transversely inward toward the sheet path 136, to thereby continue movement of the count fingers 104, 106 back toward the position shown in FIG. 7*a*.

As will be described in more detail below, the first and second count fingers 104, 106 are configured and operatively connected to other elements of the count finger arrangement in such a manner that, as the count finger axes 142, 144 move transversely inward toward the sheet path 136, relative motion between various parts of the count finger arrangement cause the first and second count fingers 104, 106 to pivot from their extended to their retracted positions about their respective count finger axis 142, 144. By virtue of this arrangement, when the count fingers 104, 106 are returned to the position shown in FIG. 7*a*, the count fingers 104, 106 are in their retracted position within the circumferential grooves of the folding rolls 130, 132 and oriented so as to not engage the sheets below the nip 138 formed between the folding rolls 130, 132 until the controller 128 commands them to do so.

As further illustrated in FIG. 7*f*, once the count fingers 104, 106 have transferred the pack 124 being built to the upper build finger 110, the folding rolls 130, 132 continue to deposit folded sheets on the top surface of the pack 124. As the pack 124 continues to be built, the completed pack 122 is transported downstream through longitudinal motion of the lower build finger 112 and the strip fingers 114. As the completed pack 122 moves downward, the strip fingers 114 are moving faster than the upper build finger 110, and pull the last panel 148 of the completed pack 122 apart from the first panel 150 of the next pack 150.

As shown sequentially in FIGS. 7*f* and 7*g*, as the completed pack 122 continues to move longitudinally downstream supported by the lower build finger 112, the first panel folding fingers 120 are moved by the apparatus 100 in a transverse direction toward the sheet path 136 in such a manner that the distal ends of the folding fingers 120 intersect a first panel 152 of the completed pack 122, hanging below the upper build finger 110. An array of first fluid emitters, in the form of air jets 154 then direct a blast of compressed air 156 against the first panel 152 of the completed pack 122 in such a manner that the first panel 152 is partly folded back upon itself around the distal ends of the first folding fingers 120. During this time, the apparatus 100 continues to move the upper build finger 110 in a downstream direction along the sheet path 136 so that the next pack 124 continues building toward a completed state on an upper surface of the lower build finger 110.

As shown in FIG. 7*h*, when the next pack 124 reaches a desired number of folded sheets, the apparatus 100 causes the first and second count fingers 104, 106 to pivot about their respective count finger axes 142, 144 into engagement with oppositely opening folds of the sheets being deposited on the upper surface of the pack 124, to thereby terminate formation of the next (second) pack 124. As described above, once the first and second count fingers 104, 106 pivot into their extended positions, as shown in FIG. 7*h*, the apparatus 100 moves the axes 142, 144 of the first and second count fingers 104, 106 in a downstream direction longitudinally along the sheet path 136 as a new next (third) pack 158 following the now completed pack 124 begins to build on top of the extended count fingers 104, 106 as shown in FIG. 7*i*.

As further shown in FIG. 7*h*, the lower build finger 112, the strip fingers 114 and the first panel folding fingers 120 remain in their extended positions to support and transport the first completed pack 122 downstream along the sheet path 136 to a point just above the conveying arrangement 126. As shown in the lower portion of FIG. 7*i*, the separator apparatus 100 then moves the lower build fingers 112, the strip fingers 114 and the first panel folding fingers 120 transversely outward from the sheet path 136 to the respective retracted positions of the lower build fingers 112, the strip fingers 114 and the panel folding fingers 120, to thereby deposit the first completed pack 122 onto the conveyor arrangement 126 with the first panel 152 of the first completed pack 122 folded partially back upon itself between the lower surface of the pack 122 and the upper surface of the conveying arrangement 126. During these operations, the separator apparatus 100 continues to move the upper build finger 110 and the first and second count fingers 104, 106 in a downstream direction along the sheet path 136 at a rate sufficient to allow the folded sheets exiting the nip 138 between the folding rolls 130 and 132 to continue building on the upper surface of the partly completed next pack 158.

FIG. 7*j* illustrates a point in the operation of the separator 100 which is substantially similar to the point in the separation process shown in FIG. 7*c*, with the exception that the second completed pack 124 is being supported on the upper build finger 110, and the lower build fingers 112 have moved upstream in their retracted positions, together with the strip fingers 114 and the panel folding fingers 120. As depicted in FIG. 7*j*, the conveying arrangement 126 has moved the first completed pack 122 out of the stacking region 134, either into or out of the page, (as viewed in FIG. 7*j*). The separator apparatus 100 has also moved the upper build fingers 110 downstream along the sheet path 136, away from the count fingers 104, 106 in preparation for having the lower build fingers 112 and the strip fingers 114 move from their retracted positions, as shown in FIG. 7*j* to their extended positions, as shown in FIG. 7*k*, beneath the count fingers 104, 106, in the same manner as described above in relation to FIG. 7*d*, with the lower build fingers 112 lifting the last panel of the last sheet of the second completed pack 124 upward away from the remainder of the second completed pack 124, and the strip fingers 114 helping to hold the last sheet of the second completed pack 124 in place and facilitate separation of the last panel 160 of the last sheet of the second completed pack 124 from the first panel 162 of the first sheet of the next (third) pack 158 when the second completed pack 124 is pulled downstream along the sheet path 136 away from the next (third) pack 158 Stated another way, the point in the operation of the separator 100 shown in FIG. 7*k* is essentially the same as the point described earlier with reference to FIG. 7*d*, with the exception that the position of the upper and lower build fingers 110, 112 are reversed in FIG. 7*k* from the position shown in FIG. 7*d*.

At the point in operation of the separator 100 illustrated in FIG. 7*l*, the separator apparatus 100 has refracted the count fingers 104, 106 in a transverse direction, with respect to the sheet path 136, to thereby transfer the partially built next pack 158 from the count fingers 104, 106 to the lower build finger 112. As further illustrated in FIG. 7*l*, continued movement longitudinally in a downstream direction along the sheet path 136 has begun to pull apart and separate the last panel 160 of the completed pack 124 from the first panel 162 of the next, partly completed pack 158. In general, the position in the operating cycle illustrated in FIG. 7*l* is the same as the earlier described position illustrated in FIG. 7*e*, with the exception that the relative of the upper and lower build fingers 110, 112 is reversed in FIG. 7*l* from the positioning illustrated in FIG. 7*e*.

FIG. 7*m* illustrates a point in the operation of the separator 100 which is substantially similar to the point in the separation process shown in FIG. 7*f*. Specifically, once the count fingers 104, 106 have transferred the next partly completed pack 158 to the lower build finger 112, the folding rolls 130, 132 continue to deposit folded sheets on the top surface of the partly completed pack 158. As the pack 158 continues to be built, the completed pack 124 is transported downstream through longitudinal motion of the upper build finger 110 and the strip fingers 114.

As will be understood by those having skill in the art, by virtue of the processes of building the stack 158 being separated from the process transporting the completed pack 124, in accordance with the invention, the upper build fingers 110 and the strip fingers 114 move downward along the sheet path 136 at a faster rate than the lower build fingers 112. This difference in relative downward speeds causes a last panel 160 of the completed pack 124 to be pulled apart from a first panel of the partly completed next pack 158.

As shown sequentially in FIGS. 7*m* and 7*n*, as the completed pack 158 continues to move longitudinally downward, supported by the lower build finger 112, the first panel folding fingers 120 are moved by the apparatus 100 in a transverse direction toward the sheet path 136 in such a manner that the distal ends of the folding fingers 120 intersect the first panel 150 of the completed pack 122 hanging below the upper build fingers 110. A second array of fluid emitters, in the form of a plurality of air jets 164 then direct a blast of compressed air 166 against the first panel 150 of the completed pack 124, in such a manner that the first panel 150 is partly folded back upon itself around the distal ends of the folding fingers 120. During this time, the apparatus 100 continues to move the lower build fingers 112 in a downstream direction along the sheet path 136 so that the next pack 158 continues building toward a completed state on an upper surface of the lower build fingers 112.

FIGS. 7*o* and 7*p* show points in the operation of the separator 100 which are respectively similar to those points of operation for the count fingers 104, 106 illustrated and described above with regard to FIGS. 7*a* and 7*b*. Specifically, as illustrated in FIG. 7*o*, the first and second count fingers 104, 106 have been rotated about their respective axes 142, 144 to their respective retraced positions with the distal ends of the count fingers 104, 106 being located inside of grooves in the first and second rolls 130, 132 in such a manner that the count fingers 104, 106 do not engage the folds being formed in the sheet stream 140.

As shown in FIG. 7*p*, the controller 128 has determined that the stack 158 is completed and has actuated the first and second count fingers 104, 106 to pivot about their respective first and second axes 142, 146 into successively opening folds to form the completed third pack 158 downstream from the count fingers 104, 106. The process for separating the completed pack 158 from the next successive pack being built on top of the count fingers 104, 106 then continues in the manner described above with regard to the building of packs 124 and 158.

FIGS. 7*o* and 7*p* also illustrate that, as the counting process is taking place with the count finger arrangement 102, the completed pack 124 is separately being directed downward along the sheet path 136 toward a point in the process whereat the upper build fingers 110, the strip fingers 114, and the panel folding fingers 120 will be retracted in a transverse direction to drop the completed pack 124 with its first sheet folded back upon itself onto the conveying apparatus 126. The conveying apparatus 126 will then convey the completed pack 124 out of the stacking region 134, either into, or out of the page (as viewed in FIGS. 7*o* and 7*p*).

Those having skill in the art will recognize that the first exemplary embodiment of the separator apparatus 100 may be repetitively operated in the manner described above, to provide a continual succession of packs having a desired number of folded sheets therein.

Figure 8:
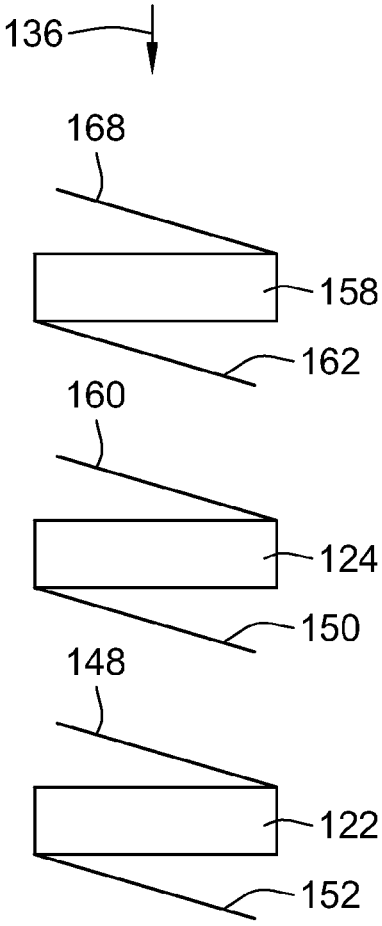
FIG. 8 is an illustration showing the orientation of first and last panels of a succession of packs each containing an even number of folded sheets, such as may be produced utilizing the first exemplary embodiment of the invention in accordance with FIGS. 1-6 when operated in accordance with the method shown in FIGS. 7*a*-7*p*.

As illustrated in FIG. 8, the first exemplary embodiment of the separator apparatus 100 is structured and operable to produce successive packs 122, 124, 158 having an even number of folded sheets. As a matter of geometry, with an even number of sheets, the first panels 152, 150, 162 of successive packs 122, 124, 158 will always point in one transverse direction with regard to the sheet path 136, and the last panels 148, 160, 168 will always point in an opposite transverse direction to the sheet path 136.

In the first exemplary embodiment of the separator apparatus 100, the components are structured, arranged and operated in such a manner that the packs 122, 124, 158 take the form shown in FIG. 8. Specifically, in the apparatus of the first exemplary embodiment 100, the first (right) count finger 104 is always actuated one fold ahead of the second (left) count finger, the first (upper) and second (lower) build fingers 110, 112 are located on the same (right) side of the sheet path 136 as the first count fingers 104, and the strip fingers 114 and panel folding fingers 120 are located on an opposite (left) side of the sheet path, below the second (left) count fingers 106. It will be understood, by those having skill in the art, that the relative positions of the first and last panels shown in FIG. 8 can be reversed in an alternate embodiment of the invention in which the positions of the count fingers, build fingers, the strip fingers and the panel folding fingers are reversed in a mirror image fashion about the sheet path 136.

Figure 9:
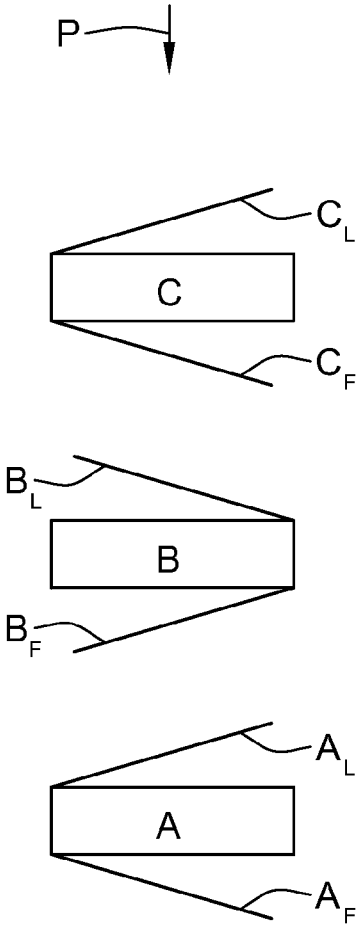
FIG. 9 is a schematic illustration showing the orientation of the first and last panels of a succession of packs having an odd number of folded sheets.

As shown in FIG. 9, where it is desired to produce a series of successive packs A, B, C having an odd number of sheets, geometry will dictate that the first and last panels $A_F$, $A_L$, $B_F$, $B_L$, $C_F$, $C_L$ of successive packs A, B, C will point in the same direction for each given pack, with respect to a sheet feeding path P, and that the direction in which the first and last panels point are opposite for each successive pack A, B, C.

Figure 10A:
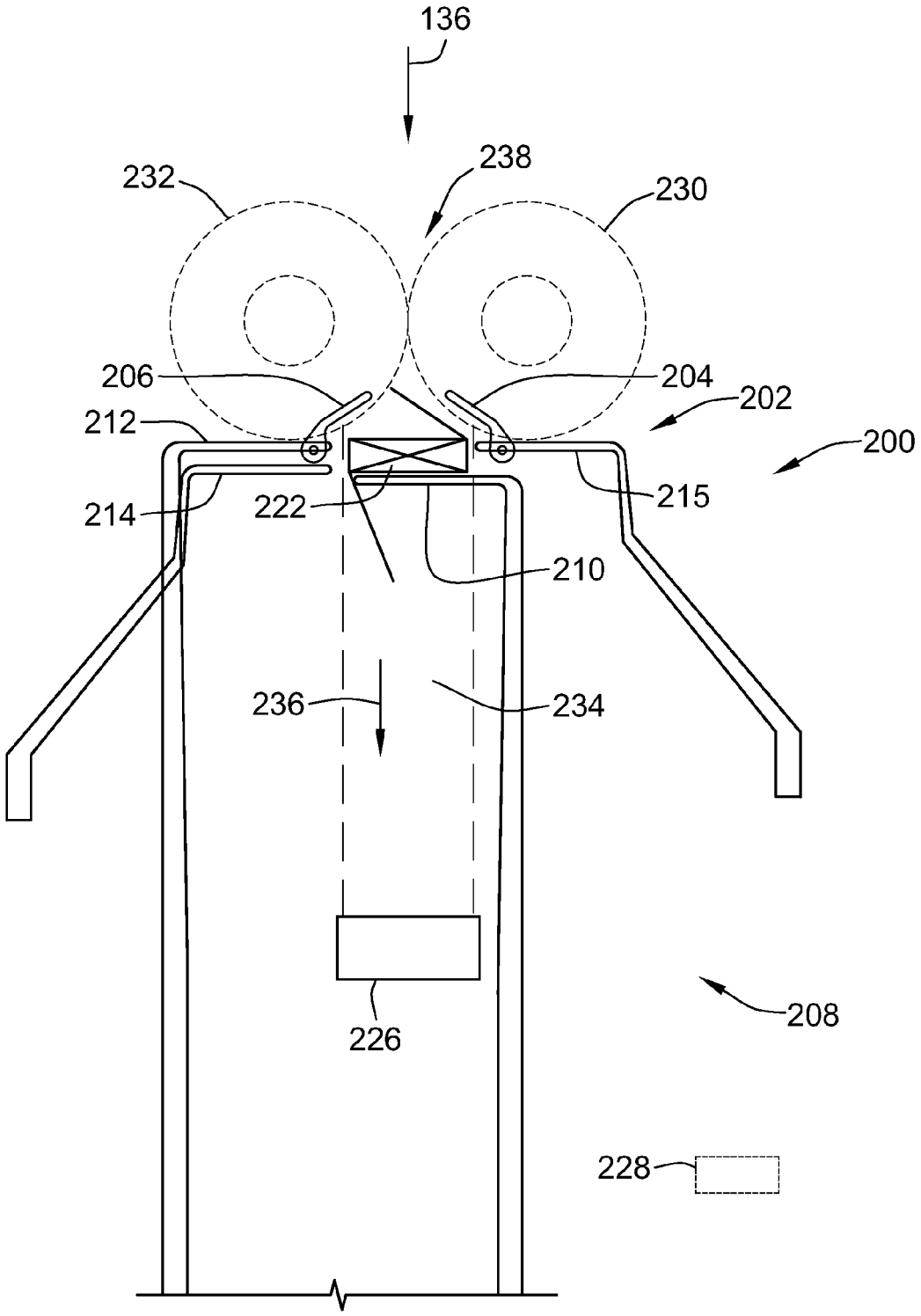
FIGS. 10*a*-10*p* are schematic illustrations showing successive steps in the operation of a second exemplary embodiment of a separator apparatus according to the invention, according to a second method of the invention, to produce a succession of packs having an odd number of folded sheets such as the succession of packs illustrated in FIG. 9.
Figure 10B:
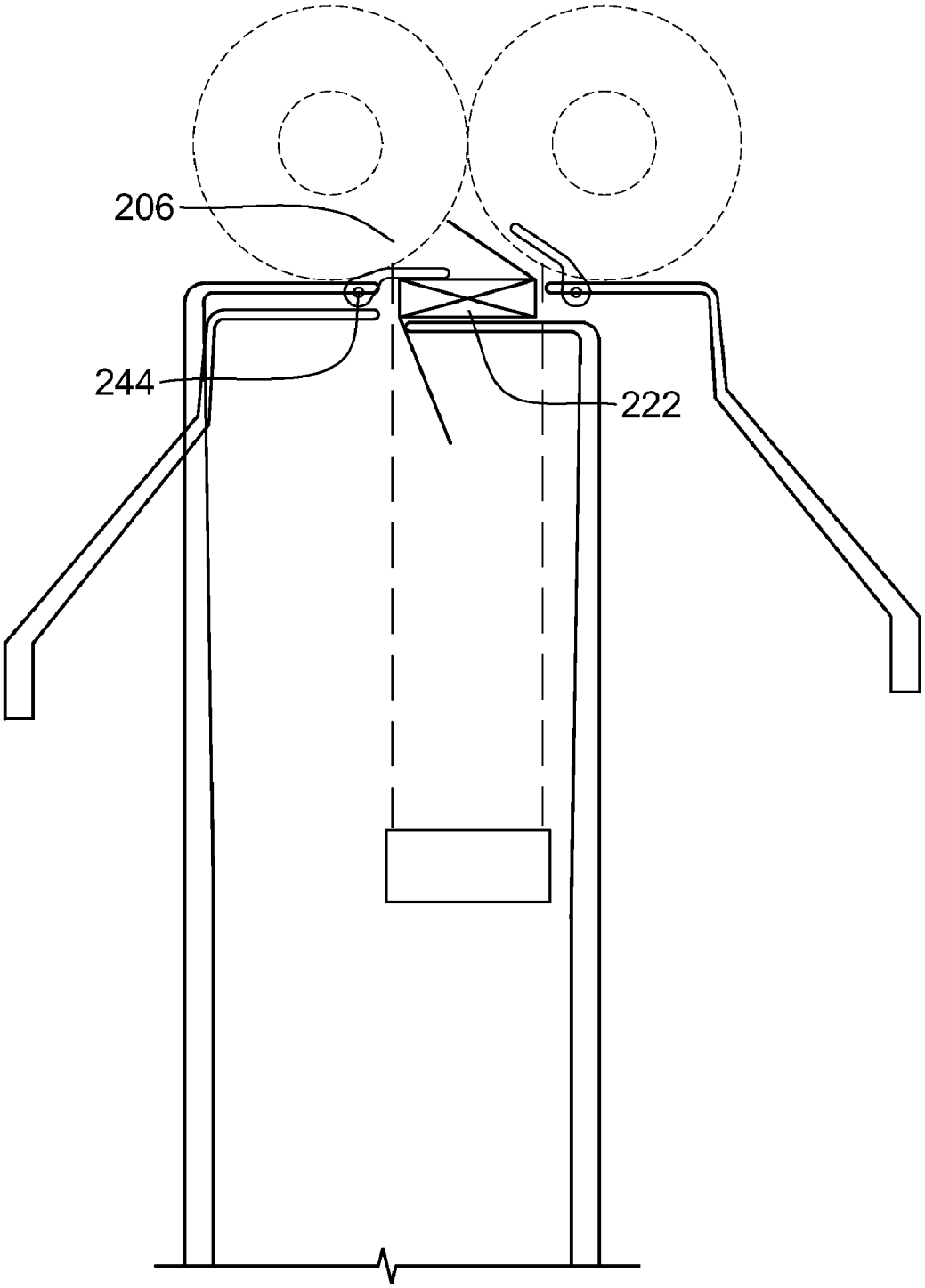

FIGS. 10*a*-10*b* illustrate the construction and operation of a second exemplary embodiment of a separator apparatus 200, according to the invention, which can be utilized for producing a succession of packs having an odd number of sheets, as depicted in FIG. 9. Those skilled in the art will recognize that the second separator apparatus 200 can also be used to produce packs having an even number of sheets. The following description is initially directed to forming packs having an odd number of sheets, however.

As shown in FIGS. 10*a*-10*b*, the second exemplary embodiment of the separator apparatus 200 includes a count finger arrangement 202 having first and second count fingers 204, 206, a build and transport arrangement 208 having a first (right) build finger 210 and a second (left) build finger 212, a first (left) strip finger 214 and a second (right) strip finger 215.

The first and second strip fingers 214, 215 are part of a stripping and folding arrangement 216, which may also include a panel folding arrangement (not shown), having panel folding fingers (not shown) and fluid emitters (not shown) similar to those described previously with regard to the construction and operation of the first exemplary embodiment of the separator apparatus 100. FIG. 10*a* also illustrates a first partly completed pack 222 of folded sheets resting on the first build finger 210.

The second exemplary embodiment of the separator apparatus 200 also includes a conveying arrangement 226 for receiving the completed packs 222 and a control arrangement (not shown) operatively connecting the various components of the separator apparatus 200 to a controller 228.

As further shown in FIGS. 10*a*-10*p*, the second exemplary embodiment of the separator apparatus 200 is mounted downstream from (below) and as close as is practical to a pair of folding rolls 230, 232 for forming completed packs 222 containing a desired number of interfolded sheets in a stacking region 234 extending downstream from the folding rolls 230, 232. The stacking region 234 is disposed about a sheet path, indicated by arrows 236 extending through a nip 238 defined between the pair of folding rolls 230, 232.

The completed packs 222, etc. are formed from sheets cut from a continuously flowing sheet stream issuing downstream from the pair of interfolding rolls 230, 232 along the sheet path 236. The interfolded sheets have adjacent panels of each sheet joined along an adjacent edge of the adjacent panels to form successive folds opening alternately in opposite directions oriented substantially transversely to the sheet path 236.

As shown in FIG. 10*a*, the stream of interfolded sheets is building the first pack 222 on top of the right build finger 210. The first and second count fingers 204, 206 are illustrated in their respective retracted positions, with their distal ends located inside of grooves in the first and second rolls 230, 232, in such a manner that the first and second count fingers 204, 206 do not engage the folds being formed in the sheet stream.

As shown in FIG. 10*b*, when the controller 228 determines that the pack 222 is completed, the left count finger 206 rotates into a fold opening to the left, on top of the last panel of the last sheet of the pack 222. Specifically, the left count finger 206 is rotated downward about its count finger axis 244 to begin the process of separating the now completed first pack 222 from the next pack in the succession of packs.

Figure 10C:
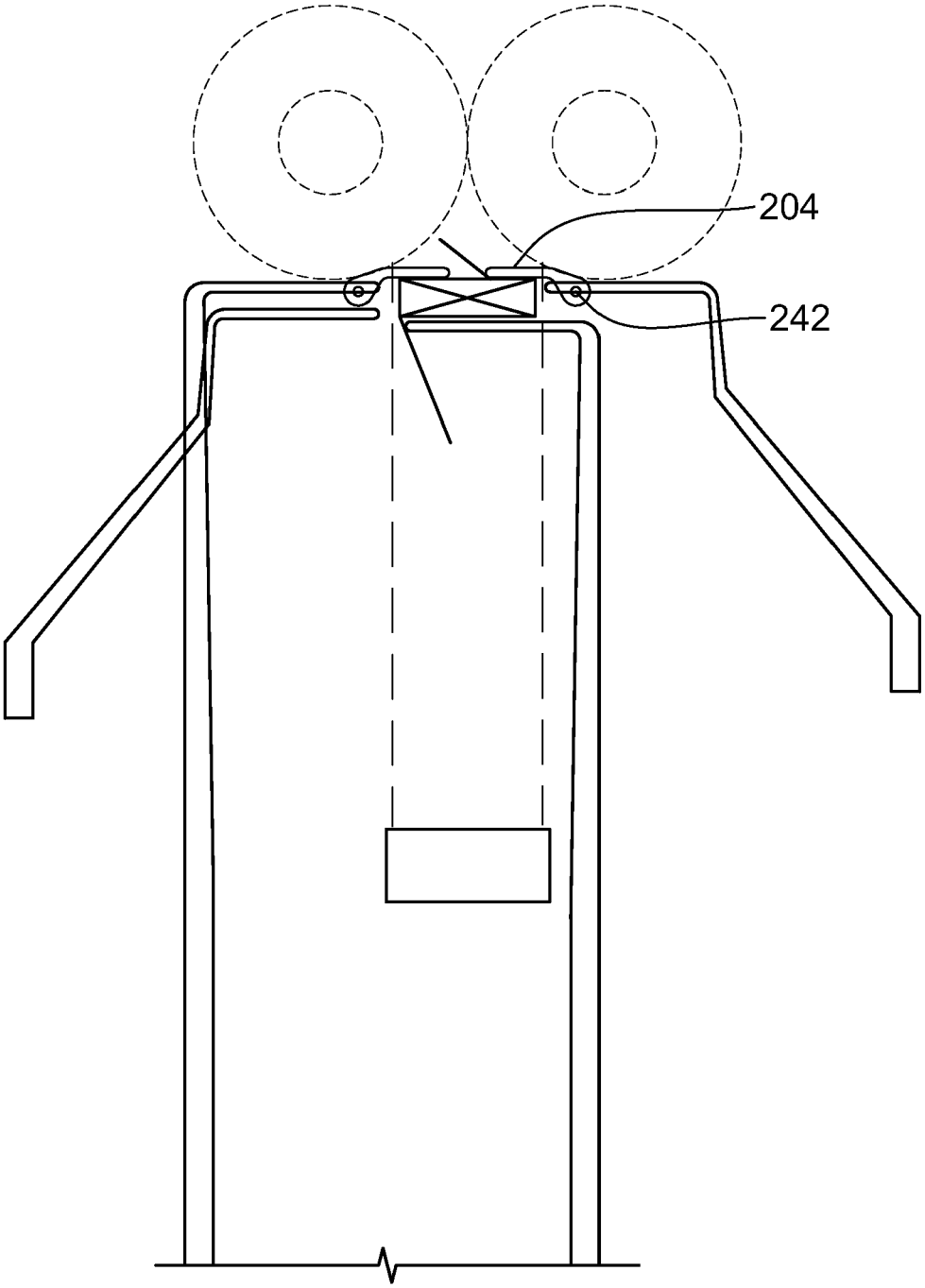

As shown in FIG. 10*c*, the right count finger 204 is then rotated about its respective count finger axis 242 into contact with what will become the first panel of the first sheet of a next pack 224.

Figure 10D:
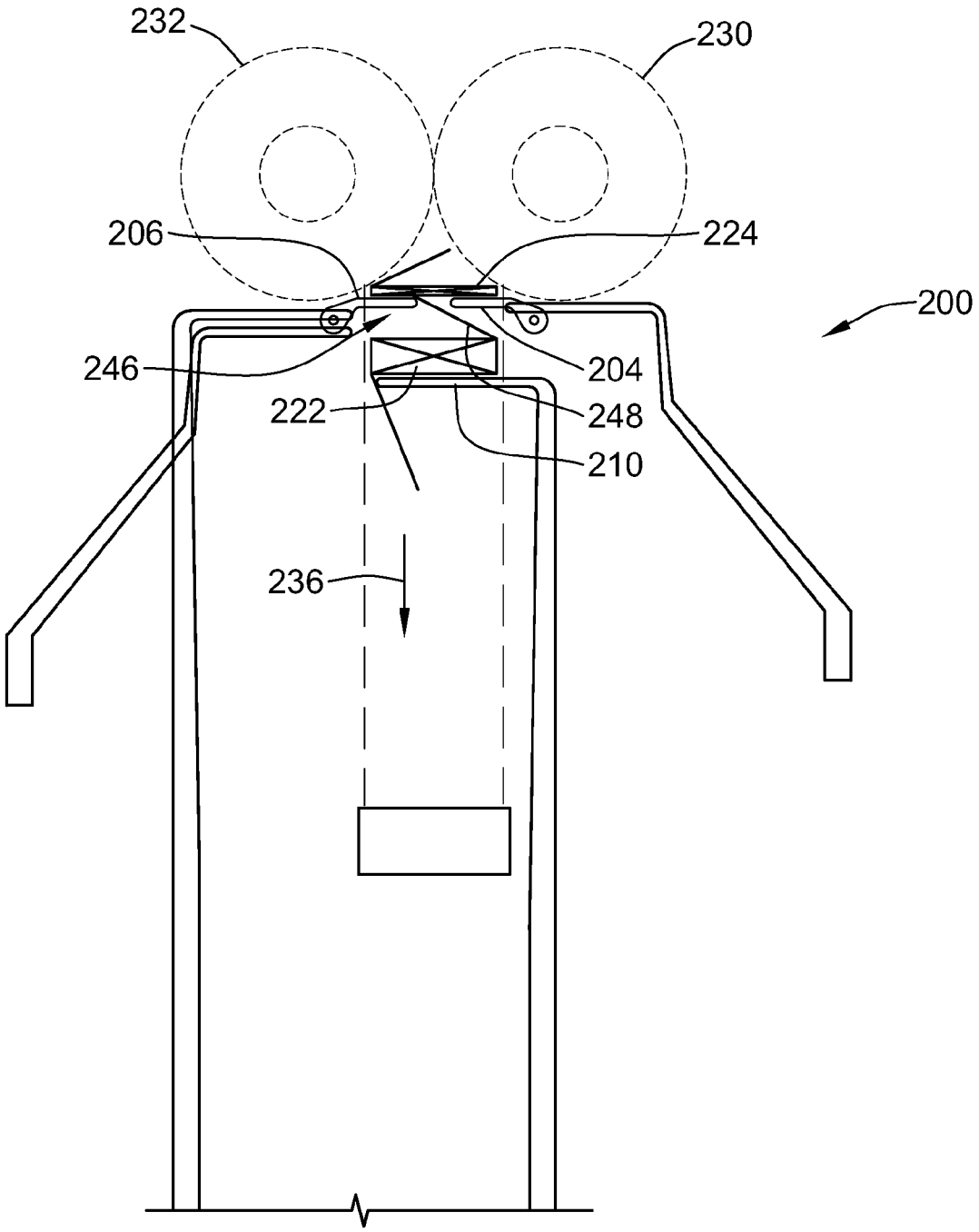

As shown in FIG. 10*d*, once both the right and left count fingers 204, 206 have rotated to their extended positions, the separator apparatus 200 begins moving the count finger axes 242, 244 longitudinally along the sheet path 236 in a downstream direction (downward in the orientation of the apparatus 200 shown in FIG. 10*d*) while the folding rolls 230, 232 continue to run at full speed depositing successive folded sheets on an upper surface of the extended count fingers 204, 206, to thereby begin building the second pack 224 on top of the extended count fingers 204, 206.

As further shown in FIG. 10*d*, once the count fingers 204, 206 have pivoted from their retracted to their extended positions and begin moving downward on the sheet path 236, the right build finger 210 is moved downstream along the sheet path 236 away from the count fingers 204, 206 at a faster rate than the count fingers 204, 206 are moving downward, to thereby provide a space 246 between a last sheet 248 of the completed pack 222 and the count fingers 204, 206.

Figure 10E:
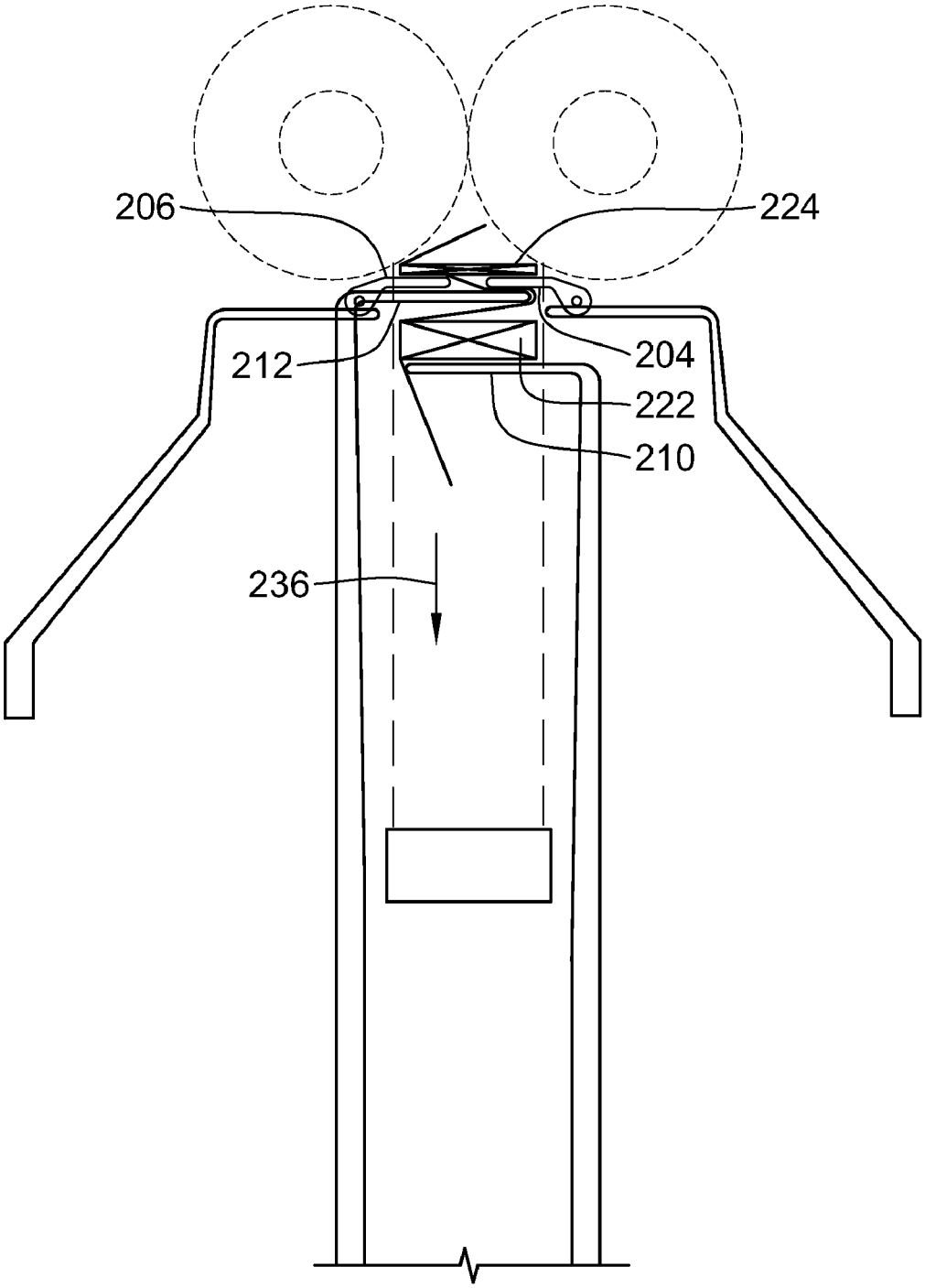

As shown in FIG. 10*e*, as the next stack 224 continues to build on top of the extended count fingers 204, 206, the left build finger 212 is moved transversely across the sheet path 236 over the last sheet of the completed pack 222, in such a manner that the left build finger 212 lifts the top panel 248 of the last sheet of the completed pack 222 upward away from the remainder of the completed pack 222.

Figure 10F:
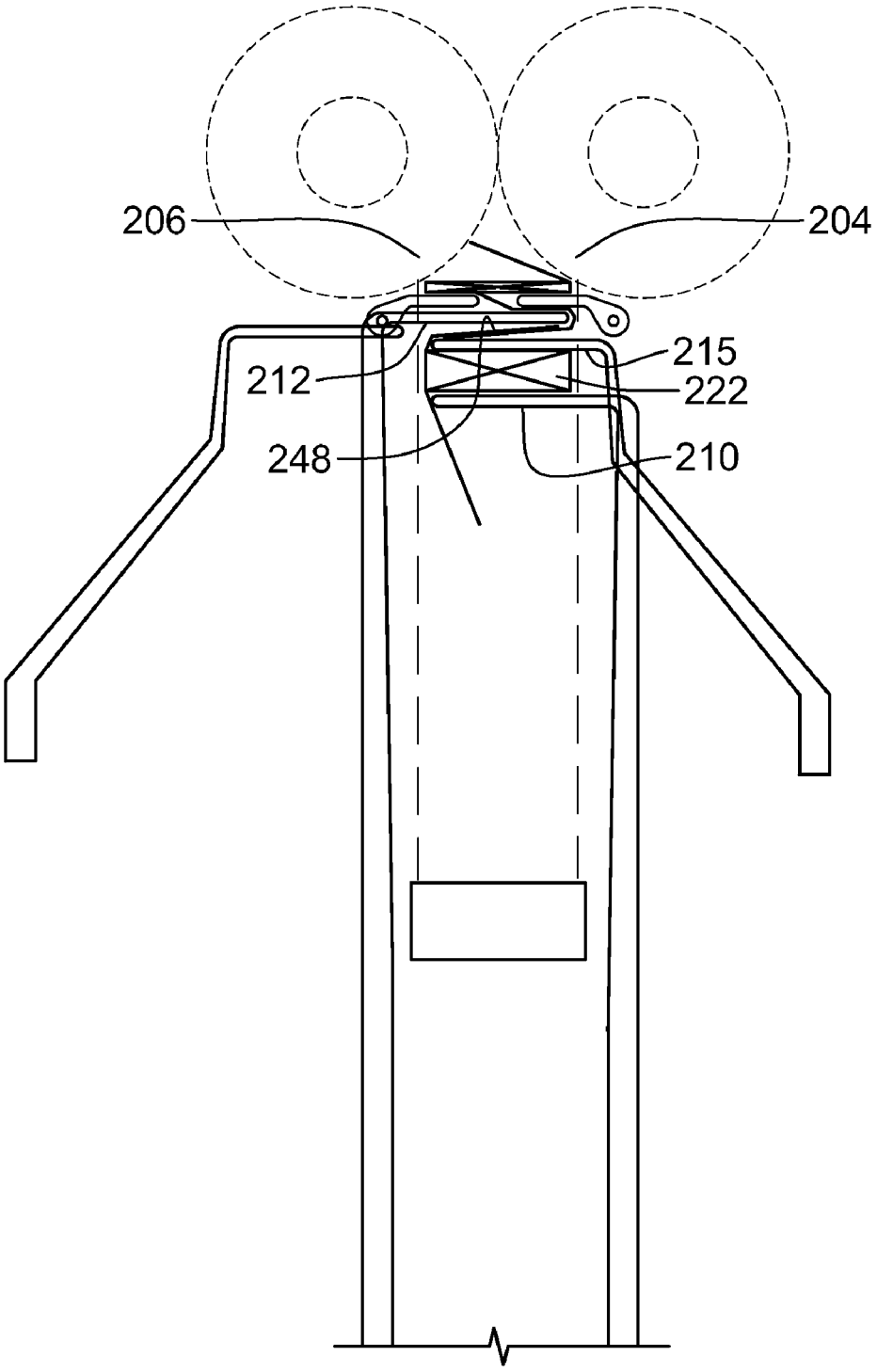

As shown in FIG. 10*f*, with the left build finger 212 lifting the top panel 248 of the completed pack 222 upward off the remainder of the pack 222, the right strip finger 215 is moved transversely inward across the top of the completed pack 222, beneath the last panel 248 of the completed pack 222.

Figure 10G:
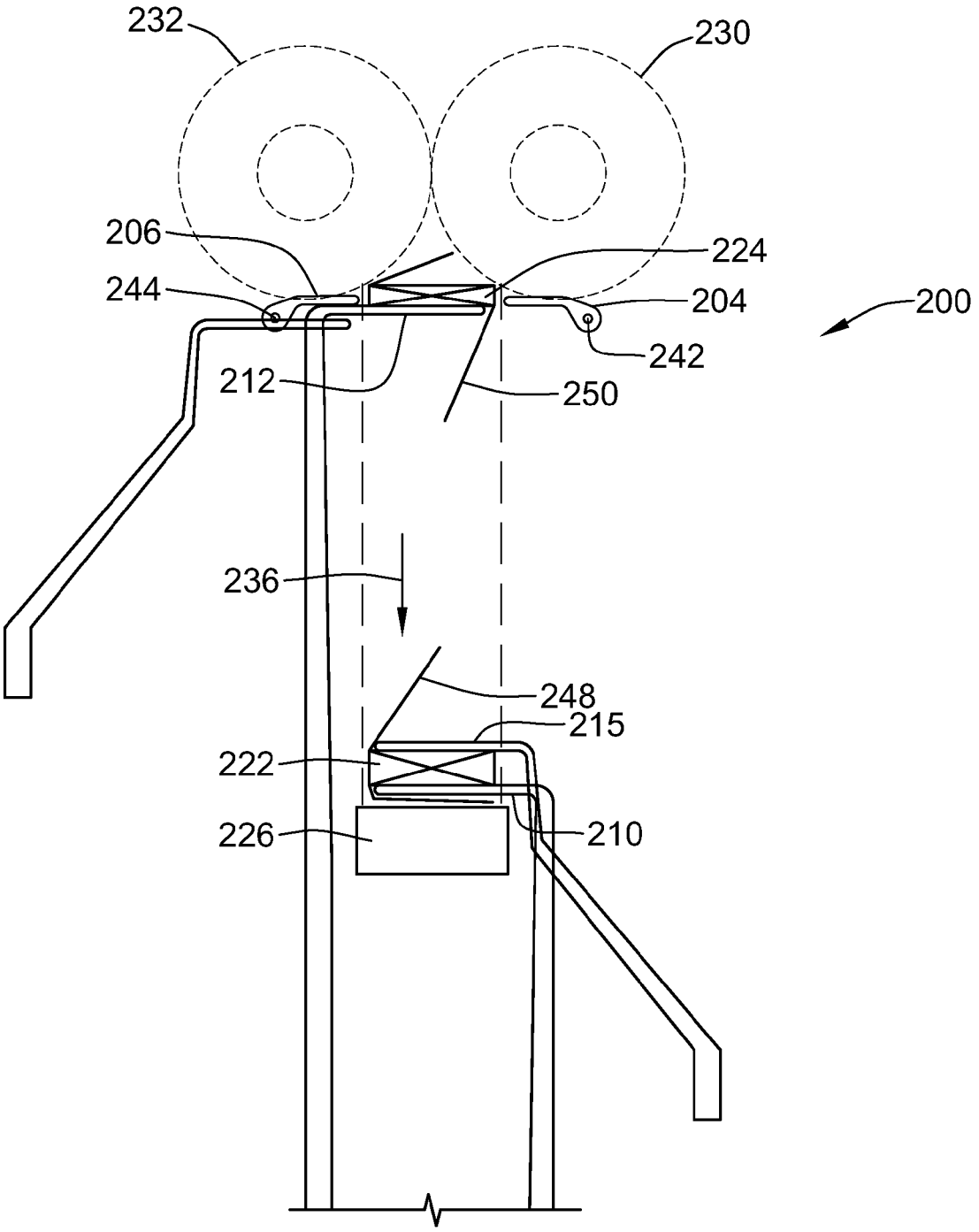

As shown in FIG. 10*g*, the right build finger 210 and the strip finger 215 are then moved downward along the sheet path 236 to deliver the completed pack 222 to the conveying arrangement 226.

As further shown in FIG. 10*g*, once the left build finger 212 is moved transversely into its extended position below the count fingers 204, 206, the count finger axes 242, 244 are moved transversely outward, away from the sheet path 236, to transfer the partly completed second pack 224 from the count fingers 204, 206 to the left build finger 212, so that the second pack 224 can continue to be built on the second build finger 212 by the stream of folded sheets issuing from the folding rolls 230, 232.

Figure 10H:
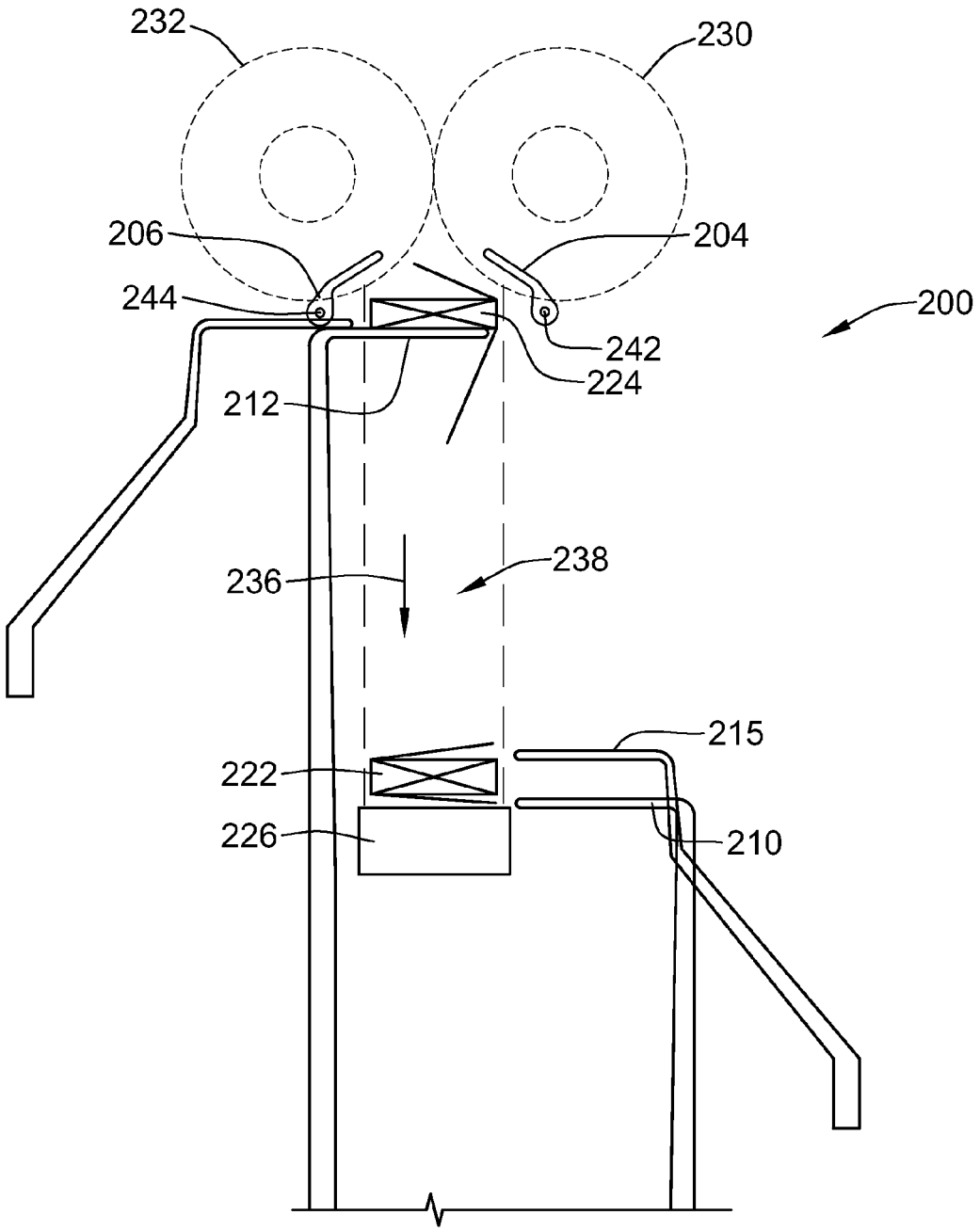

As shown in FIG. 10*h*, the right build finger 210 and the right strip finger 215 are then moved transversely outward to a retracted position thereof, to deliver the completed first pack 222 to the conveying arrangement 226, so that the conveying arrangement 226 can transport the completed pack 222 out of the stacking region 238 by moving the completed pack 222 in a direction into, or out of the page as illustrated in FIG. 10*h*.

As further illustrated in FIG. 10*h*, subsequent to delivering the partly completed next pack 224 to the left build finger 212, the axes 242, 244 of the count fingers 204, 206 are moved transversely upward and inward to a ready position, awaiting direction from the controller 228 to actuate for performing the next separation. The count fingers 204, 206 are also configured and operatively connected to the remainder of the separator apparatus 200 in such a manner that as the axes 242, 244 are moved to the ready position, as illustrated in FIG. 10*h*, the count fingers 204, 206 pivot about their respective axes 242, 244 in such a manner that the distal ends of the count fingers 204, 206 are rotated upward into respective grooves in the rolls 230, 232, so that the count fingers 204, 206 do not contact sheets issuing from the rolls 230, 232 while the count fingers 204, 206 are in their retracted positions.

Figure 10I:
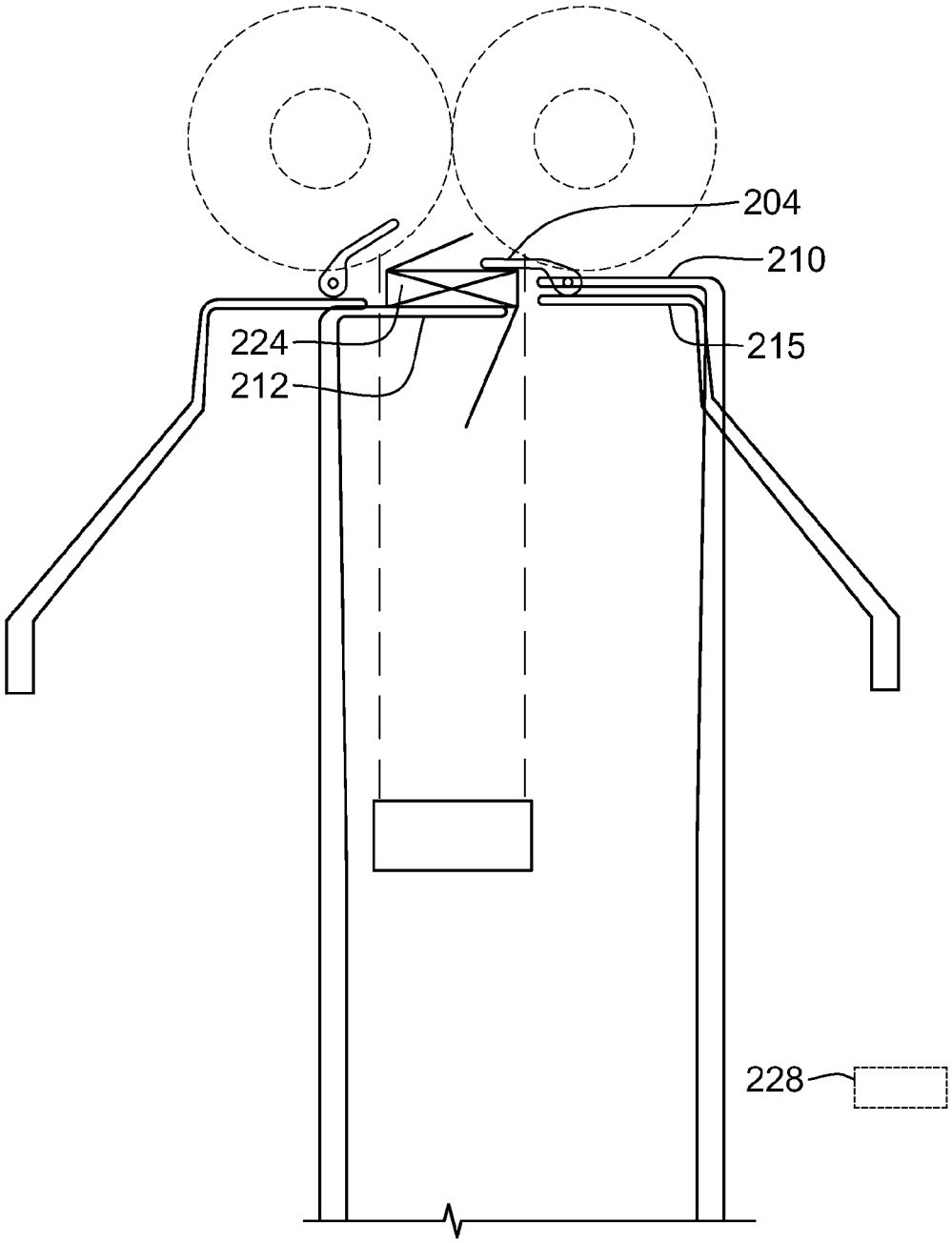

At the point in the process illustrated in FIG. 10*i*, the controller 228 has determined that the desired number of sheets have been deposited onto the left build finger 212 to complete the second pack 224, and the controller has caused the right count finger 204 to be actuated from its retracted position, as shown in FIG. 10*h*, to an extended position, as shown in FIG. 10*i*, whereat the right count finger 204 extends across a portion of the last panel of the last sheet of the now completed second pack 224. As further indicated in FIG. 10*i*, the right build finger 210 and right strip finger 215 have been moved upstream to ready position, to await insertion for forming the next pack after the now completed pack 224.

Figure 10J:
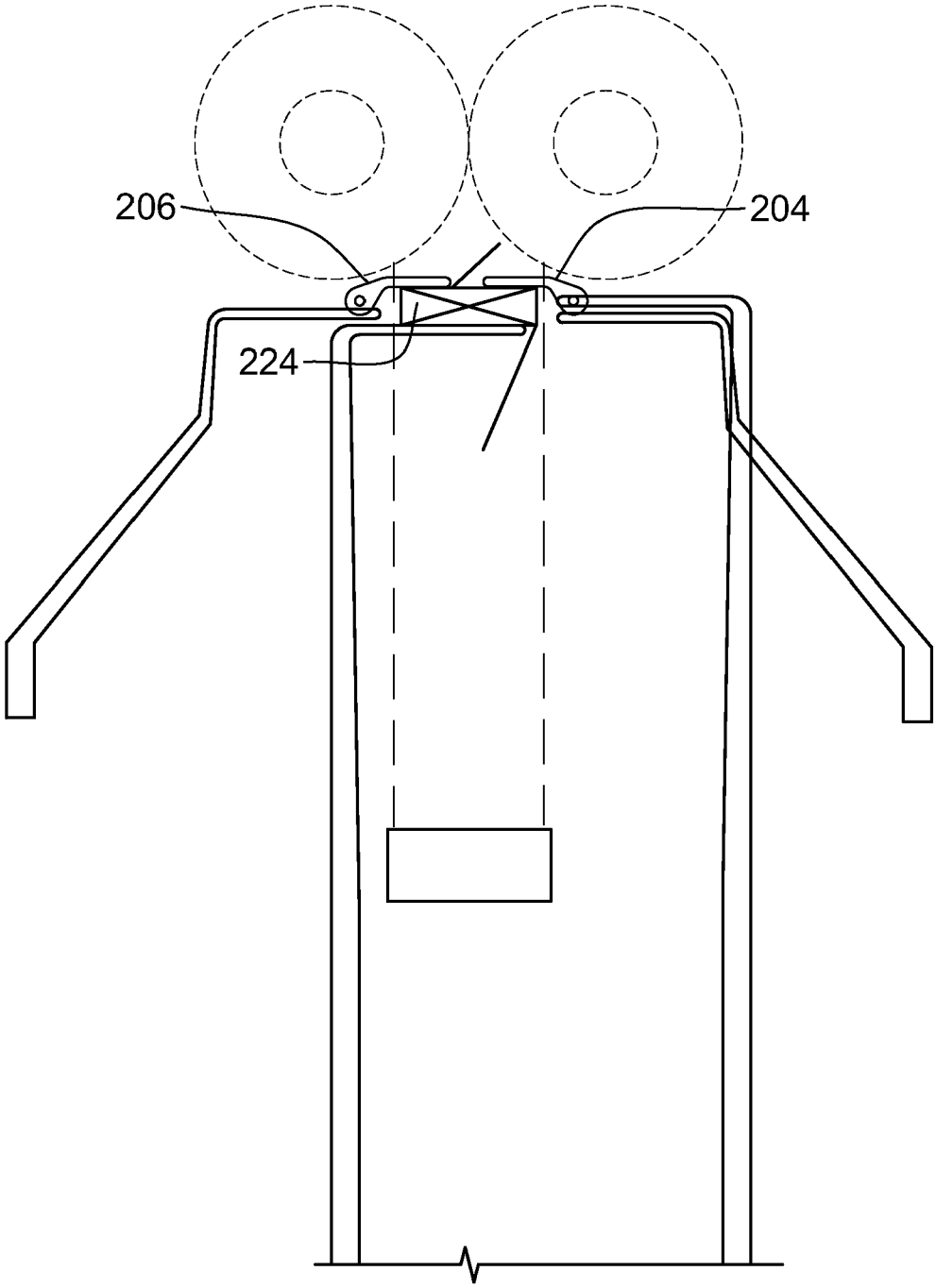

As shown in FIG. 10*j*, one panel after the right count finger 204 is actuated into its extended position, the left count finger 206 is rotated from its fully refracted position, as shown in FIG. 10*h*, to its extended position, as shown in FIG. 10*j*, to contact the first panel of the next pack to be formed. It will be noted, by those have skill in the art, that the succession of operation of the right and left count fingers 204, 206 is reversed for completion of the second pack 224 from the succession of operation performed to complete the first pack 222 in the manner described above. For packs having an odd number of sheets, the sequence of operation of the first and second count fingers is reversed for each successive pack.

Figure 10K:
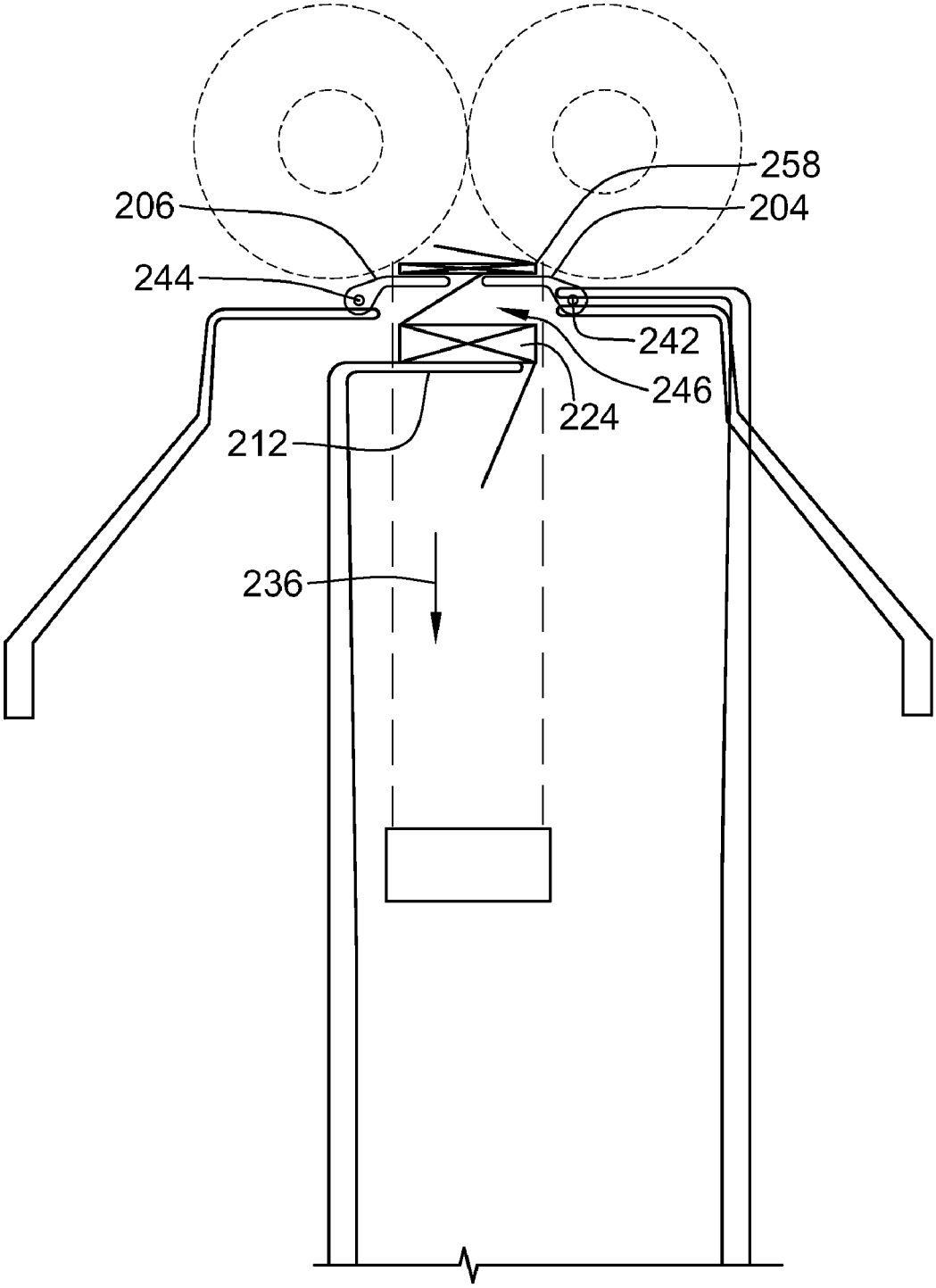
Figure 10L:
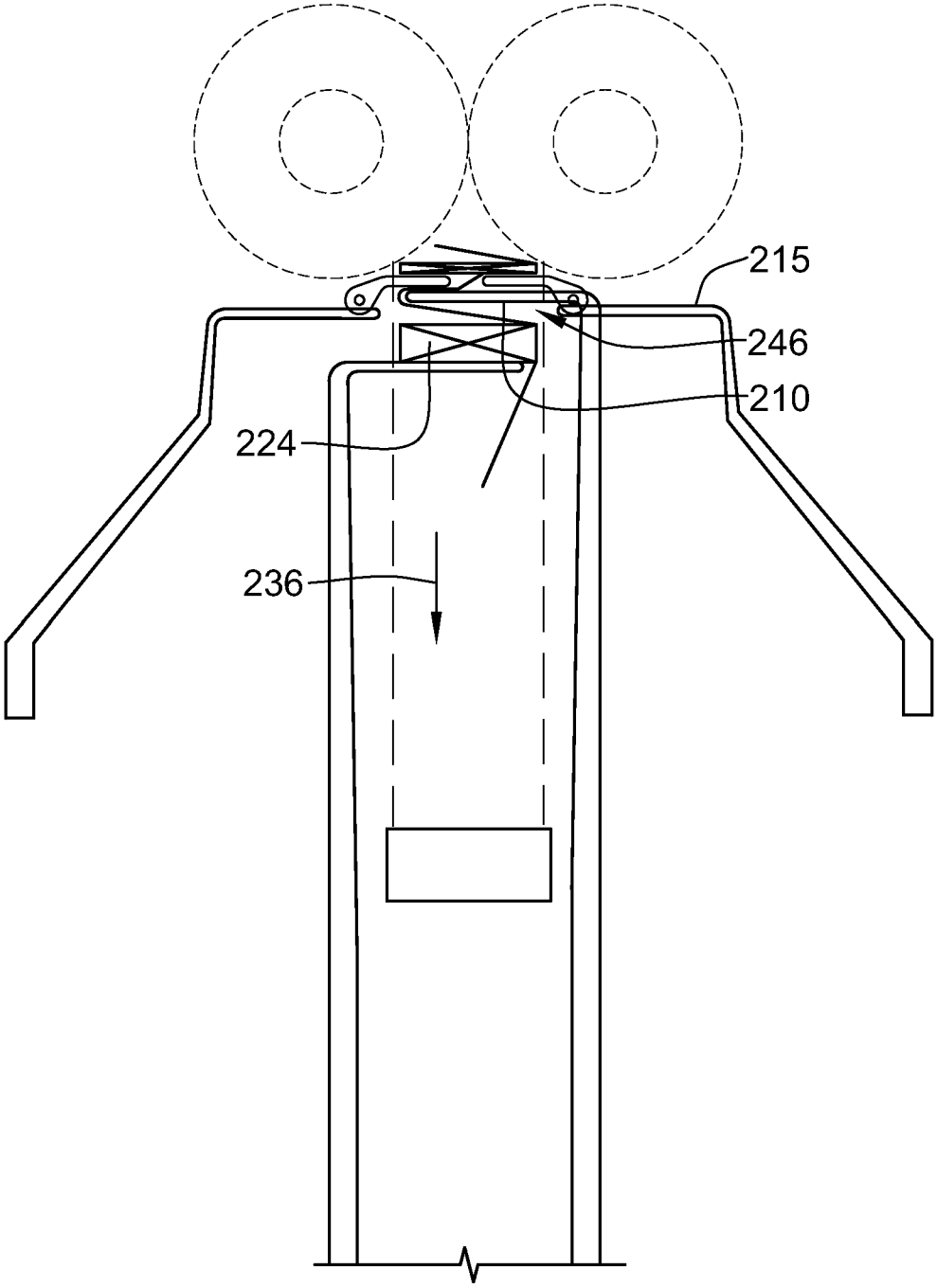

As shown in FIG. 10*k*, as the third pack 258 is built upon an upper surface of the count fingers 204, 206, the left build finger 212 is moved downward along the sheet path 236 at a rate more rapid than the axes 242, 244 of the count fingers are being moved in a downward direction, to thereby create the gap 246 between the last panel of the now completed second pack 224 and the remainder of the pack 224.

As shown in FIG. 101, the right build finger 210 is then inserted into the gap 246 just below the count fingers 204, 206, to thereby lift the last panel of the completed stack 224 away from the remainder of the second pack 224.

Figure 10M:
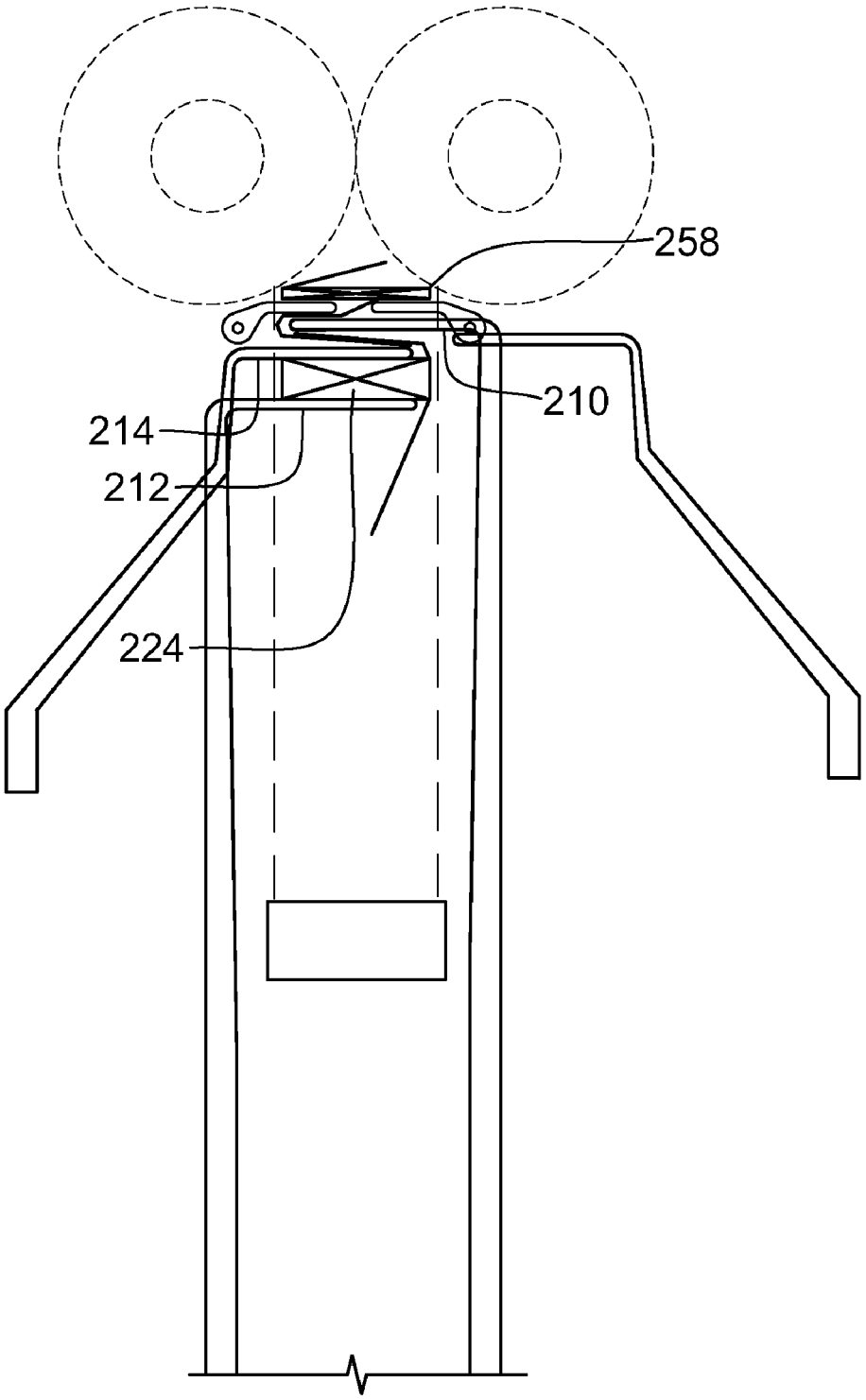

As shown in FIG. 10*m*, the left strip finger 214 is then inserted across the upper surface of the second pack 224, below the first panel of the next pack 258 and the last panel of the completed pack 224, and then the left strip finger 214 and left build finger 212 are moved downward along the sheet path 236 to separate the completed second pack from the partly completed third pack 258 being built on top of the count fingers 204, 206.

Figure 10N:
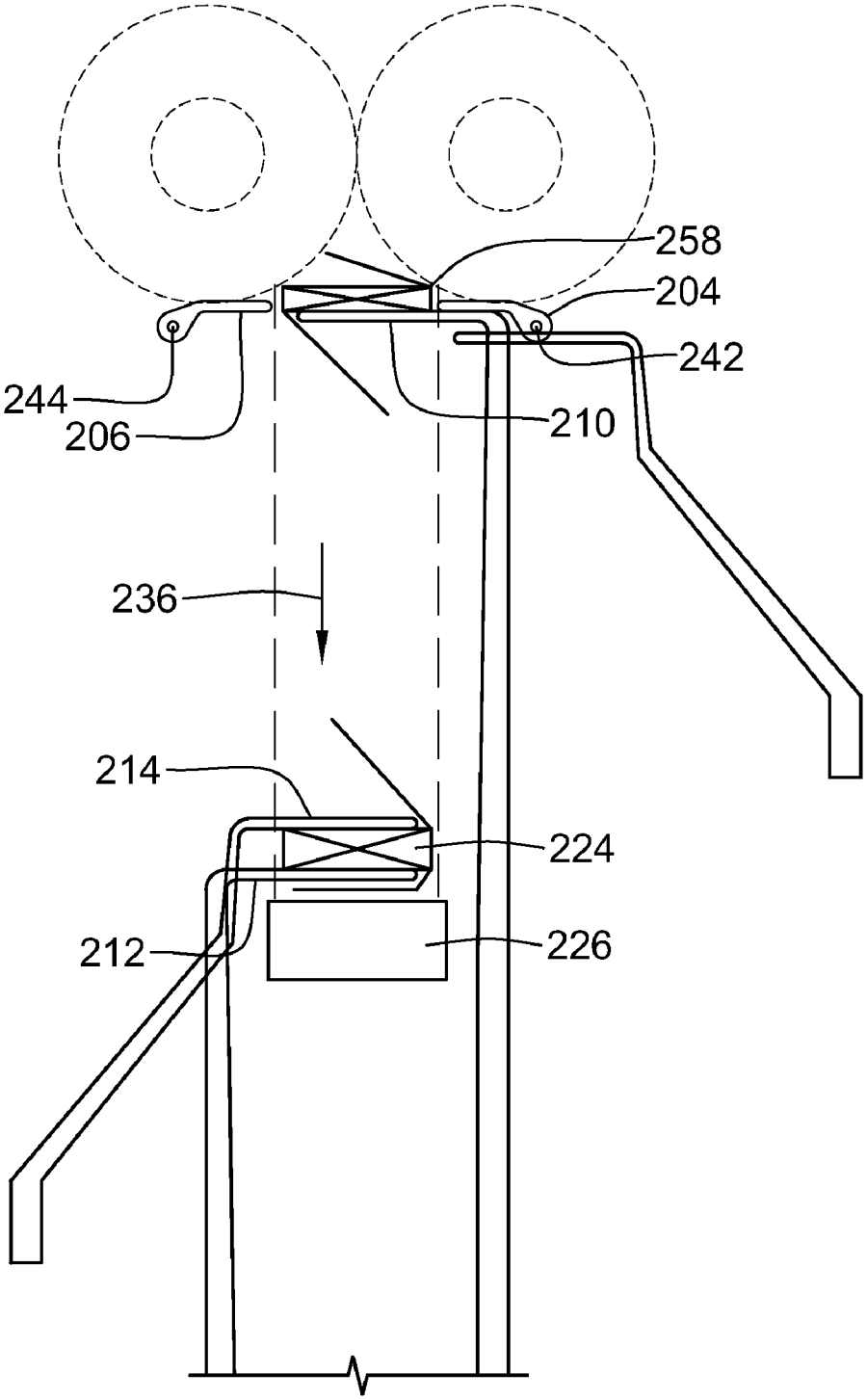

As further shown in FIG. 10*n*, once the completed pack 224 has been pulled away from the third pack 258, the partly built third pack 258 is delivered from the count fingers 204, 206 to the right build finger 210, by moving the count finger axes 242, 244 transversely outward from the sheet path 236, so that the partly completed pack 258 can drop onto the right build finger 210.

Figure 10O:
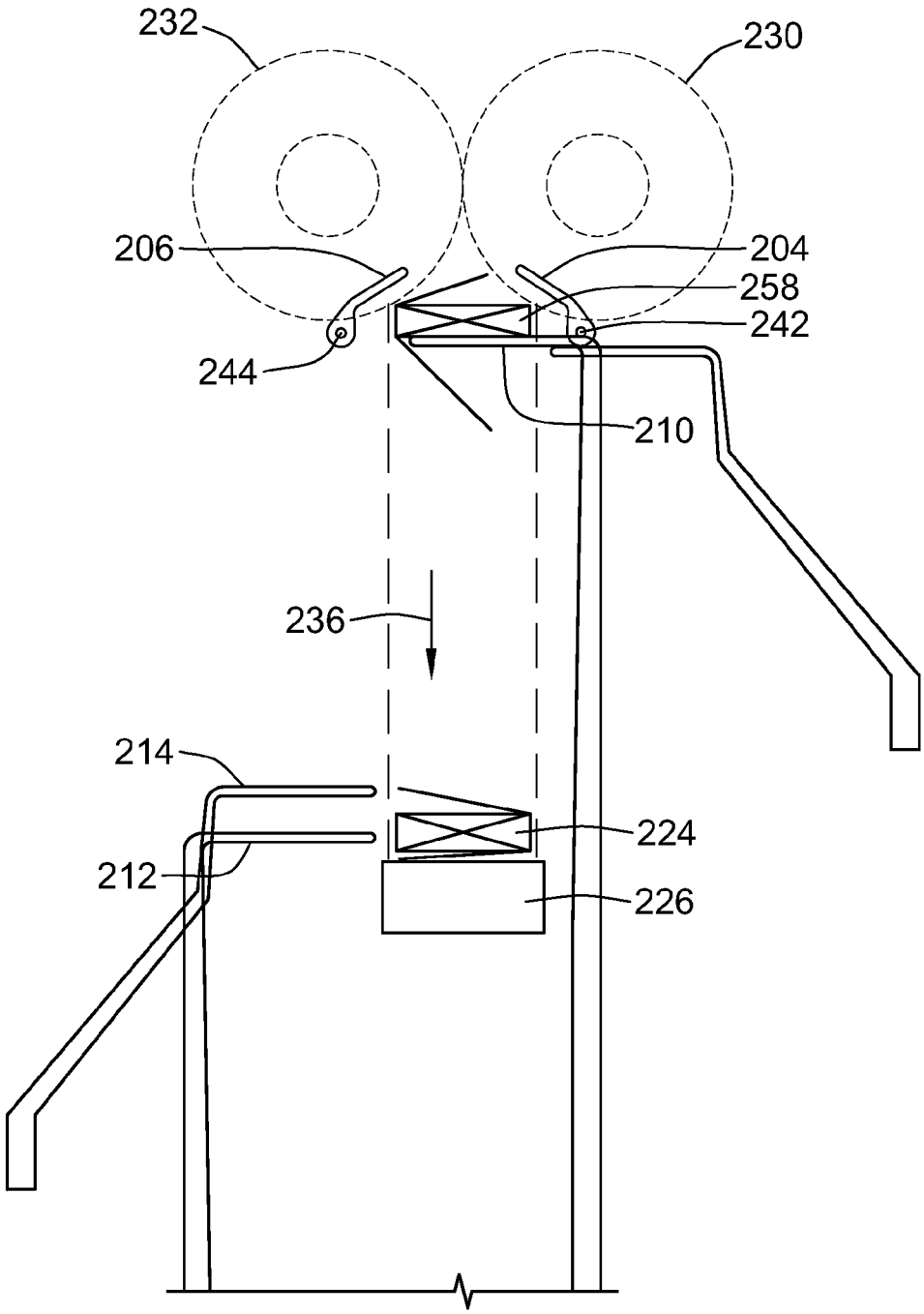

As shown in FIG. 10*o*, the left build and strip fingers 212, 214 are then moved transversely outward, to a retracted position, to thereby deliver the completed pack 224 to the conveying arrangement 226. The folding rolls 230, 232 continue to deliver folded sheets to the upper surface of the partly completed third pack 258, as the right build finger 210 is moved downward at an appropriate speed to allow room for the additional sheets to be added to the third pack 258.

As further illustrated in FIG. 10*o*, once the third pack 258 has been delivered to the right build finger 210 by the count fingers 204, 206, the count finger axes 242, 244 are moved transversely upward and inward, and the count fingers 204, 206 are rotated upward about their respective axes 242, 244 into the circumferential grooves in the rolls 230, 232 to be ready for actuation by the controller when the desired number of sheets have been deposited to form a completed third stack 258.

Figure 10P:
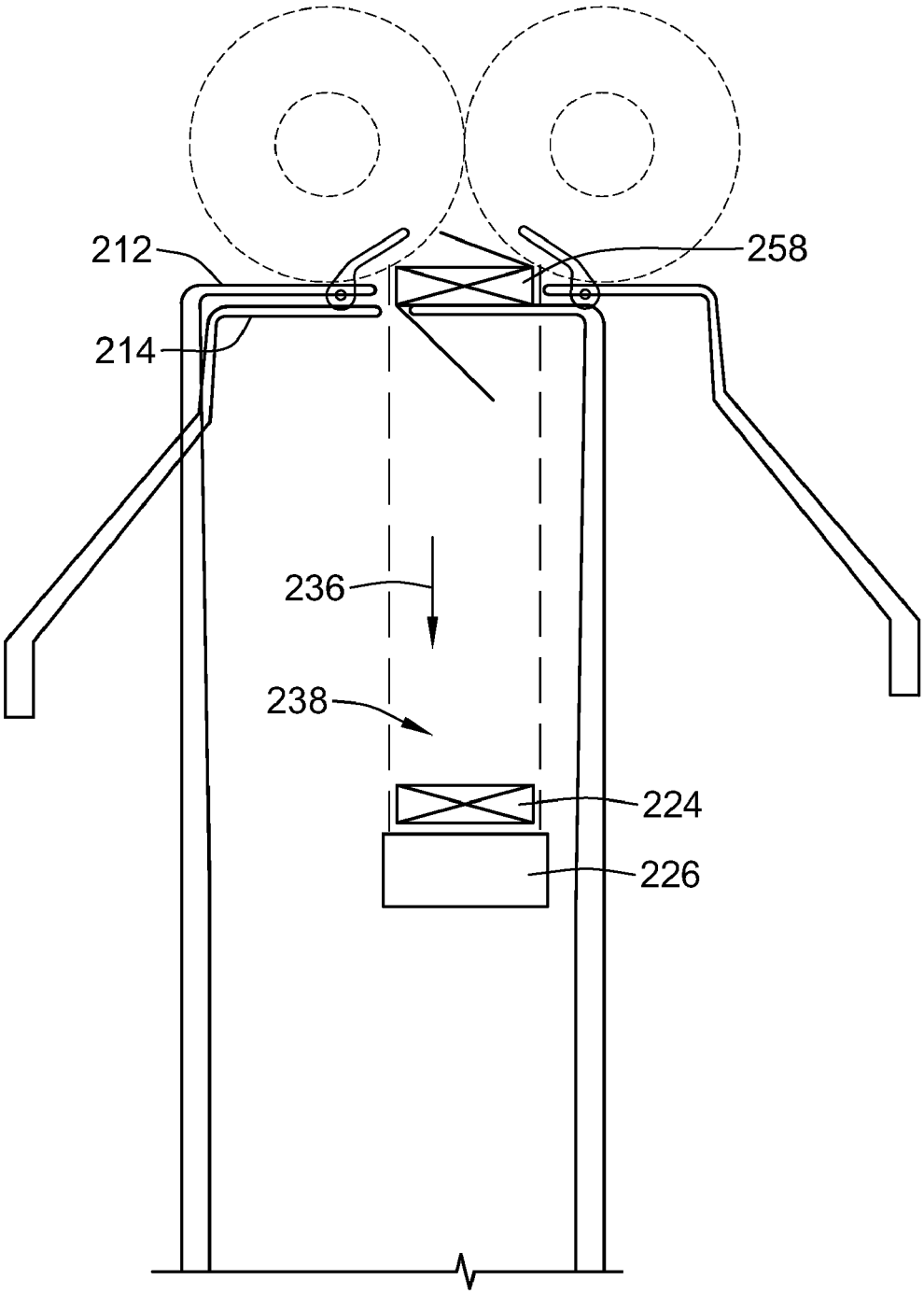

As shown in FIG. 10*p*, the left build and strip fingers 212, 214 are then moved vertically upward to return them to their retracted position, and the completed second pack 224 is conveyed out of the stacking region 238 by the conveying arrangement 226, to thereby return the separator apparatus 200 to the same condition as illustrated and described above with regard to FIG. 10*a*, so that the separation sequence can repeat itself.

Those having skill in the art will readily recognize, that the second exemplary embodiment of the separator apparatus 200 can be operated in an alternative manner, to form packs having even numbers of sheets with the first and last sheets oriented in either desired direction with respect to the sheet path 236.

It will be further understood that the panel folding arrangement described hereinabove with respect to the first exemplary embodiment of the separator apparatus 100 may be utilized with the second exemplary embodiment of the separator apparatus 200 to partly fold a first or last panel of a completed pack back upon itself.

In practicing the invention, it is contemplated that any appropriate form of actuation may be utilized for moving and positioning the count finger axes 142, 144, 242, 244, and for rotating the count fingers 104, 106, 204, 206 about their respective axes during operation of a separator apparatus 100, 200 according to the invention.

It is advantageous in some embodiments of the invention, to utilize a form of the invention in which the number of actuators required for positioning and pivoting the count fingers is minimized. In one form of an exemplary embodiment of a separator apparatus 300, according to the invention, a count finger 304 is operatively attached to a count finger carriage 305 by a count-finger arm arrangement 302, in such a manner that only two actuators 306, 308 are required to move the count finger 304 longitudinally along the sheet path 336, as indicated by arrow 310, transversely to the sheet path 336 as indicated by arrow 312, and for pivoting the count finger 304 about its count finger axis 316, as indicated by arrow 314, in the manner illustrated in FIG. 12*a*.

Figure 12A:
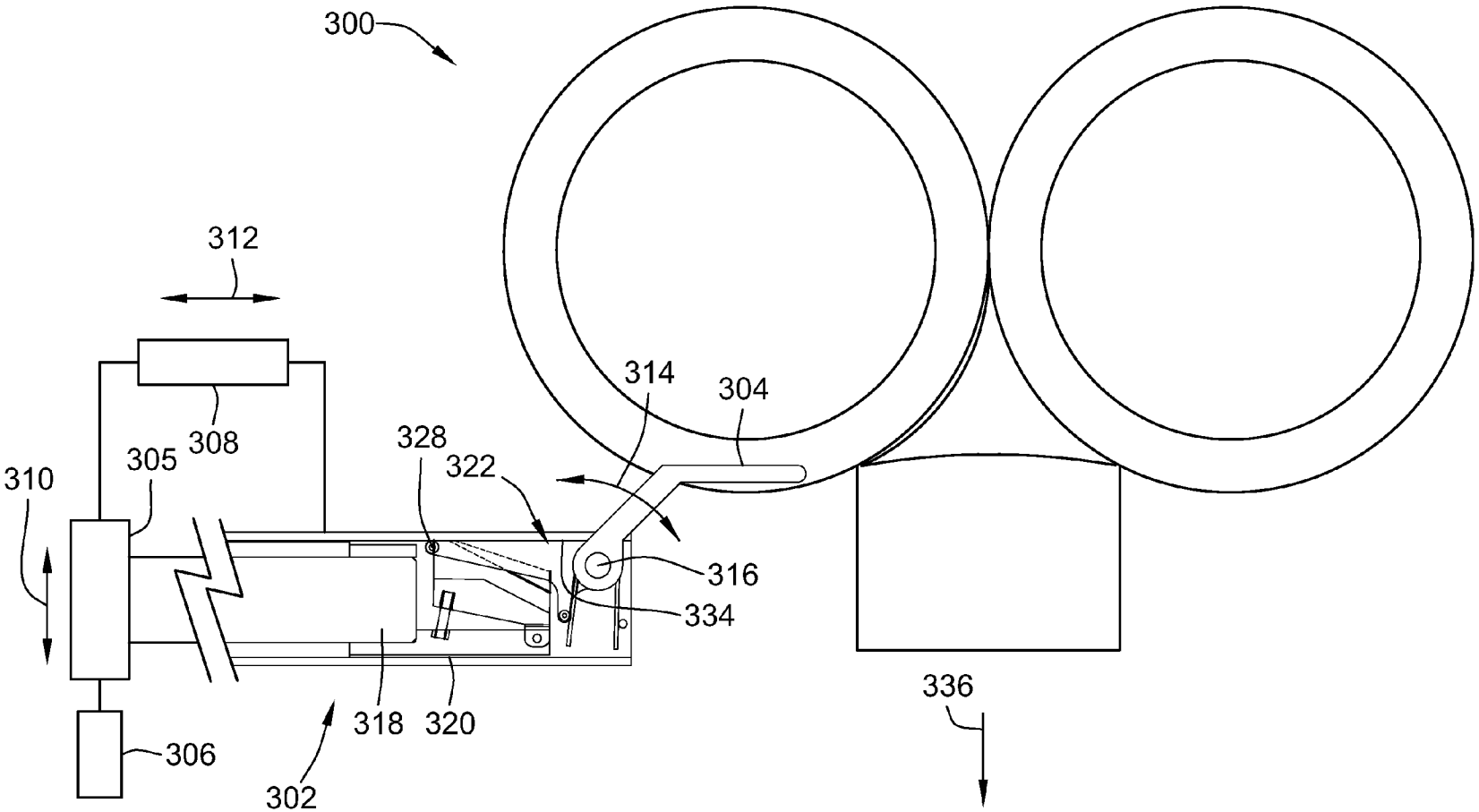
FIGS. 12*a*-12*h* illustrate an exemplary embodiment of the separator apparatus, according to the invention, including a count-finger arm arrangement which utilizes only two actively controlled actuators to achieve three directions of motion of a count finger of the separator apparatus.

As further illustrated in FIG. 12*a*, the count-finger arm arrangement 302 includes a first member 318, a second member 320, and a cam follower arrangement 322. In the exemplary embodiment of the count finger arrangement 302, the first member 318 takes the form of a support rail 318, having a proximal end thereof fixedly attached to the count rail carriage 305. The second member 320 of the count-finger arm arrangement 302 takes the form of a support tube 320 which is slidingly mounted over the first member 318 in such a manner that the second member 320 may be moved transversely along the first member 318 by operation of the first actuator 308, in order to selectively position the count finger axis 316 transversely with respect to the count finger carriage 305 and the sheet path 336. The count finger 304 is attached to a distal end of the second member 320 for pivoting movements 314 about the count finger axis 316. The count finger 304 is further operatively attached to both the first and second member 318, 320 via the cam and follower arrangement 322, in such a manner that relative movement between the first and second members 318, 320 in the transverse direction 312 causes the count finger 304 to pivot about the count finger axis 316 to a plurality of desired angular positions of the count finger 304 corresponding to the longitudinal and transverse position of the count finger axis 316 as determined by coordinated operation of the first and second actuators 306, 308.

Figure 12B:
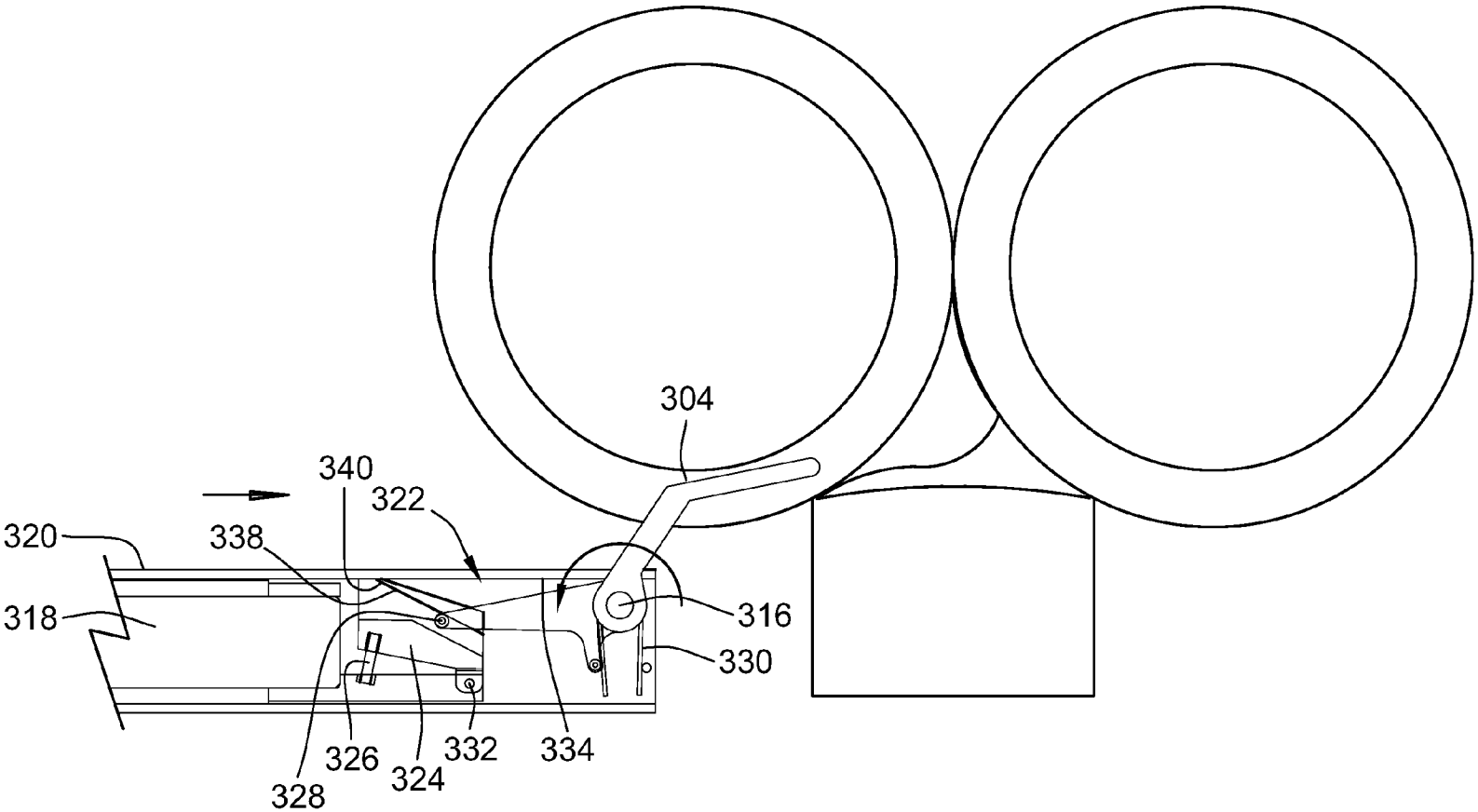

As shown in FIG. 12*b*, the cam-follower arrangement includes a pivoting cam 324 and a cam return spring 326 attached to the distal end of the first member 318, in combination with a cam follower 328 extending from the count finger 304, and a count finger return spring 330. The cam 324 is pivotably attached to the distal end of the first member 318 about a cam pivot 332, and the cam return spring 326 is operatively attached between the first member 318 and the cam 324, to urge the cam to rotate in a counter-clockwise direction about the cam pivot 332, as shown in FIG. 12*b*. The count finger return spring 330 is operatively connected between the count finger 304 and the second member 320 to urge counter-clockwise rotation of the count finger 304 about the count finger axis 316, in an exemplary apparatus as shown in FIG. 12*b*.

As will be understood from an examination of FIGS. 12*a*, 12*d*-12*h*, during portions of the operation of the separator apparatus 300 in which the count finger 304 is positioned substantially perpendicularly to the sheet path 336, the count finger return spring 330 urges the cam follower 328 into contact with a transversely extending surface of the second element 320.

As shown in FIG. 12*b*, during portions of operation of the separator apparatus 300 in which the count finger 304 is pivoted upward (clockwise as shown in FIG. 12*b*) from a position of substantial perpendicularity with the sheet path 336, the cam follower 328 is positioned along a lower inclined cam surface 338 of the cam 324, while an upper corner 340 of the included surface 338 is urged into contact with the transversely extending surface 334 of the second member 320 by the cam return spring 326.

Figure 12C:
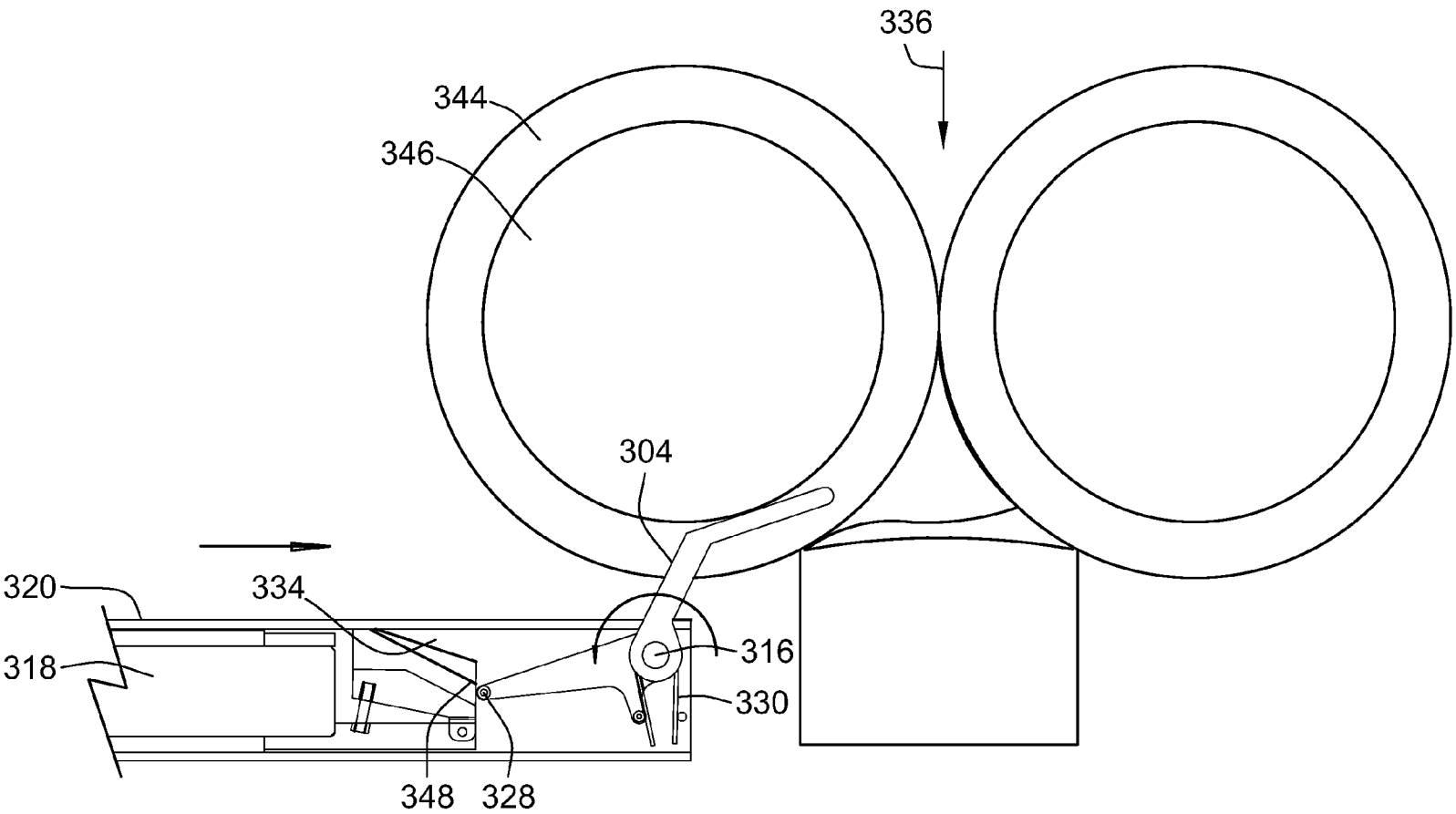
Figure 12D:
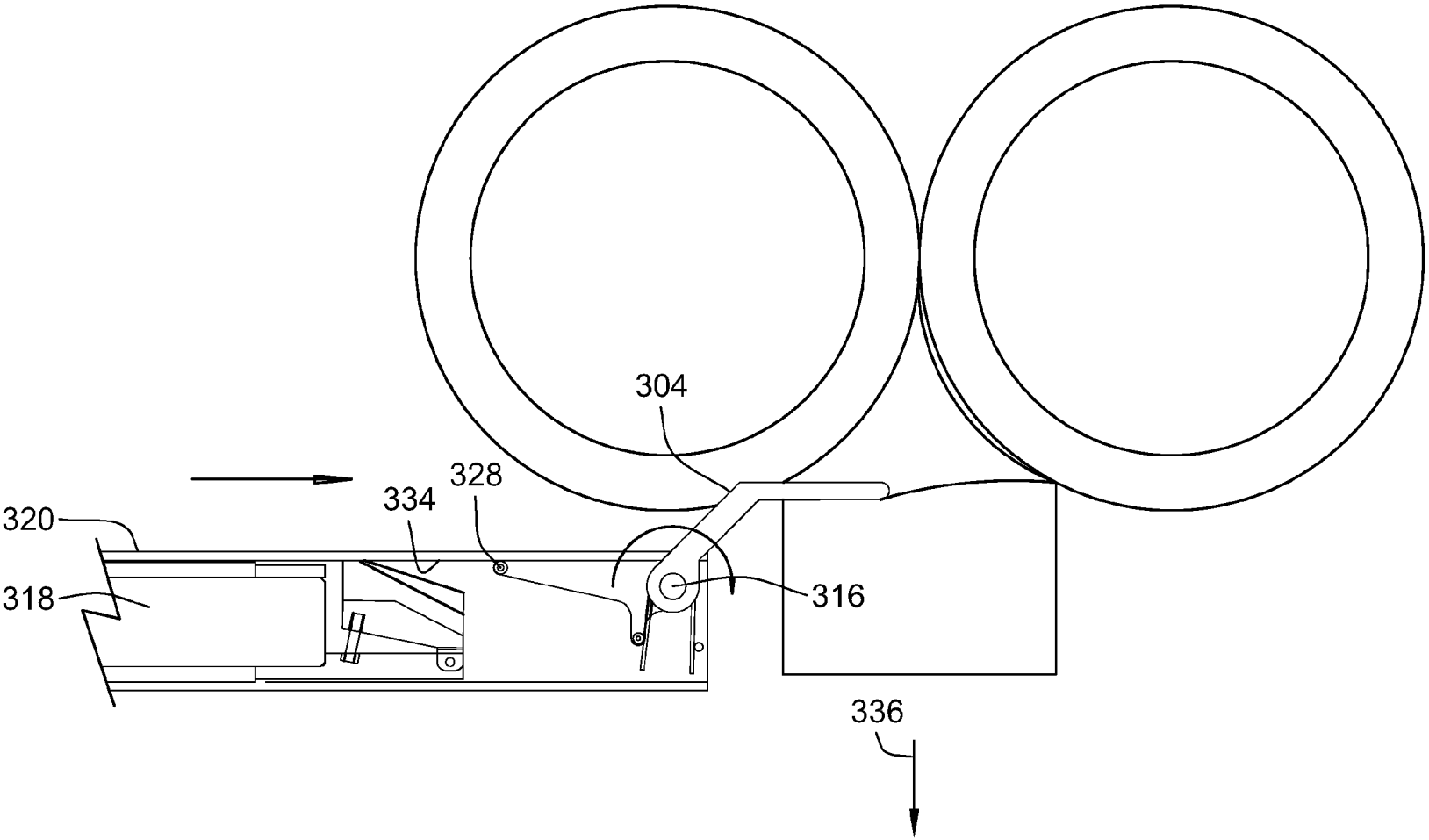
Figure 12E:
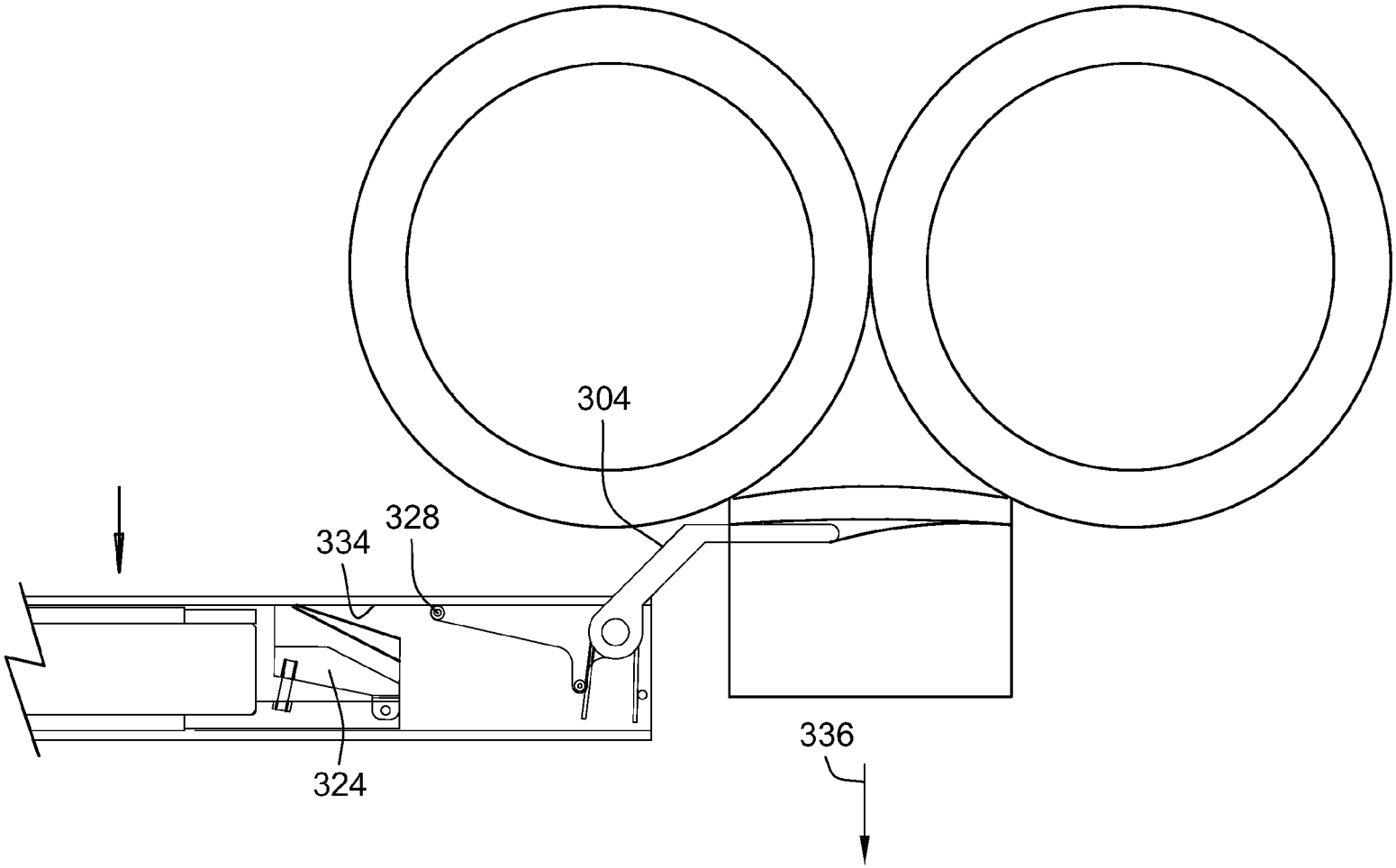
Figure 12F:
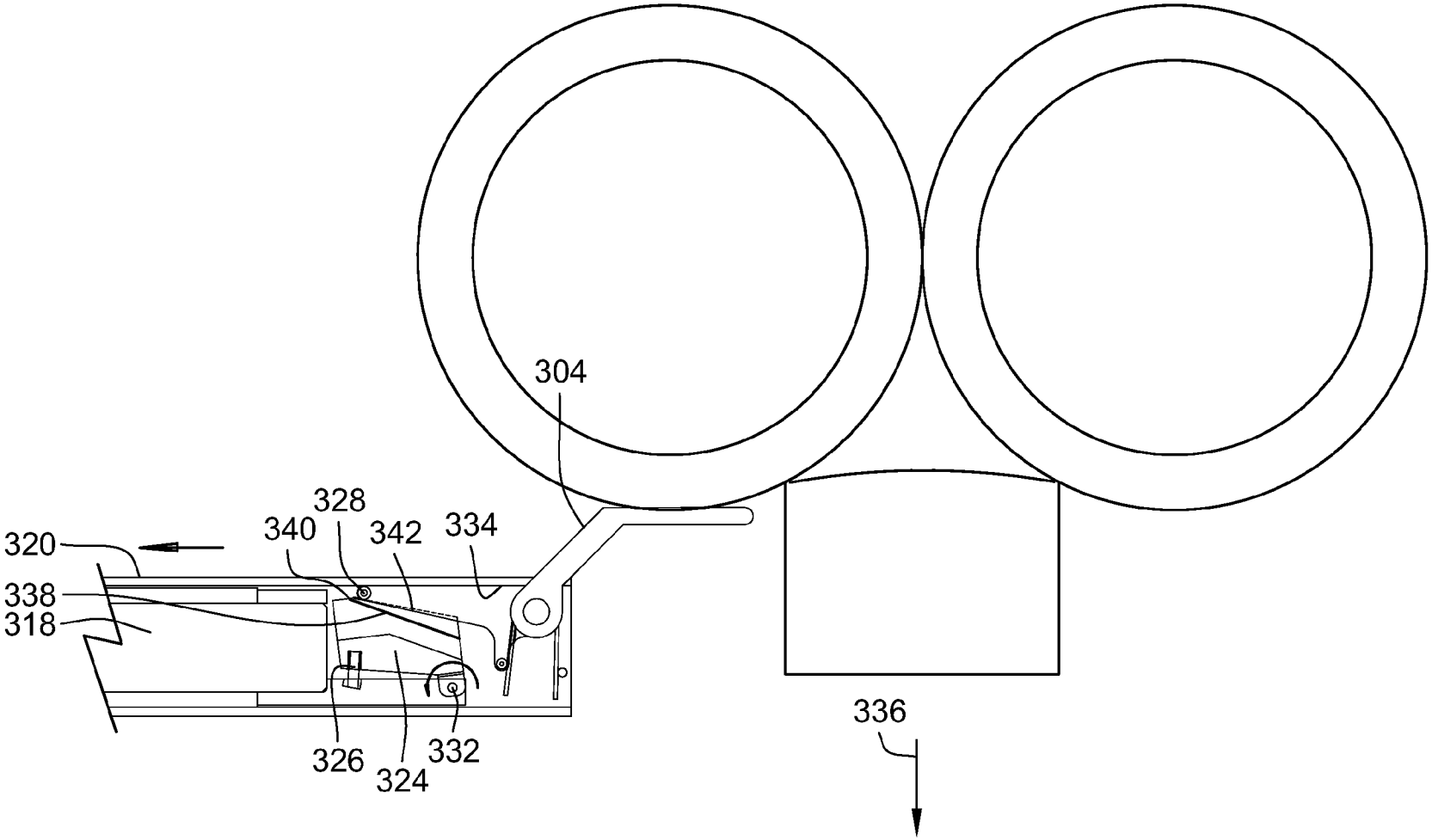
Figure 12G:
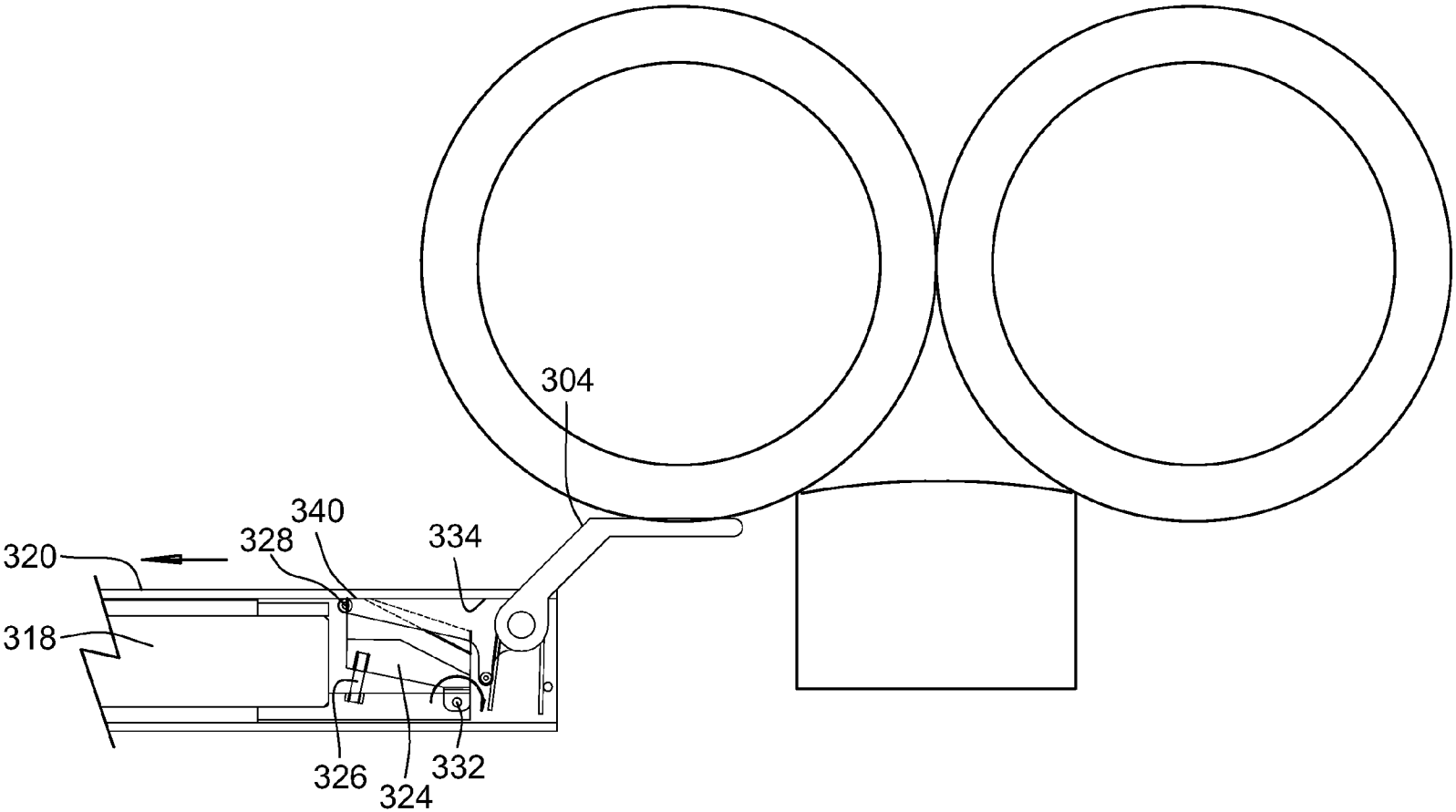
Figure 12H:
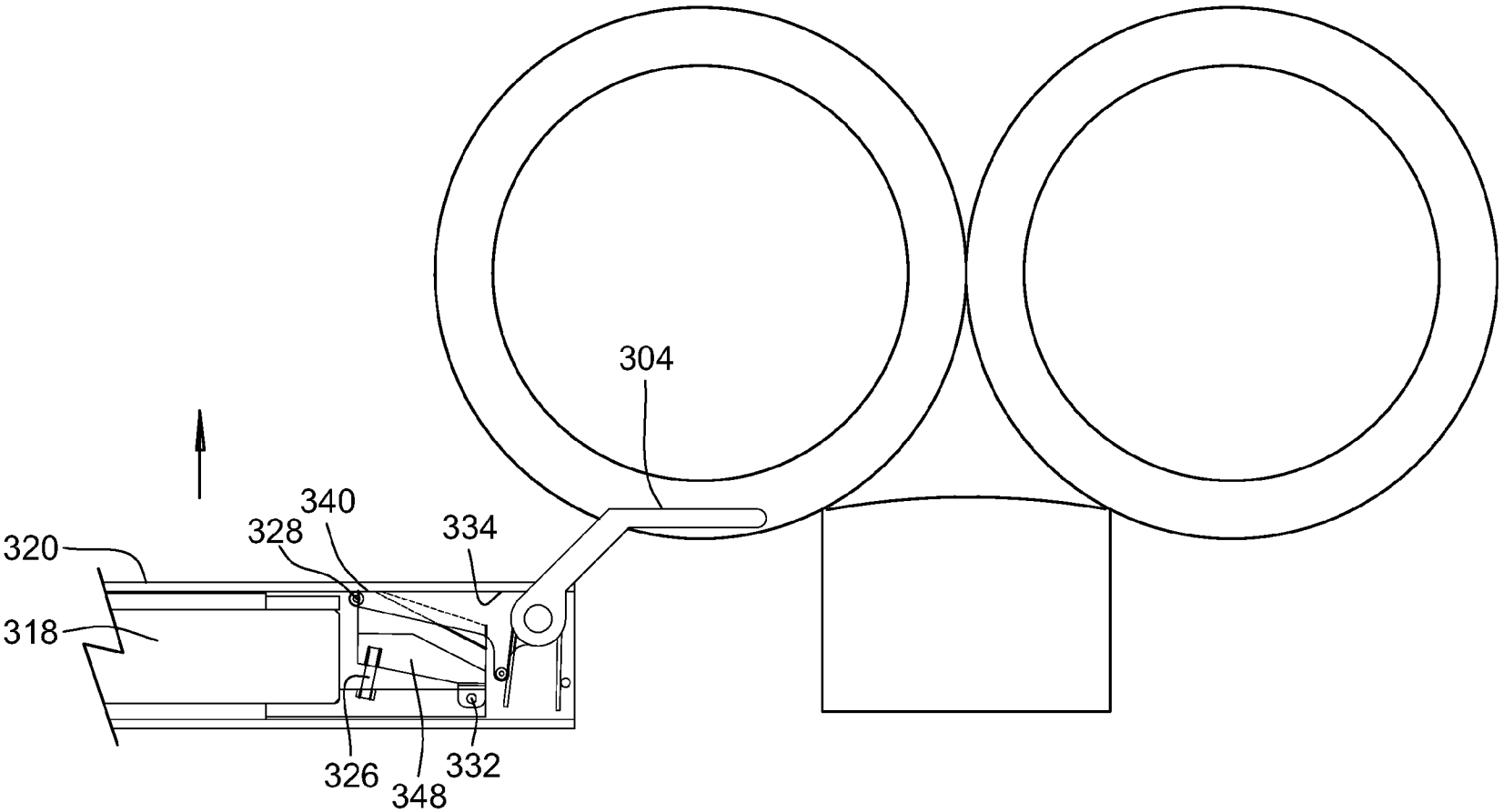

As shown in FIG. 12*f*, the cam 324 also includes an upper inclined cam surface 342 thereof, which intersects with the lower inclined cam surface 338 at the upper end of the lower inclined cam surface 338. As further shown in FIG. 12*f*, during operating periods wherein the cam follower 328 is in contact with the transversely extending surface 334 of the second member, the cam follower 328 comes into contact with a portion of the upper included cam surface 342 and bears against the cam 324 in a manner causing the cam 324 to pivot about the cam pivot 332 against the force of the cam return spring 326, so that the cam follower 328 may pass between the transversely extending surface 334 and the cam 324. As shown in FIGS. 12*a*, 12*g* and 12*h*, once the cam follower 328 has passed over the cam 324 and transversely beyond the upper end 340 of the lower inclined cam surface 338, the cam return spring 326 urges the cam 324 to rotate about the cam pivot 332 to thereby bring the upper end 340 of the lower inclined cam surface 338 back into contact with the transversely extending surface 334 of the second member 320.

As shown in FIG. 12*b*, once the cam 324 has been urged back into contact with the transversely extending surface 334, relative motion between the first and second members 318, 320 by action of the second actuator 308, will cause the cam follower to come into contact with the lower inclined surface 338 of the cam 324. As the cam follower 328 travels along the lower inclined cam surface 338, by virtue of further relative motion between the first and second members 318, 320, the count finger 304 is caused to pivot about the count finger axis 316, in the manner illustrated in FIGS. 12*b* and 12*c*, so that the count finger 304 can be positioned as illustrated in FIG. 12*c* within a circumferential groove 344 in the folding roll 346 in such a manner that the count finger 304 can be moved into a ready position to effect a count without interfering with the delivery of sheets along the sheet path 336.

As shown in FIG. 12*c*, when it is desired to actuate the count finger 304 to complete a pack and begin the next pack, the first and second members 318, 320 are moved relative to one another by the second actuator 308 to a relative position whereat the cam follower 328 moves beyond a lower end 348 of the lower inclined cam surface 338. Once the cam follower 328 moves beyond the lower end 348, the count finger return spring 330 will cause the count finger 304 to rapidly pivot about the count finger axis 316 in such a manner that the cam follower 328 is brought into contact with the transversely extending surface 334 of the second member, as shown in FIG. 12*d*, to thereby stop rotation of the count finger 304 in a position whereat the count finger 304 is again extending substantially perpendicularly to the sheet path 336.

It will be recognized, therefore, that by virtue of this arrangement, three degrees of motion are achieved for the count finger 304 through the use of only two actively controlled actuators 306, 308 in combination with the cam follower arrangement 322. Those having skill in the art will recognize that, in other embodiments of the invention, other actuating arrangements may be utilized within the scope of the invention.

Figure 13:
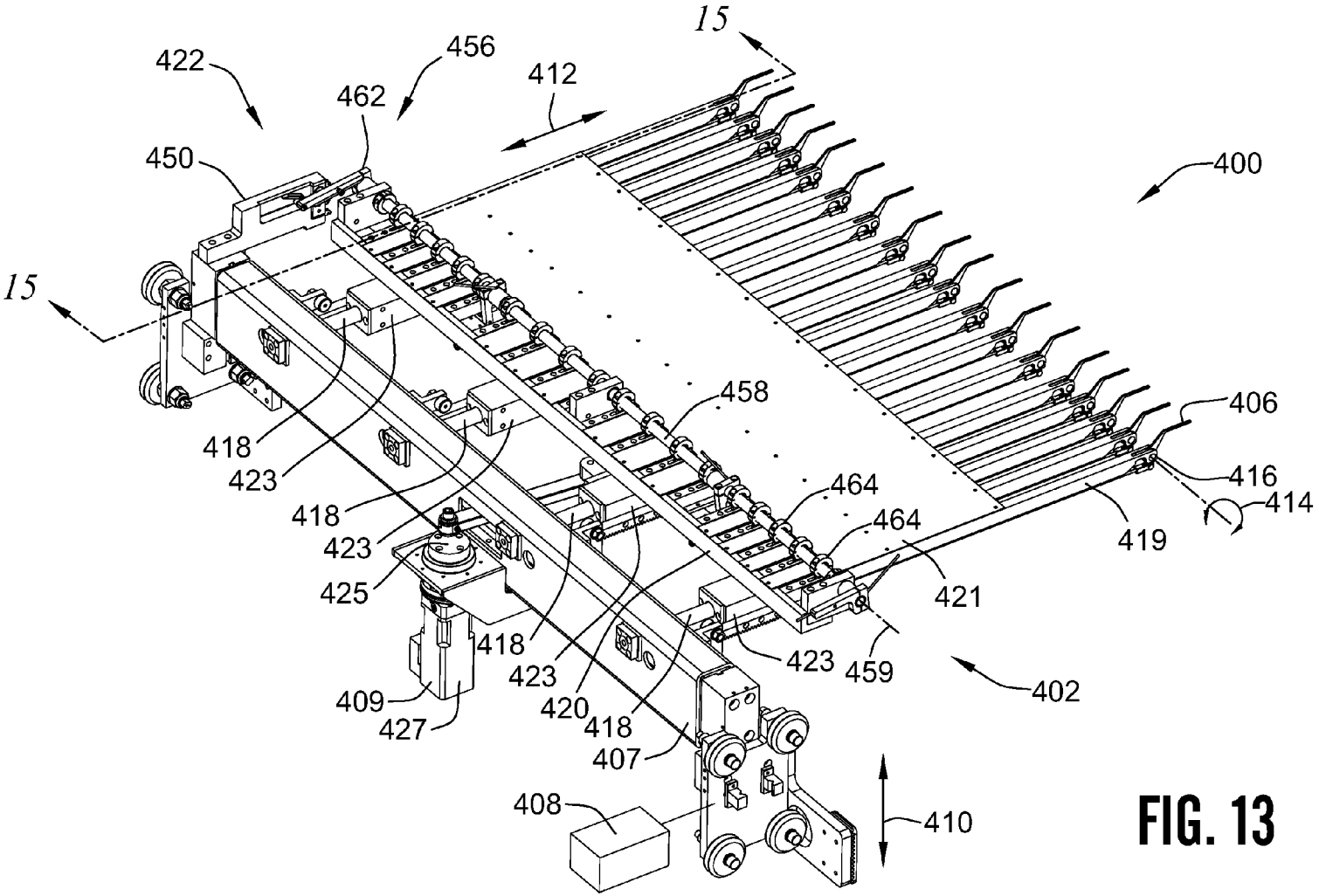
FIG. 13 is a perspective illustration of a count finger arm arrangement of a separator apparatus, according to the invention, in which a single cam-follower arrangement is utilized to actuate a plurality of count fingers, under active control of two actuators in a manner resulting in control of the position of the count fingers in three directions.

FIG. 13 is a perspective illustration of a count-finger arm arrangement 402 of a fourth exemplary embodiment of a separator apparatus 400, according to the invention. The exemplary embodiment of the count-finger arm arrangement 402 shown in FIG. 13, and in more detail in FIGS. 14 and 15*a*-15*g*, is similar functionally to the count-finger arm arrangement 302 described above, in that only two actively controlled actuators 406, 408 are needed to control position and movement of the count fingers 406 in a longitudinal direction 410, a transverse direction 412, and rotational motion of the count fingers 406 about the count finger axis 416, as indicated by arrow 414 in FIG. 13. In the exemplary embodiment of the count-finger arm arrangement 402 shown in FIG. 13 a single cam-follower arrangement 422 is utilized to control the rotational motion 414 of a plurality (16 as illustrated in FIG. 13) of count fingers 406. This is in contrast to the approach shown in the exemplary embodiment of the count finger arm arrangement 302 described above, wherein a separate cam-follower arrangement 322 was provided for controlling rotational motion 314 of each of the plurality of count fingers 304.

Figure 14:
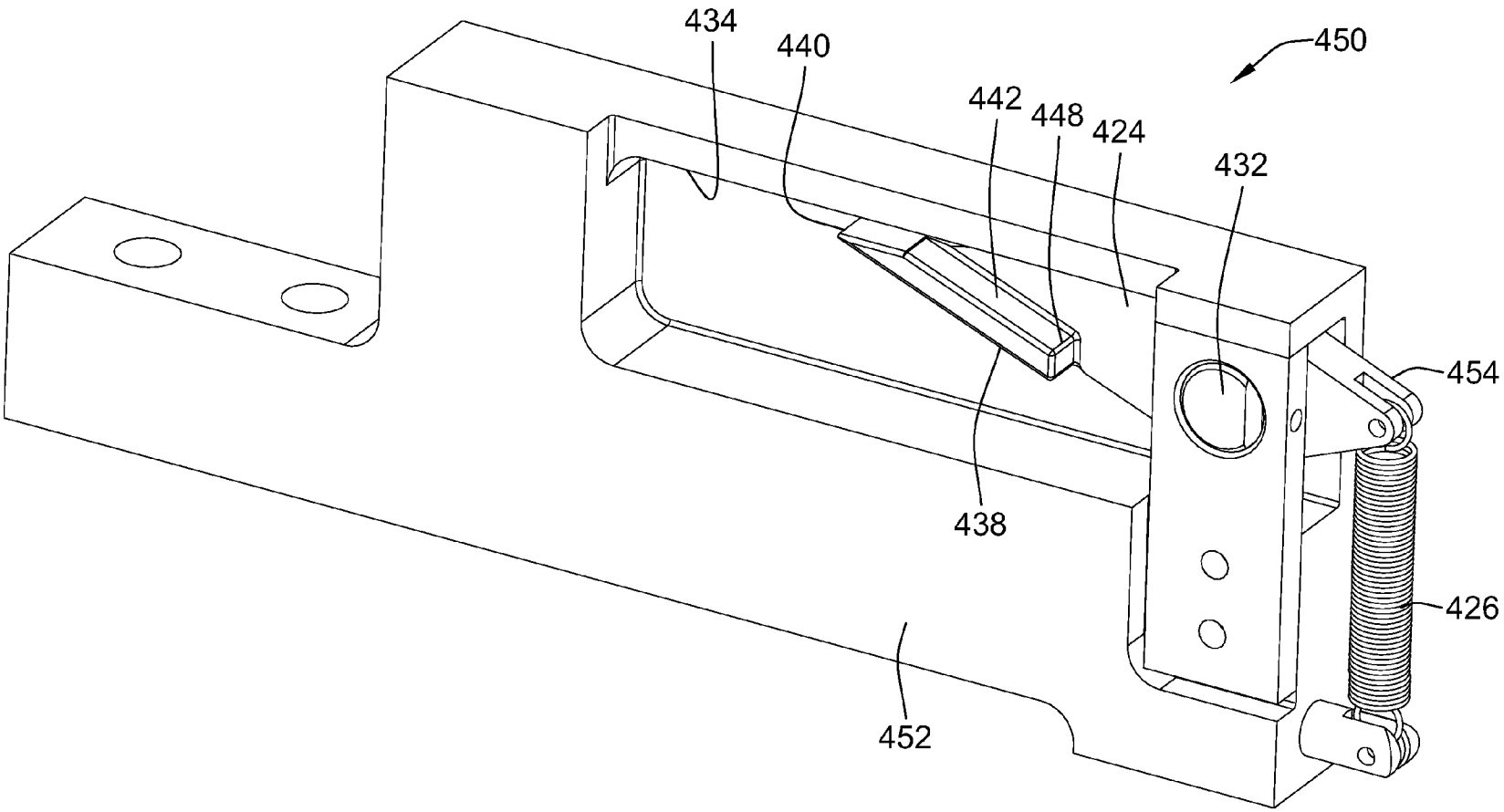
FIG. 14 is a perspective illustration of a cam arrangement of the count finger arrangement shown in FIG. 13.

As shown in FIGS. 13 and 14, the exemplary embodiment of the count finger arm arrangement 402 includes a plurality of first members 418, in the form of support bars fixedly attached at a proximal end thereof to the count finger support carriage 407. As further indicated in FIG. 13, the count finger carriage 407 is supported at opposite ends thereof by a bearing arrangement in a pair of longitudinally oriented guide rails (not shown). The count finger carriage 407 is also operatively connected to a first actuator 408 for moving and positioning the count finger carriage 407 and the first members 418 along the longitudinal direction indicated by arrows 410.

Figure 15A:
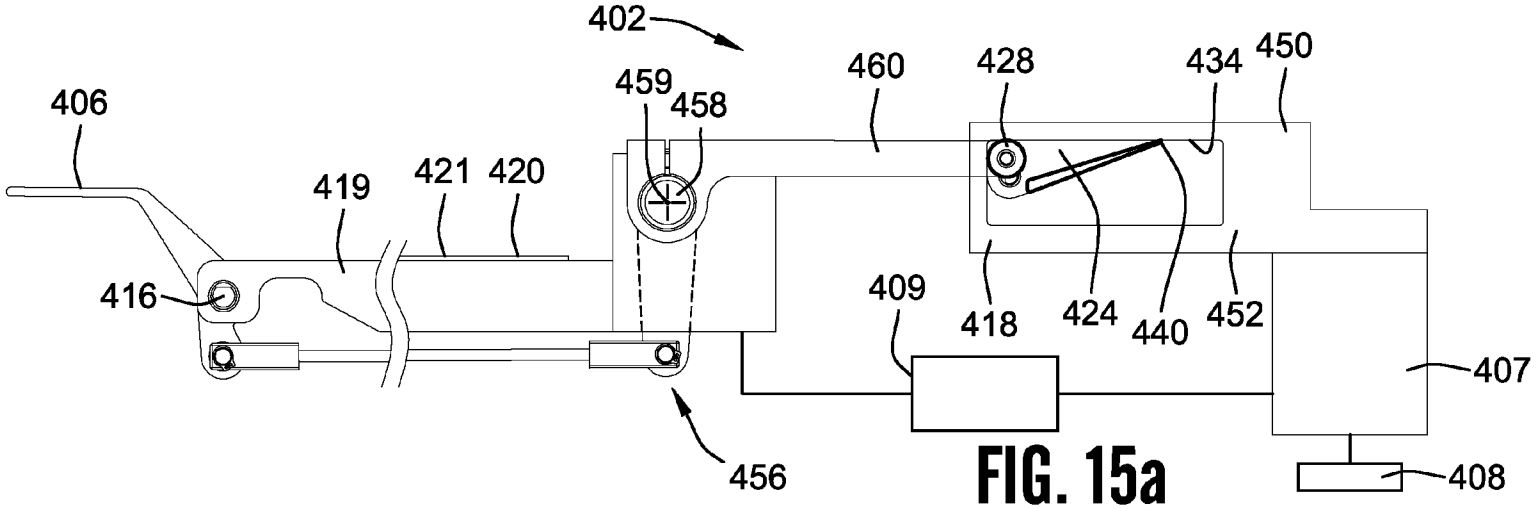
FIGS. 15*a*-15*g* are schematic cross-sectional illustrations taken along the line 15-15 in FIG. 13, illustrating details of the construction and operation of the exemplary embodiment of the count finger arm arrangement shown in FIG. 13.
Figure 15B:
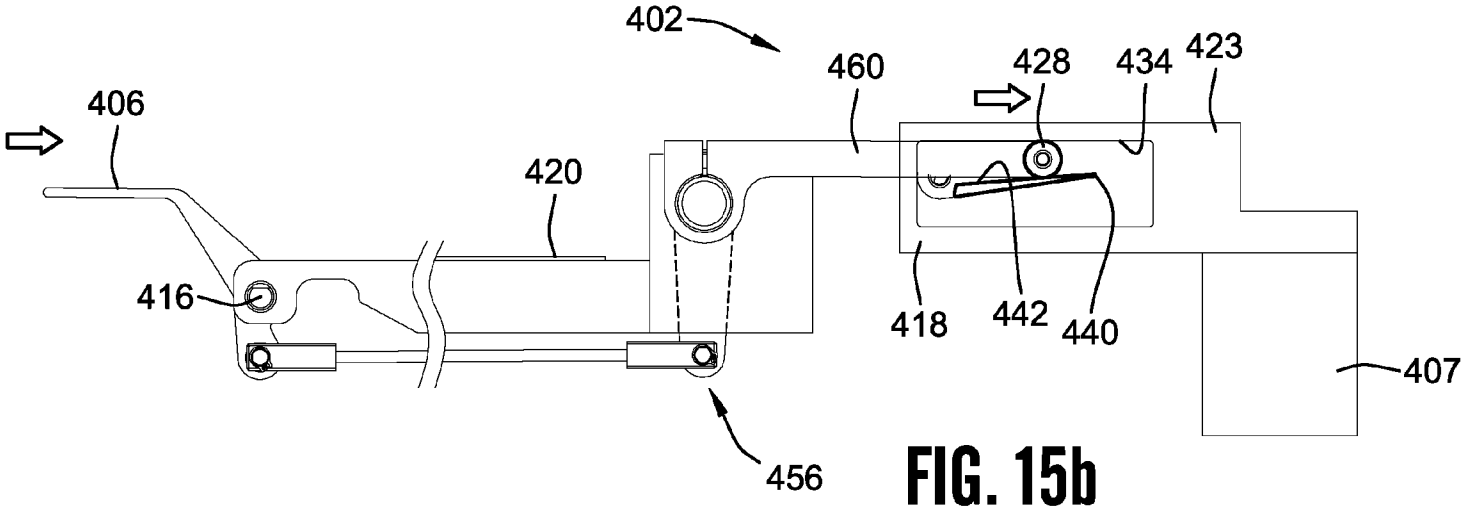
Figure 15C:
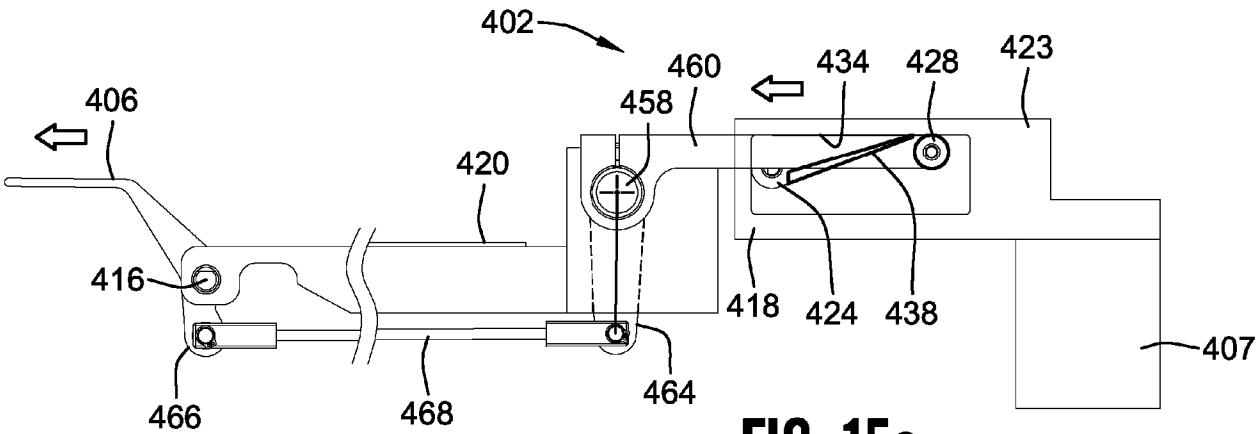
Figure 15D:
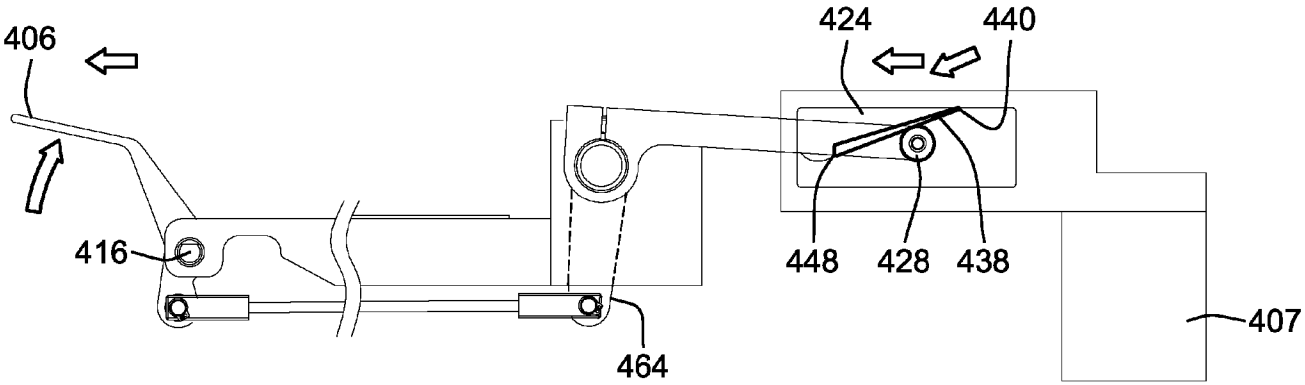
Figure 15E:
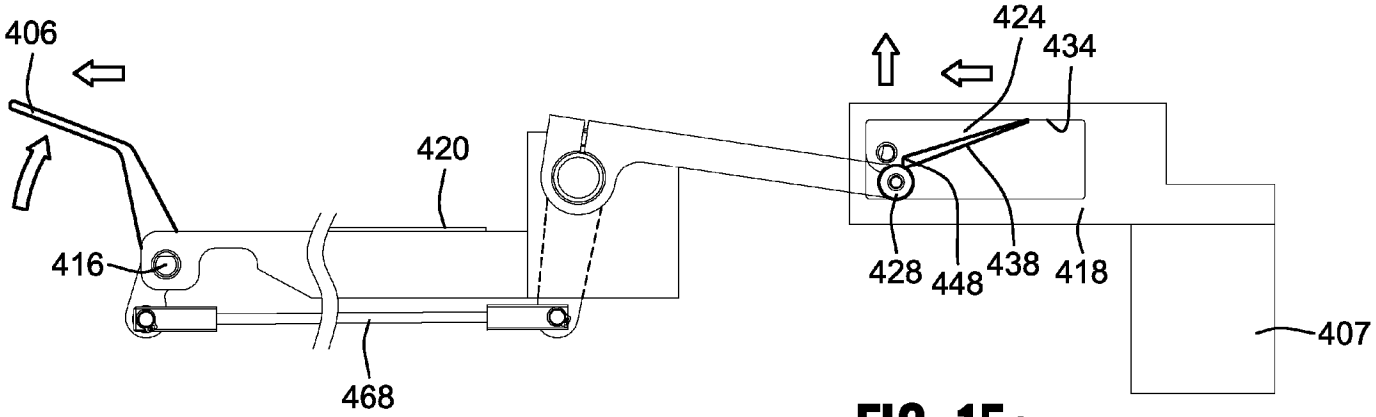

As further shown in FIGS. 13 and 15*a*, a second member 420 of the count finger arrangement 402 includes a plurality of count finger arms 419 connected together by a common plate 421 with the second member 420 also having a plurality of bearing blocks 423 which slidingly connect the second member 420 for transverse movement 412 along the first members 418. The count finger arms 419 each support a respective count finger 406 for pivoting movement about a count finger axis 416 of each of the count fingers 406, with the arms 419 being further configured to align the count finger axes 416 of all of the plurality of count fingers 406 with one another.

As further indicated in FIG. 13, the first and second members 418, 420 are operatively connected by a second actuator arrangement 409 having an eccentric arrangement 425 operatively connecting a motor 427 of the second actuator between the first and second members 418, 420 in such a manner that controlled rotation of the motor 427 is transmitted through the eccentric arrangement 425 to move the second member 420 transversely with respect to the first members 418 and the count finger carriage 407.

As shown in FIG. 14, the cam-follower arrangement 422 includes a cam arrangement 450 having a cam 424 and a cam return spring 426 operatively mounted in a cam housing 452. As further indicated in FIG. 14, the cam 424 is operatively mounted in the cam housing 452 for pivoting movement about the cam pivot 432. In the exemplary embodiment shown in FIG. 14, the cam 424 has an return spring extension 454 thereof extending from the cam 424 on a side opposite the pivot 432 from upper and lower inclined cam surfaces 442, 438 of the cam 424. An extension spring 426 is operatively connected between the cam housing 452 and the lug 454 in such a manner that an upper end 440 of the lower inclined surface 438 of the cam 424 is urged toward a transversely extending surface 434 of the cam housing 452. Because the cam housing 452 is fixedly attached to the count finger carriage 407, and thereby also fixedly attached to the first members 418, it will be understood that the transversely extending surface 434 of the cam housing 452 functionally constitutes a transversely extending surface of the first member 418 of the count finger arm arrangement 402.

As further indicated in FIG. 14, the upper inclined cam surface 442 also defines a lower end 448 thereof, which is spaced apart from the cam housing 452 and the cam pivot 432 a sufficient distance to allow the cam follower 428 (see FIGS. 15*a*-15*g*) to pass between the lower end 448 of the upper inclined cam surface 442 and the cam housing 452, in a manner described in more detail below with reference to FIGS. 15*a*-15*g*.

The cam follower arrangement 422 of the count finger arm arrangement 402 also includes a rock shaft and linkage arrangement 456, which operatively connects the cam follower 428 to the count fingers 406. As shown in FIGS. 13 and 15*a*-15*g*, the rock shaft and linkage arrangement 456 includes a rock shaft 458, which is operatively mounted to the second member 420 for rotational movement about a rock shaft axis (not shown) oriented substantially parallel to the common count finger axis 416. The rock shaft and linkage arrangement 456 also includes an input arm 460 having a proximal end thereof clamped onto the rock shaft 458 in such a manner that movement of the input arm 460 about the rock shaft 458 imparts rotation to the rock shaft 458 about the rock shaft axis 459. The cam follower 428 is operatively mounted to the distal end of the input arm 460 in such a manner that contact of the cam follower with either of the transversely extending surface 434 of the cam housing 452 or contact of the cam follower 428 with the lower inclined cam surface 442 of the cam 424 will control the rotational position and movement of the input arm 460 about the rock shaft axis 459. As shown in FIG. 13, the rock shaft and linkage arrangement 456 also includes a torsion spring 462 operatively connected between the input arm 460 and the second member 420 of the count finger arm arrangement 402 to urge movement of the distal end of the input arm 460 toward the transversely extending surface 434 of the cam housing 452 (i.e. counter-clockwise about the rock shaft axis as shown in FIG. 15*a*).

The rock shaft and linkage arrangement 456 also includes a plurality of output arms 464 having a proximal end fixedly attached to the rock shaft 458 in such a manner that pivoting motion of the rock shaft 458 about the rock shaft axis 459 imparted by angular motion of the input arm 460 about the rock shaft axis 459 is translated into pivoting motion of the distal end of the out arms 464 about the rock shaft axis 459 in proportion to the relative lengths of the input and output arms 460, 464. As shown in FIG. 13, whereas only one input arm 460 is utilized in the exemplary embodiment of the count finger arm arrangement 402, a separate output arm 464 is provided for each one of the count fingers 406.

As indicated in FIGS. 15*a*-15*g*, the distal ends of each of the output arms 464 is operatively connected to the distal end of an input lug 466 extending substantially oppositely from the count finger 406 with respect to the count finger axis 416 by a transfer rod 468 of the rock shaft and linkage arrangement 456. The opposite ends of the transfer rod 468 are pivotably attached to the distal ends of the output arm 464 and input lug 466 associated with each respective one of the count fingers 406. By virtue of this arrangement, it will be seen that movement of the cam follower 428 along a path defined by the transversely extending surface 434 of the cam housing 452 or along the lower inclined surface 438 of the cam 424 will be transmitted through the various components of the rock shaft and linkage arrangement 456 into a pivoting motion of the count finger 406 about the count finger axis 416.

Figure 15F:
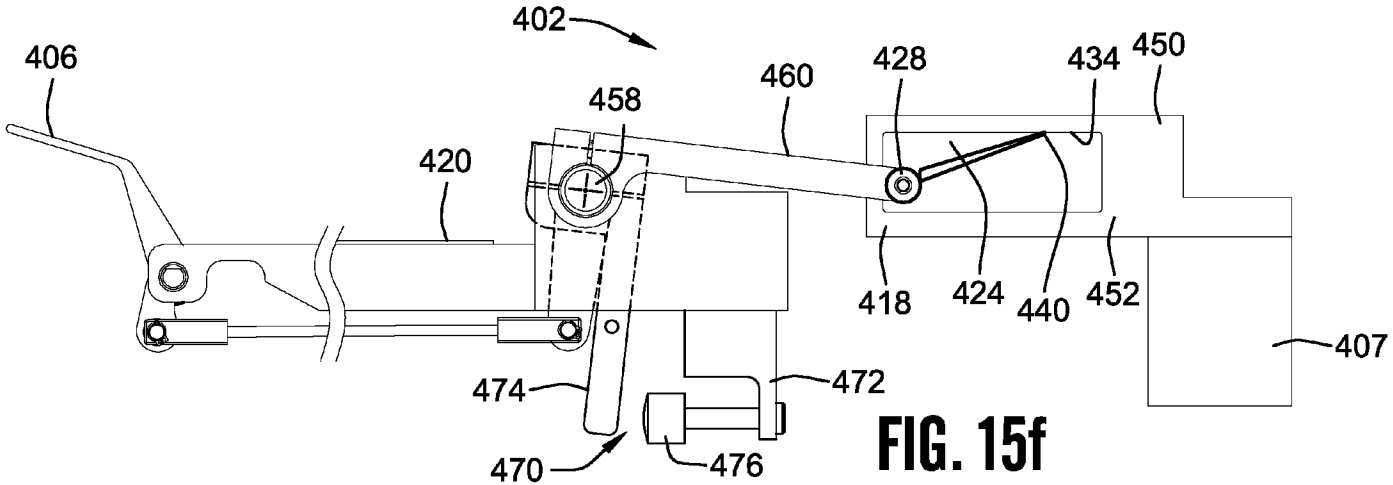
Figure 15G:
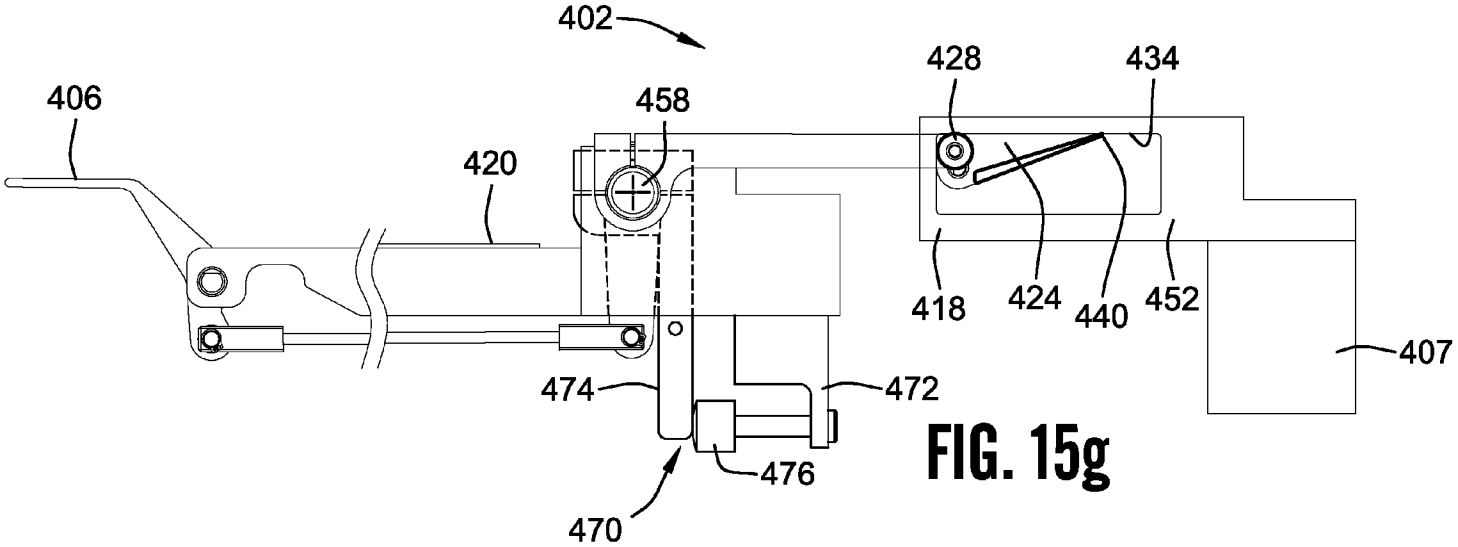

As shown in FIGS. 15*f* and 15*g*, in some forms of the invention it may be desirable to add a stop arrangement 470 to preclude impact of the cam follower 428 against the transversely extending surface 434 of the cam housing 452. In the embodiment disclosed in FIGS. 15*f* and 15*g*, the stop arrangement includes an adjustable bumper stop 472 and a stop arm 474. The stop arm has a proximal end thereof clamped to the rock shaft 458 for pivotal movement therewith.

The bumper stop 472 can take a variety of forms, but as illustrated in FIGS. 15*f* and 15*g* includes a resilient bumper element 476 which is mounted upon the second member 420 of the count finger arm arrangement 402.

The stop arm 474 and adjustable bumper stop 472 are configured and attached to the rock shaft 458 and second member 420 in such a manner that the distal end of the stop arrangement 470 will contact the bumper element 476 just prior to the cam follower 428 coming into contact with the transversely extending surface 434 of the cam housing 452, when the cam follower 428 moves from the position indicated in FIG. 15*f* to the position indicating in FIG. 15*g* to affect pivoting motion of the count finger 406 from the raised position shown in FIG. 15*f* to the substantially horizontally extending position shown in FIG. 15*g*. In the embodiment shown in FIGS. 15*f* and 15*g*, the stop arrangement will hold the cam follower 428 in a position just off the transversely extending surface 434, along a line of motion extending parallel to the transversely extending surface 434 as the cam follower 428 moves transversely outward in the manner shown. Sequentially in FIGS. 15*a*-15*c*. Once the cam follower 428 clears the upper (pointed) end 440 of the lower inclined surface 438 of the cam 434, and begins moving back transversely inward, operation of the embodiment shown in FIGS. 15*f* and 15*g* having the stop arrangement 470 is the same as described above in relation to FIGS. 15*d* and 15*e*.

It will be further appreciated, that the arrangements described above with regard to FIGS. 13, 14 and 15*a*-15*g* allow the count fingers 406 to deflect in an upper direction, in the manner illustrated in FIG. 15*e* to clear a jam or other obstruction bearing on the lower surface of the count fingers 406.

Figure 16:
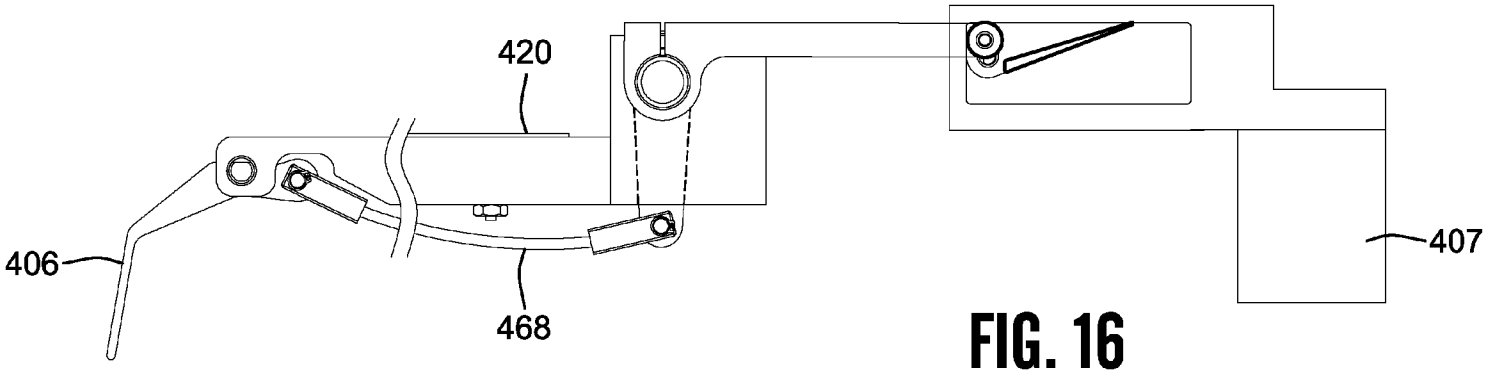
FIG. 16 is a schematic illustration of the exemplary embodiment of the count finger arrangement shown in FIGS. 13, and 15*a*-15*g*, including an elastically bendable link element which allows the count fingers to deflect and automatically return to their operating position to clear an overload, interference or jam.

As shown in FIG. 16, in some embodiments of the invention, the transfer rod 468 is fabricated in an appropriate manner or from a resilient material, such as metal, composite, or a pull-truded composite, which will allow the transfer rod 468 to elastically buckle in such a manner that an overload, due to a jam for example, applied on the upper surface of the count fingers 406 will cause the count fingers 406 to rotate downward about the count finger axes 416 for clearing the jam or overload. Once the jam or overload is cleared, the elastic nature of the transfer rods 406 will cause the count fingers to snap back to the position they held prior to encountering the jam or overload. Those having skill in the art will recognize that a stop arrangement, according to the invention, such as the one described above with reference to FIGS. 15*f* and 15*g*, also may be utilized with efficacy in embodiments of the invention, such as the embodiment shown in FIG. 16, where the transfer rod 468 is formed in such a manner that it can flex elastically.

Figure 17C:
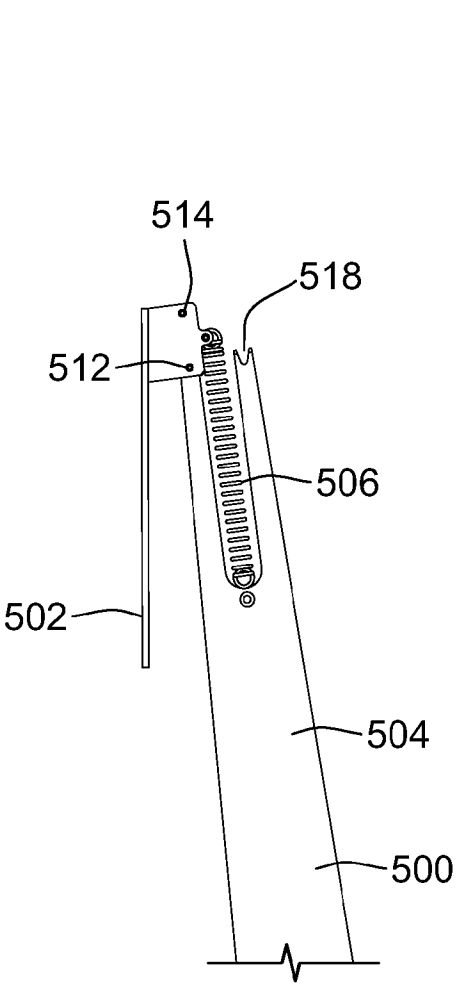
FIGS. 17*a*-17*c* illustrate the construction and operation of a separator finger arrangement, according to the invention, which allows the separator finger to deflect in either direction from an operating position to automatically clear an overload or obstruction and then return automatically to the operating position of the separator finger.
Figure 17B:
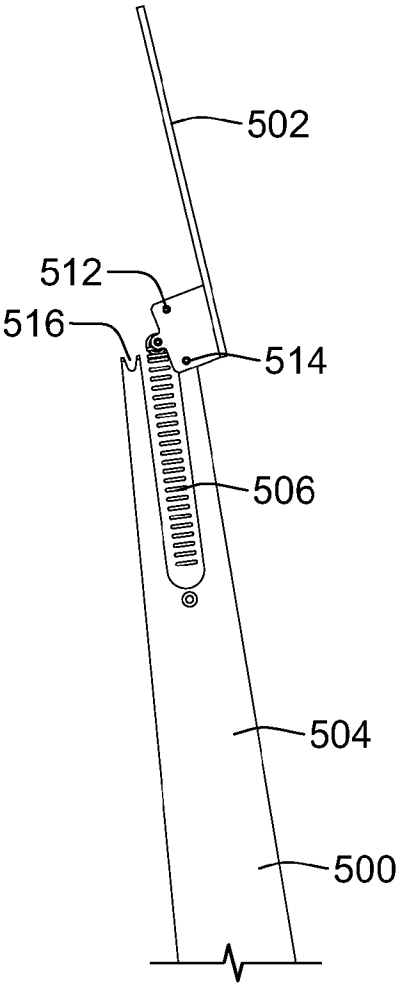
Figure 17A:
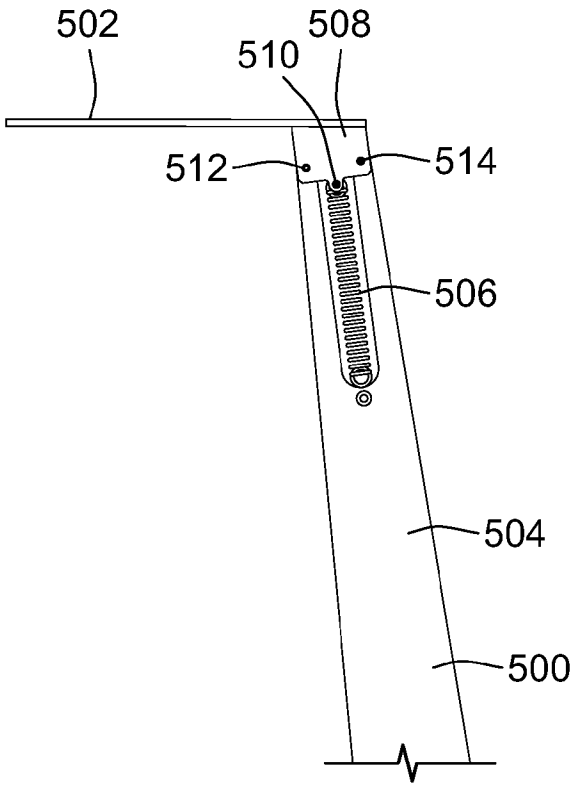

In addition to having the count fingers in a separator apparatus according to the invention be deflectable from their operating positions to clear an overload or jam, it is also desirable that some or all of the build and strip fingers also be deflectable from their operating positions in order to clear an overload or jam. FIGS. 17*a*-17*c* illustrate the construction and operation of a build finger arrangement 500, according to the invention having a finger 502 which is deflectable and automatically resettable in either direction from a normal operating position, as shown in FIG. 17*a*.

As shown in FIG. 17*a*, the build finger arrangement 500 includes an arm 504 for supporting the finger 502, and an extension spring arrangement 506 for operatively connecting the finger 502 to the arm 504. The proximal end of the arm 502 includes a bracket 508 having a spring attachment point 510 disposed between first and second support pins 512 and 514.

As indicated in FIG. 17*b*, the distal end of the arm 504 includes a first notch for receipt therein of the first pin 512 when the finger 502 is in its operating position as shown in FIG. 17*a*. In similar fashion, the distal end of the arm 504 also includes a second notch 518 disposed to receive the second pin 514 therein when the finger 502 is disposed in the operating position shown in FIG. 17*a*.

As shown in FIG. 17*c*, if an overload is applied on an upper surface of the finger 502, the finger 502 pivots about the first pin 512 and the first notch 516, to clear the overload, and then the spring 506 pulls the finger 502 back to the operating position shown in FIG. 17*a*. In similar fashion, if the lower surface of the finger 502 encounters an obstruction or overload, the finger 502 pivots about the second pin 514 in the second notch 518 to clear the overload or jam. Once the jam overload is cleared, the spring 506 pulls the finger 502 back into the operating position illustrated in FIG. 17*a*.

It will be noted, as illustrated in FIG. 1, that the arrangement illustrated in FIGS. 17*a*-17*c* can be applied in practicing the invention to arms extending either substantially vertically, substantially horizontally, or in oblique directions from the normal operating position of the finger attached to the arm.

It will be understood, therefore, that in some embodiments of the invention, all of the separator fingers may be constructed and operated in a manner which allows them to automatically deflect and then return to their normal operating positions to deal with overloads, obstructions or jams within the machine.

As shown in FIG. 7*a*, in some embodiments of the invention, it is desirable to have the conveyor arrangement 126 be operatively configured and attached to the remainder of the separator apparatus 100, in such a manner that the conveyor arrangement 126 can be shifted sideways away from the sheet path 136, to a clearing position as indicated in dashed lines at 180. In this manner, when it is necessary to clear an obstruction or jam from the separator apparatus 100, or during start-up and shut-down of the apparatus, the packs (either complete or incomplete) can be allowed to simply drop free of the build fingers into a waste receptacle positioned below the conveyor arrangement 126.

With regard to the second exemplary embodiment of the separator apparatus 200 described above, it is contemplated that some embodiments of the invention may utilize six carriages for operatively connecting the separator fingers, rather than the five carriages utilized in the first exemplary embodiment of the separator apparatus 100.

It will be understood that, although all exemplary embodiments presented and described above in relation to FIGS. 1-16 include count fingers 104, 106, 204, 206, 304, 406 which are configured and operatively connected for pivotable motion about respective count finger axes, other embodiments of the invention may comprise methods and apparatuses which do not utilize pivoting count fingers. It will be expressly understood that the invention may be practiced with efficacy in embodiments not having pivotable count fingers by moving non-pivoting count fingers, that are configured to extend substantially perpendicularly to the sheet path, transversely in and out with respect to the sheet path and longitudinally along the sheet path in substantially the same manner described hereinabove for embodiments having pivoting count fingers, or in any other non-pivoting process or arrangement within the scope of the invention.

It will also be understood, that embodiments of the invention having pivotable count fingers may be operated without pivoting motion of the count fingers by locking the pivotable count fingers against rotation about their pivot axes with the pivot fingers extending substantially perpendicular to the sheet path. In an embodiment such as the one shown in FIG. 15*a*, for example, the input arm 460 may be removed and the rock shaft 458 locked against rotation about the rock shaft axis 459 with the count finger 406 extending in the substantially horizontal position shown in FIG. 15*a*. With the rock shaft 458 locked against rotation, the fourth exemplary embodiment of the separator apparatus 400 may be otherwise operated in accordance with the detailed description above, without pivoting motion of the count finger 406 about the count finger pivot axis 416. It will be further noted, however, that even with the input arm 460 removed and the rock shaft 458 secured against rotation, the count fingers 406 of the fourth exemplary embodiment of the separator apparatus 400 may still deflect to clear a jam or obstruction in the manner shown in FIG. 16.

As a further example of an embodiment not having pivotable count fingers, those having skill in the art will also recognize that the invention may be practiced with efficacy in embodiments, such as a variation of the fourth exemplary embodiment 400, in which the count fingers 406 are rigidly attached to, or formed by an extension of the count finger arms 419 of the fourth exemplary embodiment 400 of a separator apparatus according to the invention. It will be yet further understood that the scope of embodiments of the invention not having pivotable count fingers is not limited to the variation of the exemplary embodiment 400 described above, but is intended to encompass any appropriate embodiment within the scope of the invention of the invention that does not include pivotable count fingers.

Figure 18:
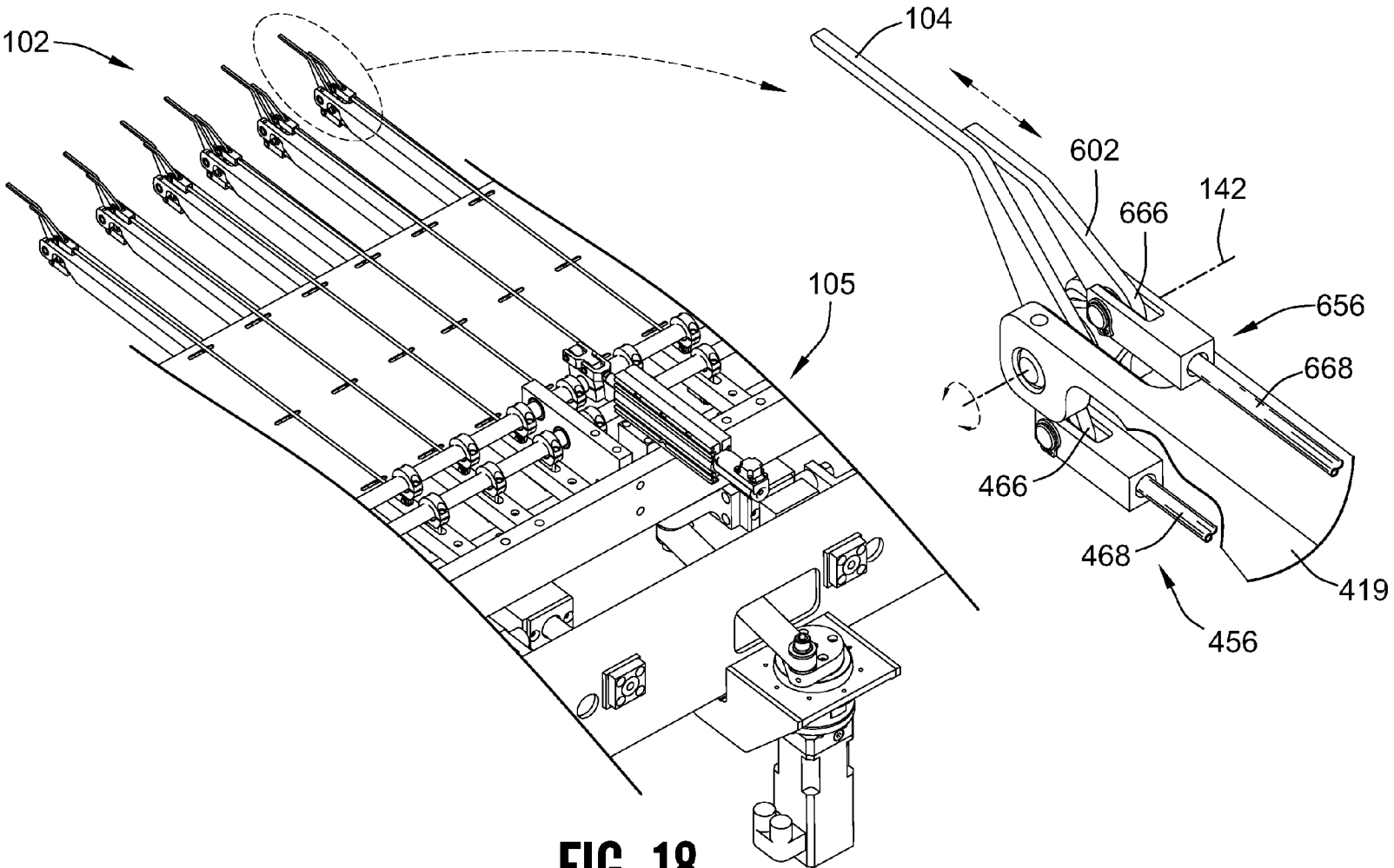
FIG. 18 is a perspective view of another exemplary embodiment of a separator incorporating a knock down finger.
Figure 19A:
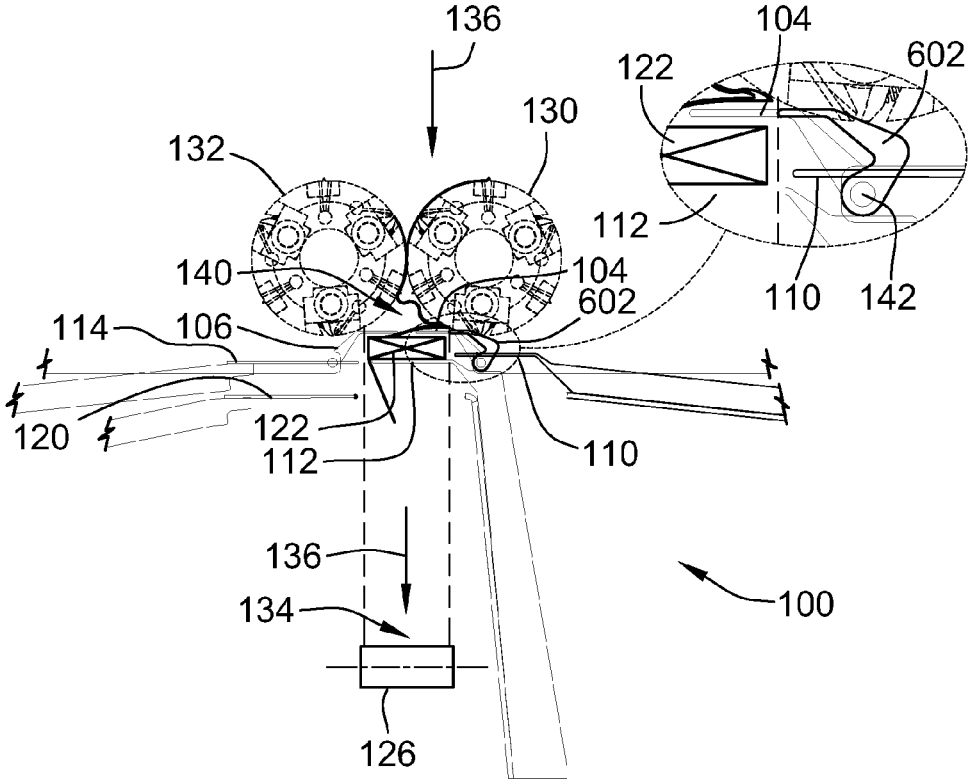
FIGS. 19*a*-19*g* are successive schematic illustrations depicting operation of an exemplary embodiment of the invention that incorporates a knock down finger.

The exemplary embodiment of the separator apparatus 100 shown in FIGS. 18 and 19*a*-18*g* is essentially the same as that shown in the preceding figures and as described above, with the exception that the separator apparatus of FIGS. 18 and 19*a*-19*g* also includes a plurality of knock down fingers 602. Accordingly, the same reference numerals used in the description relating to the previously discussed embodiments will be used, wherever possible, in the following description of the embodiment shown in FIGS. 18 and 19*a*-18*g*.

As will be more fully understood from the following description and inspection of FIGS. 18 and 19*a*-18*g*, the knock down fingers 602 advantageously ensure that a consistent separation is achieved between adjacent packs, e.g. the completed pack 122 and the next pack 124.

More specifically, and with reference now to FIG. 18, an embodiment of the separator 100 is illustrated incorporating the aforementioned knock down fingers 602. As illustrated, the knock down fingers 602 are integrated with the count finger arrangement 102 and with the carriage 105 carrying the count finger arrangement 102. The mounting and operation of each count finger 104 is generally the same as that described above despite the inclusion of the knock down finger 602.

More particularly, each count finger 104 is mounted to the count finger arm 419 and is rotatable about the first count finger axis 142. Each count finger 104 is operatively connected at an input lug 466 to a linkage arrangement 456, and more specifically to a rock arm 468 of the linkage arrangement 456.

In a generally similar fashion, each knock down finger 602 is commonly mounted to the count finger arm 419, and is rotatable about the first count finger axis 142. Each knock down finger 602 includes an input lug 666 that is operatively connected to a linkage arrangement 656, and more specifically a rock arm 668 thereof, to rotate the knock down finger 602 about the first count finger axis 142.

As will be explained in greater detail below, the knock down finger 602 is thus mounted with the remainder of the count finger arrangement 102 for linear and rotational movement in a similar manner as described above relative to the count finger 104. Although illustrated as integrated with count finger 104 on carriage 105, it is recognized that the knock down finger 602 can be equally mounted in addition or in the alternative with count finger 106 on carriage 107, or may have an independent arm, linkage arrangement, and carriage from that described above.

Turning now to FIGS. 19*a*-19*g*, various stages of operation of the separator are illustrated which incorporate the knock down finger 602 as introduced above. With reference to FIG. 19*a*, a knock down finger 602 is mounted on the same carriage 105 as the right most count finger 104. It will be recognized that this embodiment of the separator 100 will incorporate a knock down finger 602 proximate each of the first count fingers 104 of the parallel array of count fingers 104 attached to the carriage 105 carrying the same, as illustrated above at FIG. 18.

The knock down finger 602 illustrated in FIGS. 19*a*-19*g* is pivotable about the first count finger axis 142 in a similar manner as the proximate count finger 104. As will be explained by the following, the knock down finger 602 rotates about the first count finger axis 142 during the separation process in order to maintain downward pressure upon the last panel 148 of the completed pack 122 as the completed pack 122 is moved downstream to create the space 146 between the completed pack 122 and the next pack 124. (see also FIG. 7*c*). As a result, the knock down finger 602 ensures that the space 146 is large enough to accommodate the proper insertion of the build fingers 110, 112 during the separation sequence.

Put differently, once the completed pack 122 has begun moving downstream with the respective last and first panels 148, 150 of the packs 122, 124 still interfolded, there is a risk that the first panel 150 will pull the last panel 148, as well as adjacent panels of the completed pack 122 upwardly along the sheet path 136 to such an extent that the build fingers 110, 112 will be inserted into the wrong fold, or deform one or several of the sheets between the packs 122, 124. As such, the knock down finger 602 "knocks down" the last panel 148 such that it, or any adjacent sheets of the completed pack 122, cannot move upwardly along the sheet path 136 beyond their expected locations.

Still referring to FIG. 19*a*, the first and second count fingers 104, 106 have been rotated and linearly inserted to form the completed pack 122 as described above, and the lower build finger 112 is supporting the completed pack 122 as it is built. The knock down finger 602 is illustrated in a retracted position. The knock down finger 602 may rotate and linearly translate with the count finger 104 as described above, or may remain in the retracted position as illustrated while the count finger 104 rotates and inserts.

As introduced above, the knock down finger 602 is mounted with the count finger 104 such that both fingers move generally together when the count finger 104 is inserted to form the completed pack. Also as illustrated at FIG. 19*a*, at top surface of the knock down finger 602 and a top surface of the count finger 104 are generally coplanar, such that insertion of the count finger 104 brings the knock down finger 602 in proximity to, or into, the same fold that the count finger 104 is inserted into. It will be recognized as well that this configuration gives the overall assembly incorporating the count finger 104 and knock down finger 602 a generally compact profile.

Figure 19B:
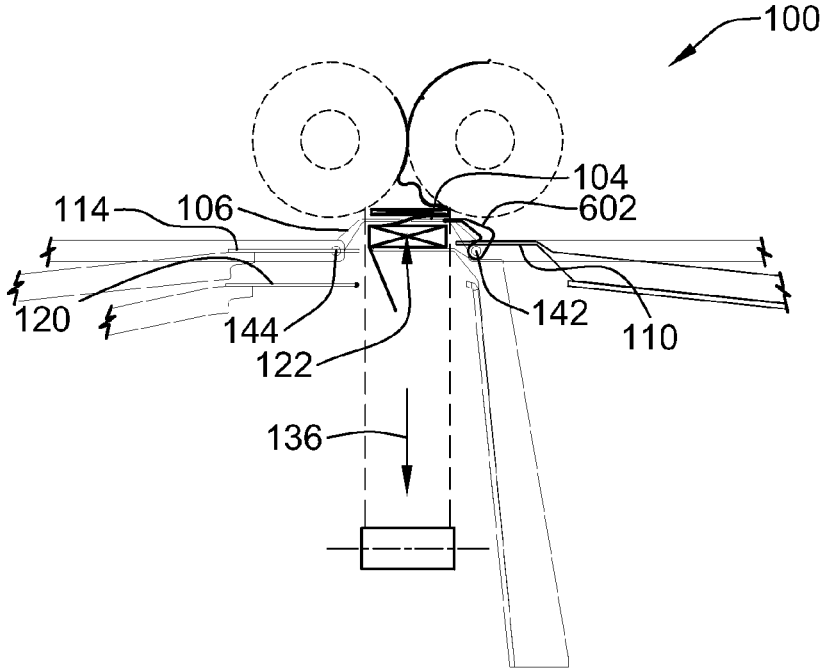

Turning now to FIG. 19*b*, the first and second count fingers 104, 106 and knock down finger 602 move linearly inward to position the knock down finger 602 generally above the last panel 148 of the completed pack 122. The first and second count finger 104, 106, knock down finger 602, and lower build finger 112 continue to move down along the sheet path 136 in unison, with the next pack 124 being build upon a top surface of the count fingers 104, 106.

Figure 19C:
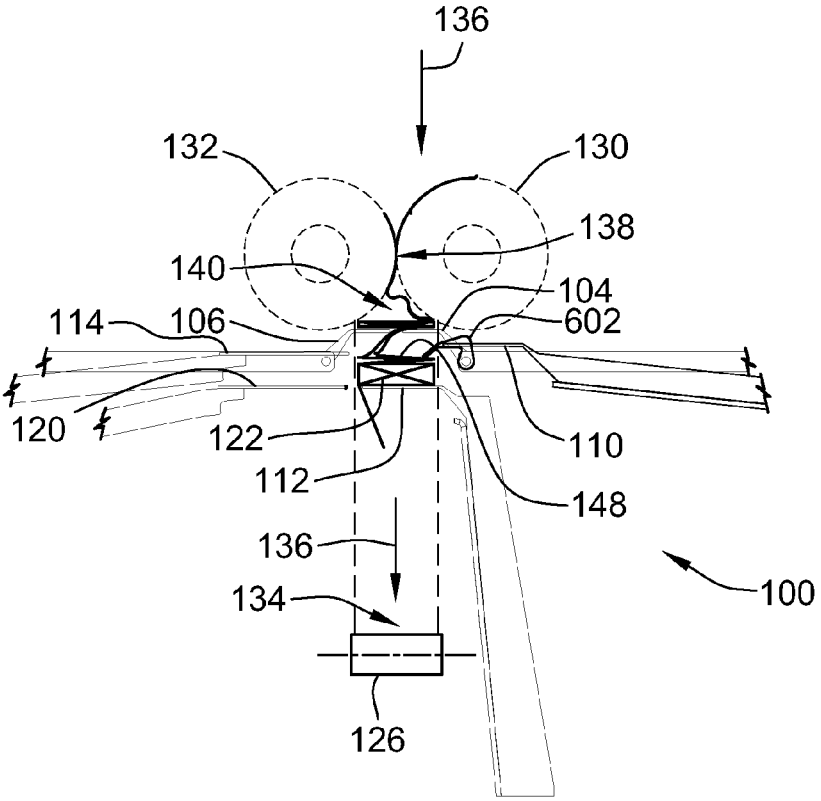

With reference to FIG. 19*c*, the lower build finger 112 then moves the completed pack 122 downstream along the sheet path 136 and away from the count fingers 104, 106. Simultaneously, the knock down finger 602 pivots about the first count finger axis 142 to contact the last panel 148 as illustrated. It will be recognized that the knock down finger 602 contacts the last panel 148 momentarily such that the next pack 124 may still be freely separated from the completed pack 122. Further, in certain embodiments, the last and first panels 148, 150 will freely move downstream with the completed pack 122 due to gravity such that the knock down finger 602 will not contact either panel 148, 150 during the operation described above. As such, the gap 146 (see FIG. 7*c*) directly upstream of the last and first panels 148, 150 can be made by gravity alone as these panels 148, 150 move downstream with the completed pack 122, or made by the knock down finger 602, or a combination thereof.

As illustrated, it will further be recognized that the knock down finger 602 pivots about the first count finger axis 142 to a position below that of the first and second count fingers 104, 106 between the completed pack 122 and the next pack 124. Put differently, the knock down finger 602 contacts the completed pack 122 at a location downstream from where the first and second count fingers 104, 106 contact the next pack 124.

Figure 19D:
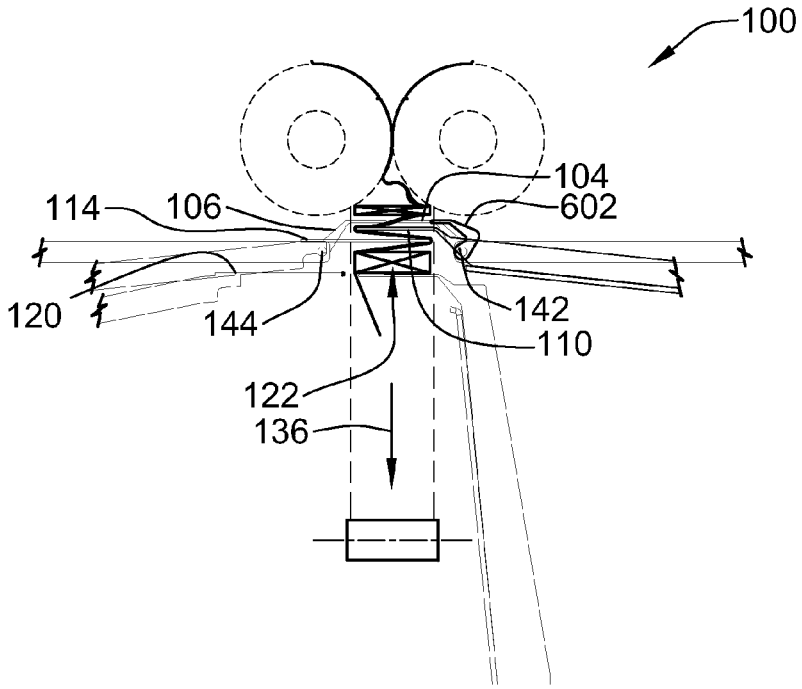

Still referring to FIG. 19*c*, the knock down finger 602 exerts a sufficient amount of downward pressure upon the last panel 148 such that the space 146 between completed pack 122 and next pack 124 can freely accommodate the insertion of the upper build finger 110 as illustrated at FIG. 19*d*. As the upper build finger 110 moves into the position illustrated in FIG. 19*d*, the knock down finger 602 retracts to its retracted position. Also as illustrated in FIG. 19*d*, the strip finger 114 has also been inserted in the same manner described above relative to FIGS. 7*a*-7*p*. The upper build finger 110 and strip finger 114 may be inserted simultaneously, or the upper build finger 110 may be inserted first, with the strip finger 114 inserted shortly thereafter. The same is true for cycles using the lower build finger 112 as opposed to the upper build finger 110.

Figure 19E:
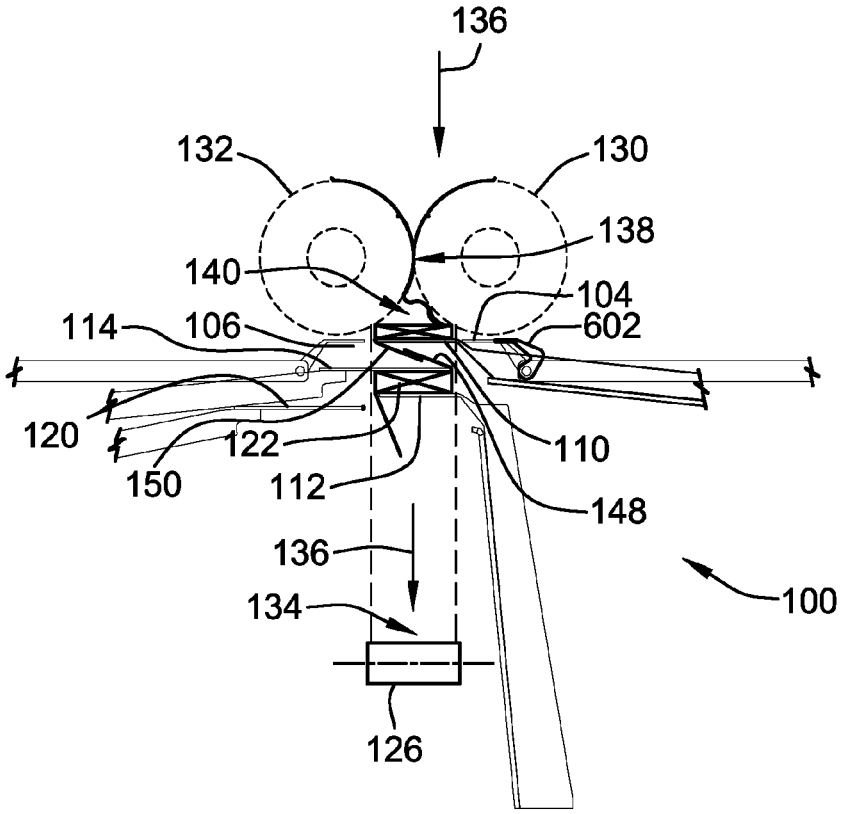

With reference to FIG. 19*e*, once the upper build finger 110 is inserted below the first and second count fingers 104, 106, the first and second count fingers 104, 106 and the knock down finger 602 move transversely outward from the sheet path 136 to transfer the partly completed next pack 124 to the upper build finger 110.

Figure 19F:
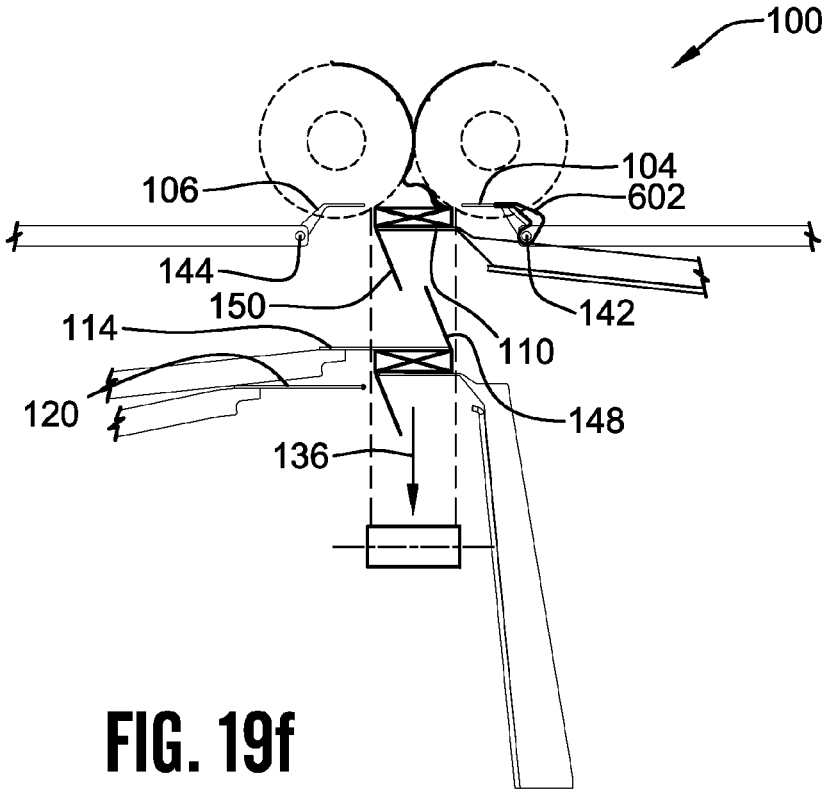

Turning now to FIG. 19*f*, the upper build finger 110 is illustrated supporting the next pack 124 as it is built. The first and second count fingers 104, 106 and the knock down finger 602 have also returned to their home position. The lower build finger 112 and the strip finger 114 compress the completed pack 122 and move it downward along the sheet path 136 to effectuate the separation of the completed pack 122 from the next pack 124 as illustrated. Also as illustrated at FIG. 19*f*, the first panel 152 and the last panel 148 of the completed pack 122 are out of contact with the lower build finger 112 and strip finger 114, respectively. Similarly, the first panel 150 of the next pack 124 is out of contact with the upper build finger 110.

Figure 19G:
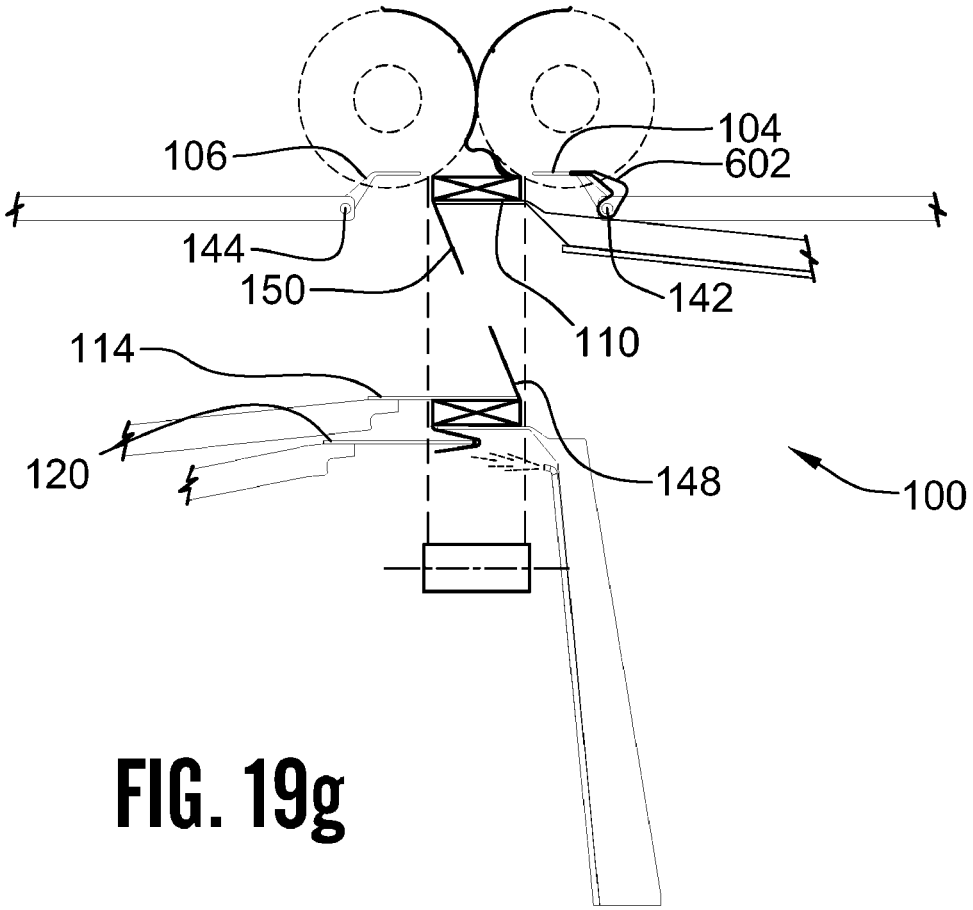
Figure 20:
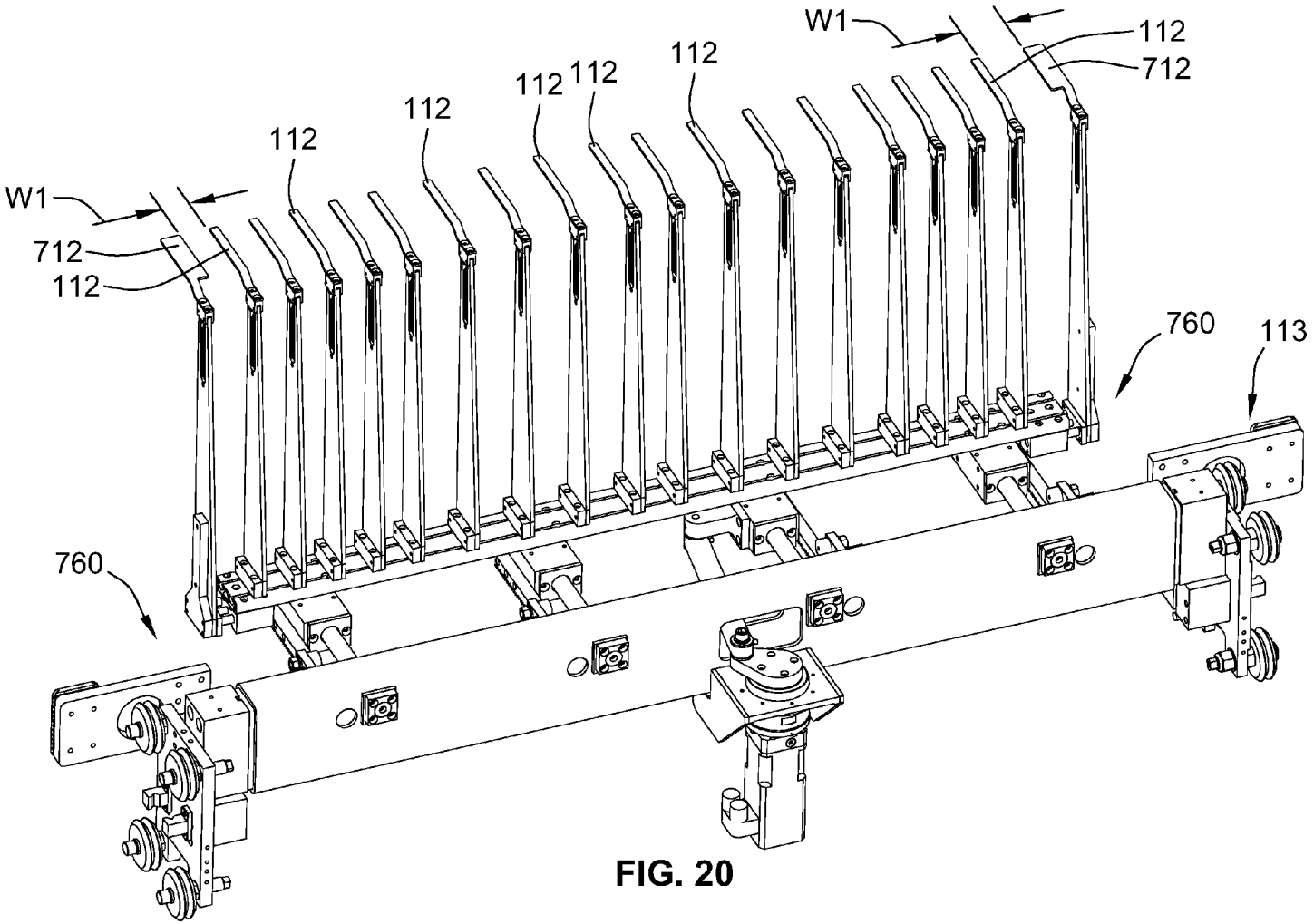
FIG. 20 is a perspective view of another embodiment of a build finger carriage incorporating extendable and retractable outer build fingers.

With reference now to FIG. 19*g*, once the completed pack 122 and next pack are separated, the fold finger 120 is inserted transversely to the feed path 136 downstream from the lower build finger 112 and approximately halfway across the same to contact the first panel 152 of the completed pack 122. As illustrated, a blast of air 156 is directed at the first panel 152 to fold it about the fold finger 120 as shown.

Once the first panel 152 of the completed pack 122 is folded, the completed pack 122 is moved by the strip finger 114 and lower build finger 112 to the conveying arrangement 126 below, and another cycle of separation begins. In a similar manner as described above relative to FIGS. 7*h*-7*p*, it will be recognized that in this next cycle, the upper build finger 110 will perform the operations of the lower build finger 112 described above relative to FIGS. 19*a*-19*g*, and vice versa. The knock down finger 602 will repeat its operation as described above to ensure consistent separation between packs.

Although illustrated as mounted to the carriage 105 carrying the first count finger 104, it will be recognized that the knock down finger 602, and more specifically the array of knock down fingers 602 may be independently mounted on their own carriage having its own axes of movement and rotation. Additionally, the knock down fingers 602 are not limited to the carriage 105 carrying the first count fingers 104, but may additionally or alternatively mounted to the carriage 107 carrying the second count fingers 106. Indeed, it will be recognized that the knock down fingers 602 can be incorporated into separator arrangements that operate upon even numbered stacks as described in FIGS. 7*a*-7*p*, or odd numbered stacks as described in FIGS. 10*a*-10*p*.

Further, the knock down finger 602 may be incorporated into other types of separator arrangements and is not necessarily limited to that illustrated in FIGS. 19*a*-19*g*. For non-limiting example, the knock down finger 602 can be incorporated into separator arrangements that forms adjacent packs of material horizontally as opposed to vertically. Still further, the knock down finger 602 can be incorporated into separator arrangements incorporating different interfolding configurations, such as four panel interfolded arrangements.

Turning now to FIGS. 20-25, the separator apparatus 100 shown is essentially the same as that shown in the preceding figures and described above, with the exception that the separator apparatus 100, and more particularly the carriage 113 carrying the second build fingers 112 includes outermost build fingers 712 that are extendible and retractable to vary a distance W1 between the outermost build fingers 712 and the next adjacent second build finger 112. Such a configuration ensures that each stack carried by the second build fingers 112, 712 supported along its entire length, as explained in greater detail below.

Indeed, with momentary reference to FIG. 5, each carriage 111, 113 contains the first and second build fingers 110, 112 in a linear arrangement. The first and second build fingers 110, 112 are arranged in an alternating fashion relative to one another such that they are interdigitated. As a result, one of the arrays of first and second build fingers 110, 112 is longer than the other, and will support the stack along a greater length thereof than the other one of the arrays of first and second build fingers 110, 112. Such an arrangement leaves the stack unsupported along a portion of both ends when the more interior one of the first and second arrays of build fingers 110, 112 is supporting the stack. As will be explained in greater detail in the following, to equalize the amount of support provided by each of the arrays of the first and second build fingers 110, 112, the carriage 113 carrying the second build fingers 112 includes the aforementioned extendible and retractable outermost build fingers 712.

Referring back to FIG. 20, the outer build fingers 712 have a larger overall width than the remaining second build fingers 112. The outer build fingers 712 are mounted to the carriage 113 in a similar or same manner as the remaining second build fingers 112 as described above, with the exception that the outer build fingers 712 are mechanically coupled to the carriage 113 by outer build finger drives 760. The outer build finger drives 760 are operable to vary the distance W1 between the outer build finger 712 and the next adjacent second build finger 112.

Figure 21:
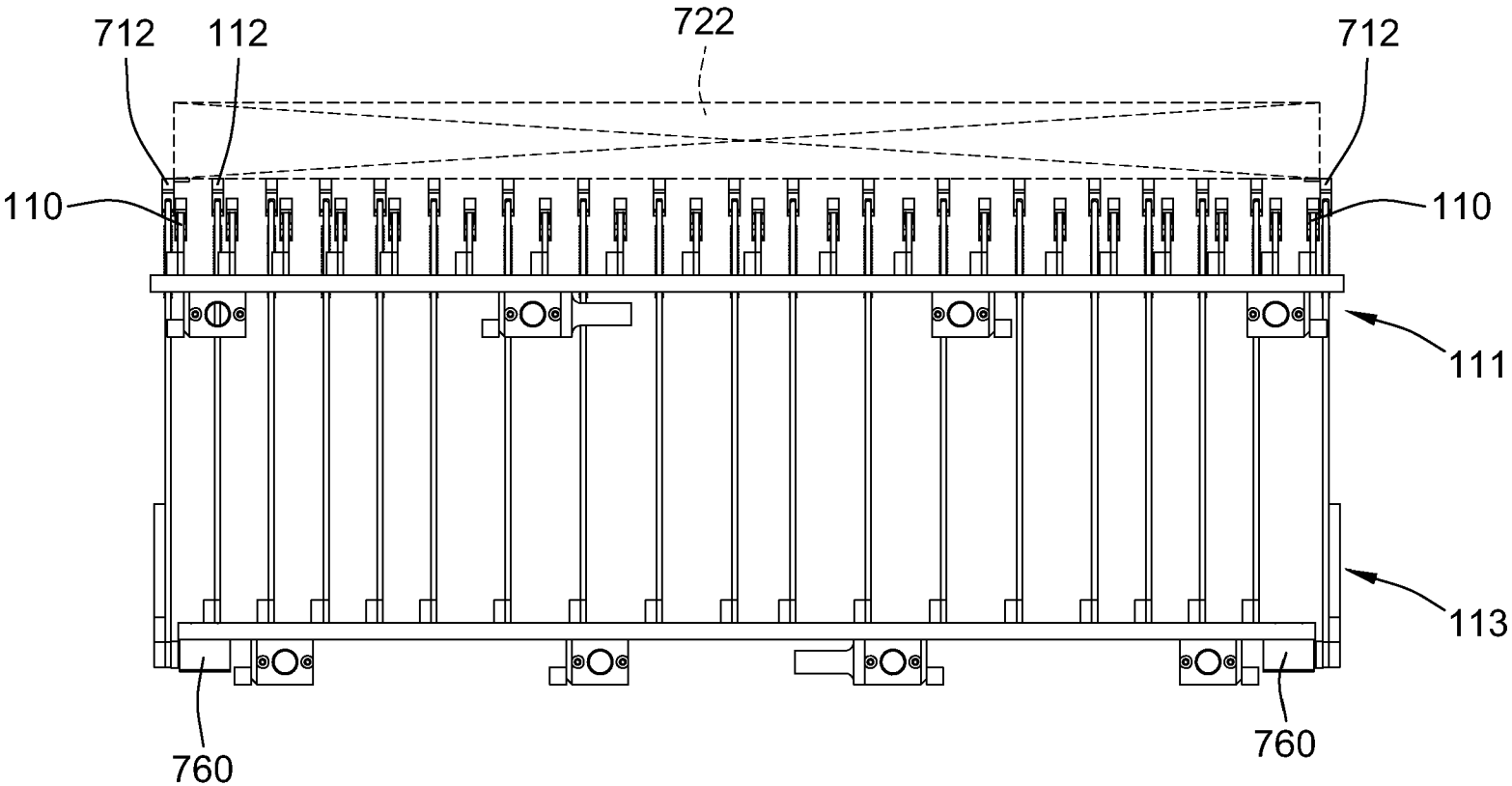
FIG. 21 is a side view of the carriage of FIG. 20 in proximity to another build finger carriage.

With reference now to FIG. 21, the second build fingers 112 as well as the outer build fingers 712 are illustrated supporting a stack 722. The first build fingers 110 carried by carriage 111 are also illustrated. From inspection of FIG. 21, it will be recognized that the additional width of the outer build fingers 712 allows for the outer build fingers 712 to support the stack 722 at the same location that the outermost build fingers of the first build fingers 110 would support the stack 722. As a result, each stack operated upon by the separator apparatus 100 will be supported in the same manner independently of the particular one of the first and second arrays of build fingers 110, 112 used to support the stack.

Figure 22:
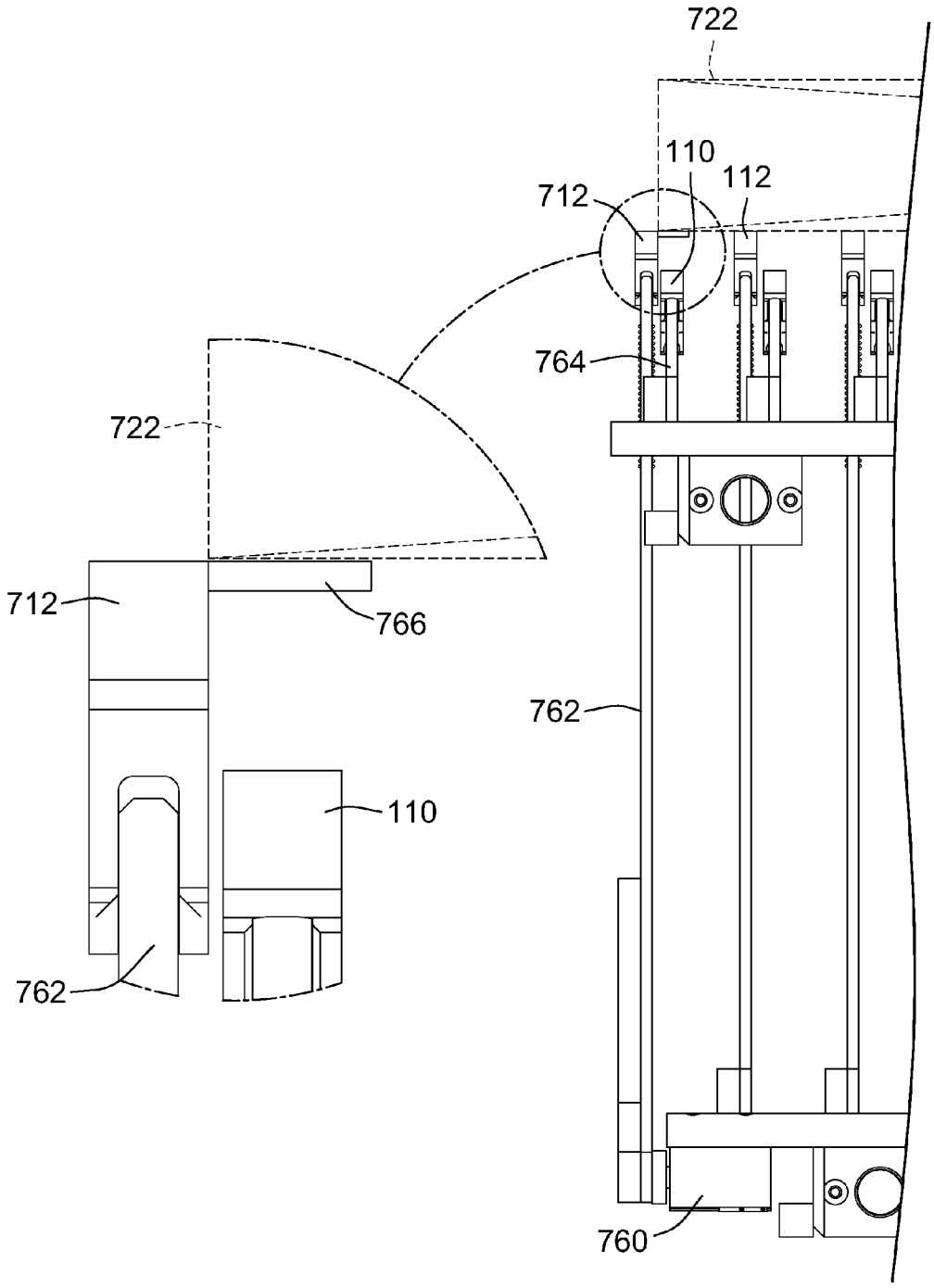
FIGS. 22-25 are partial side views of the carriages of FIG. 21 at various stages of operation.

The particular point in operation illustrated in FIG. 22 is that at which the second build fingers 112, including the outermost build fingers 712, are supporting the stack 722 and moving the same towards a conveyor 126 (see e.g. FIG. 7*a*) positioned below the stack 722. Simultaneously, the first build fingers 110 are moving upstream to begin supporting the next stack as described above. The outer build finger drives 760 are in a retracted position such that the outer build fingers 712 are also in a retracted position.

Still referring now to FIG. 22, the build finger arms 762 of the outer build fingers 712 are situated outside of the build finger arms 764 of the outermost first build fingers 110. Nonetheless, due to the greater width of the outer build fingers 712, the same can still support the extremities of the stack 722. More specifically, each of the outer build fingers 712 includes a support portion 766 that extends inwardly from the build finger arms 762 of the outer build fingers 712 to support the stack 722 as illustrated.

Figure 23:
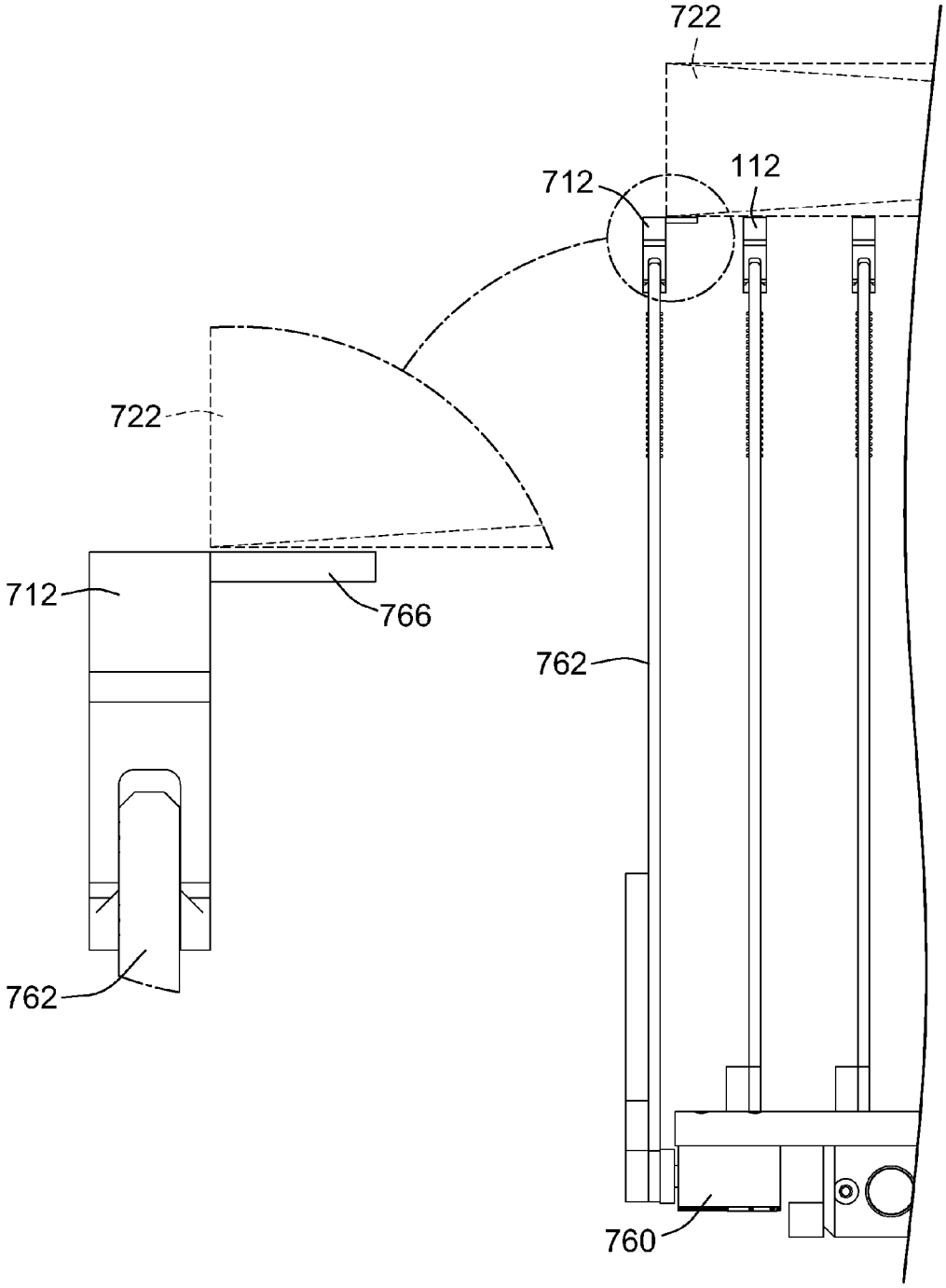
Figure 24:
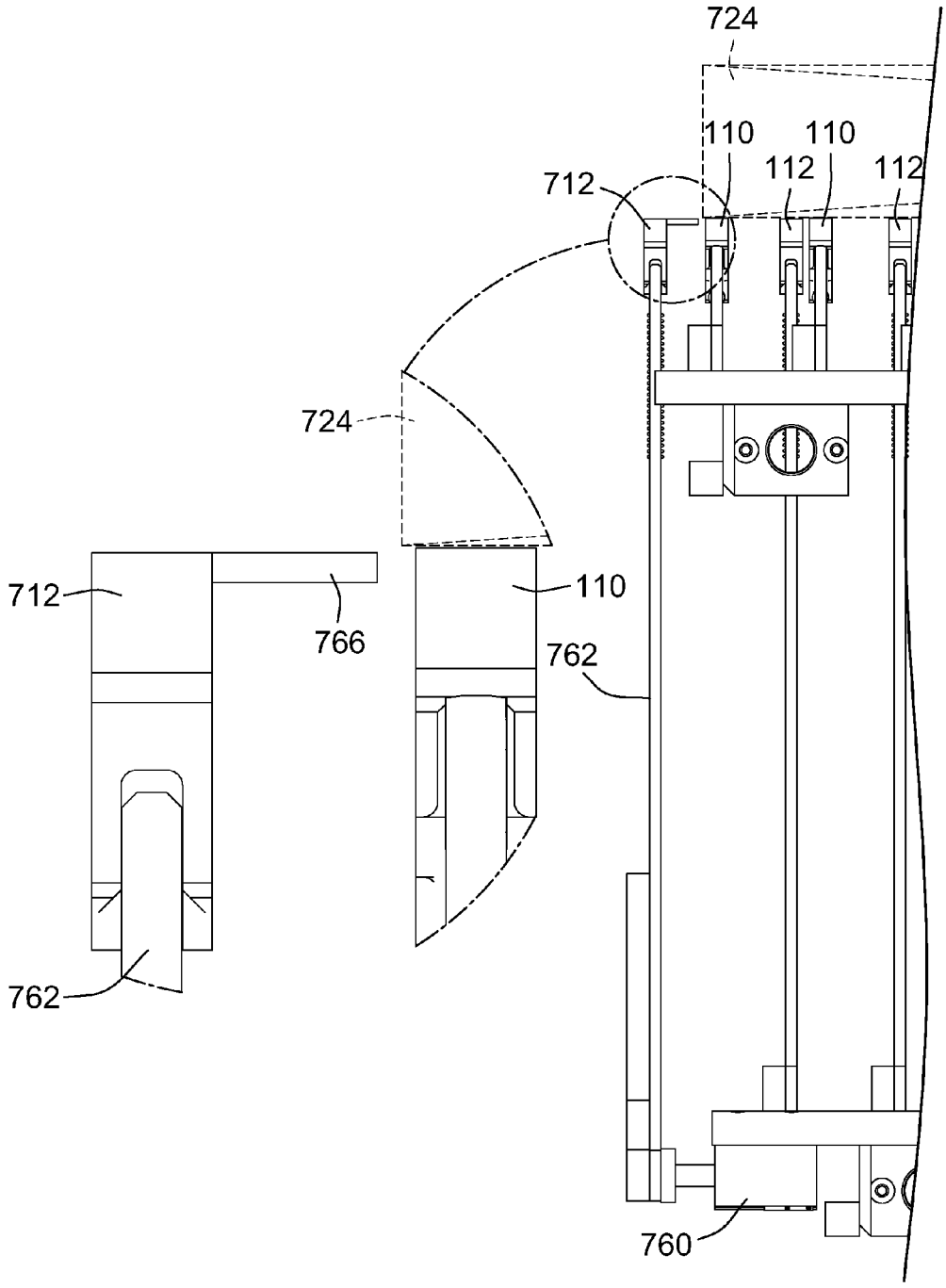

Turning now to FIG. 23, the above discussed arrangement allows for the first build fingers 110 and associated carriage 111 to move entirely above the stack 722 to support the next stack 724 as illustrated in FIG. 24. Once the second build fingers 112 including the outer build fingers 112 have dropped off the first stack 722 the outer build finger drives 760 extend the build finger arms 762 and outer build fingers 712 to an extended position so that the second build fingers 112 as well as the outer build fingers 712 can move upstream of the first build fingers 110 that continue to support the next stack 724. As illustrated, the build finger drives 760 are linear actuators in the form of pistons operable to displace the outer build fingers 712 as described herein. However, it will be recognized that other types of actuators could be utilized to displace the outer build fingers 712 as described herein.

Figure 25:
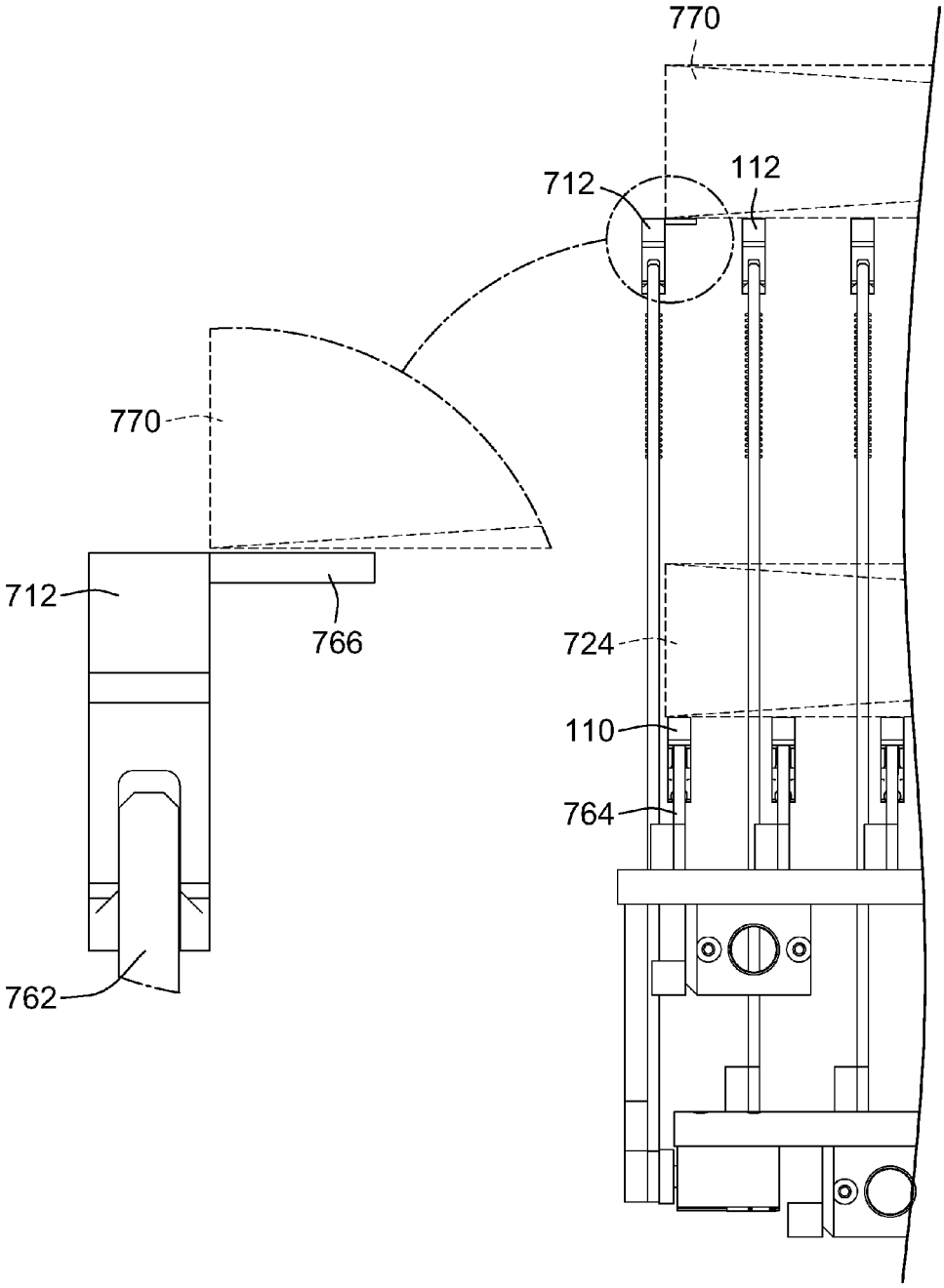

With reference now to FIG. 25, once the outer build fingers 712, and the remainder of the second build fingers 112 move upstream of the outermost build fingers of the first build fingers 110, the outer build finger drives 760 retract the build finger arms 762 and outer build fingers 712 to their retracted position. The first build fingers 110 continue to move the next stack 724 downstream as illustrated. The outer build fingers 712 and the second build fingers 112 thereafter make contact with yet another stack 770 to repeat the above described cycle.

Although only one outer build finger 712 illustrated at FIGS. 22-25, it will be recognized that the above described operation applies equally to the other outer build finger 712 (not illustrated). Further, it will also be recognized that the extendible and retractable outer build fingers 712 are not limited to carriage 113 carrying the second build fingers 112. Indeed, the above can equally apply to the carriage 111 carrying the first build fingers 110 depending on the relative arrangement of the first and second build fingers 110, 112.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for forming completed packs containing a desired number of folded sheets formed in a stacking region below a pair of folding rolls along a sheet path extending through a nip between the pair of folding rolls by a continuously flowing sheet stream of folded sheets issuing downstream from the pair of folding rolls along the sheet path and having adjacent panels forming successive folds opening alternately in opposite directions substantially transversely to the sheet path, the apparatus comprising:

at least one count finger insertable into one of the successive folds to form a completed pack and to support a next pack as the next pack continues to be built; and a knock down finger operatively configured and connected to the at least one count finger and separately actuable therefrom to contact the completed pack downstream of the next pack and downstream of the at least one count finger to form a space between the completed pack and the next pack.

2. The apparatus of claim 1, wherein the at least one count finger includes a pair of count fingers, the pair of count fingers including a first and a second count finger, the first and second count fingers pivotable about first and second count finger axes, respectively, and movable in the downstream direction with the completed pack and the next pack, and wherein the knock down finger is commonly mounted with at least one of the first and second count fingers such that the knock down finger is movable with the at least one of the first and second count fingers.

3. The apparatus of claim 2, wherein the knock down finger is commonly mounted such that it is pivotable about at least one of the first and second count finger axes.

4. The apparatus of claim 3, wherein the knock down finger is pivotable in a first direction about the at least one first and second count finger axis to contact a last panel of the completed pack to form the space between the completed pack and the next pack such that a build finger of the apparatus is insertable into one of the adjacent successive folds entirely above a last panel of the completed pack.

5. The apparatus of claim 4, wherein the knock down finger is pivotable in a second direction opposite the first direction to discontinue contact with the last panel of the completed pack prior to insertion of the build finger.

6. The apparatus of claim 1, wherein a top surface of the knock down finger and a top surface of the at least one count finger are coplanar when the knock down finger is in a retracted position.

* * * * *